US006028257A

United States Patent [19]

May

[11] Patent Number: 6,028,257

[45] Date of Patent: Feb. 22, 2000

[54] CARRIER ASSEMBLY FOR PERCUSSION INSTRUMENTS

[76] Inventor: Randall L. May, 8 Windsor, Newport Beach, Calif. 92660

[21] Appl. No.: 08/976,999

[22] Filed: Nov. 24, 1997

Related U.S. Application Data

[63] Continuation-in-part of application No. 08/588,244, Jan. 18, 1996, Pat. No. 5,691,492.

[51] Int. Cl.[7] ..... G10G 5/00

[52] U.S. Cl. ..... 84/421; 84/411 R; 248/443

[58] Field of Search ..... 84/411 R, 421, 84/453; 248/441.1, 443, 444; 984/257

[56] References Cited

U.S. PATENT DOCUMENTS

| | | | |
|---|---|---|---|
| 4,387,839 | 6/1983 | Dranchack | 224/265 |
| 4,453,446 | 6/1984 | Hoshino | 84/421 |
| 4,796,508 | 1/1989 | Hoshino | 84/421 |
| 4,799,610 | 1/1989 | Hsieh | 224/266 |
| 5,105,706 | 4/1992 | Lombardi | 84/422.3 |
| 5,400,683 | 3/1995 | LaFlame | 84/421 |
| 5,573,158 | 11/1996 | Penn | 224/265 |

*Primary Examiner*—Robert E. Nappi
*Assistant Examiner*—Marlon T. Fletcher
*Attorney, Agent, or Firm*—Neal J. Mosely

[57] ABSTRACT

Drum hardware and drum secured thereon are preferably supported on a vest type carrier or a T-bar carrier having a plurality of separate parts removable from each other and formed of a rigid light metal such as magnesium, aluminum or titanium. Special padding is provided on the shoulder straps, belly plate portion and other parts where cushioning is needed. The hardware is preferably universally adjustable. Some of the vests or T-bar carriers have cymbal supporting hardware adjustable carried on a fluted, vertically oriented tube. Special hardware is shown for supporting cymbals and other components.

55 Claims, 35 Drawing Sheets

CARRIER ASSEMBLY FOR PERCUSSION INSTRUMENTS

CROSS REFERENCE TO RELATED APPLICATION

This application is a continuation-in-part of applicant's application Ser. No. 08/588,244, now U.S. Pat. No. 5,691,492, issued Nov. 25, 1997.

BACKGROUND OF THE INVENTION

1. Field of the Invention

This invention relates to new and useful improvements in apparatus for carrying percussion instruments, particularly drums of various kinds, cymbals, xylophones, and the like. More particularly, the present invention relates to a carrier hardware providing a novel support for percussion instruments and to carrier assemblies supporting percussion instruments on a person while standing, walking or marching. The carrier assembly has a construction and relationship of parts to transfer the weight of the percussion instrument (s) to the body of a person carrying the same to maintain a stable attitude while walking or marching about and avoid pressure or other forms of detrimental forces on the shoulders and lower back.

2. Brief Description of the Prior Art

The prior art discloses many examples of apparatus for supporting percussion instruments but none providing the combination of features disclosed and claimed herein.

La Flame U.S. Pat. No. 5,400,683 discloses a carrier for percussion instruments having an abdominal plate connected at one end of a unitary frame partly encircling the wearer at the waist and having an upstanding rear portion pivotally connected to a back pressure plate. Shoulder bars are connected to the back pressure plate and wrap about shoulders and support straps connect to the abdominal plate which has suitable fixtures for attachment of various percussion instruments.

Hsieh U.S. Pat. No. 4,799,610 shows a carrier for percussion instruments having a "T" bar, a pair of shoulder bars, a belly plate. The shoulder bars are bolted on a lateral plate of the "T" bar. The lateral plate has arc-like slots and spaced semi-circular holes permit bolts to slide in the slots. The fastening end of each shoulder bar has a hole and an arc-like slot from the upper portion to the lower portion permitting angular adjustment of the shoulder rightward or leftward for various applications. The carrier holder is applied to carrying a bass drum fastened by J-bars.

La Flame U.S. Pat. No. 4,643,032 shows a carrier for various instruments such as marching bells, a marching xylophone or a marching marimba, which are sup-ported on the apparatus by the use of suitably-constructed extension arms. The carrier frame is a U-shaped bent bar welded or othervise attached to a belly plate and has extension arms which project from the belly plate to engage and support the instrument.

La Flame U.S. Pat. No. 4,605,144 shows an instrument carrier with a forwardly-projecting frame portion having a drum mounting assembly. The mounting assembly has adjustable clamp jaw elements with curved surfaces which conform to the cylindrical side wall of a drum. In practice, the side wall of the drum is sandwiched between the jaw elements and the assembly is secured in clamping engagement on the drum side wall by mechanical fasteners such as a pair of screw and nut sets which are passed through bores in the clamp elements and drawn tight to securely clamp the drum side wall. The mounting assembly may be mounted on the side wall of drum between the drum heads or, alternatively, on a portion of the side wall or a rim which projects outwardly of the drum head.

Dranchak U.S. Pat. No. 4,387,839 discloses a drum-supporting harness having two shoulder hooks with cushion pads or liners, a breast plate secured to the hooks, and a hanger structure attached to the breast plate and depending therefrom. Carried by the lower portion of the hanger structure are upwardly-facing hooks, a spacer bar extending downward from the hooks, and a spacing abutment carried by the spacer bar and extending forwardly therefrom. The hooks and the spacing abutment engage upper and lower portions of the body of the drum. The hanger structure is adjustable or extensible by means of overlapping strips which can be secured in a number of different positions. An adapter assembly attaches to the upper rim portion of the drum for connecting of hooks 16 to the drum.

La Flame GB patent 2,123,676 (based on U.S. Pat. No. 4,453,442) discloses a carrier for percussion instruments or the like which includes the combination of a belly plate with a carrier bracket for supporting an instrument at an outwardly-overhung position about a fulcrum area of contact with the front waistline area of the person, a rigid band with a generally bent contour to extend along a portion of the waistline area of the person to the back of the person, a back-plate riser arm supported by the ban to extend in a generally upward direction such that a portion of the arm will extend along the back thoracic region of the person, and means carried by the arm for imparting to the thoracic back region of the person a reactive force to the overhung weight of the instrument about the aforesaid means forming a fulcrum area of contact with the person.

Other possibly relevant prior art is Pyle U.S. Pat. No. 5,054,357; May U.S. Pat. No. 5,072,910 and May U.S. Pat. No. 5,300,810.

SUMMARY OF THE INVENTION

One object of the invention is to provide a new and improved carrier for percussion instruments, e.g., a snare drum, having hardware for supporting a drum comprising a plate with bosses having holes to receive J-rods.

Another object of the invention is to provide a new and improved carrier for percussion instruments, e.g., a snare drum, having hardware for supporting a drum comprising a plate with clamps having polygonal recesses to receive and clamp J-rods around their peripheries.

Another object of the invention is to provide a new and improved a clamp having polygonal recesses to receive and clamp J-rods or posts around their peripheries.

Another object of the invention is to provide a new and improved clamp having a plurality of polygonal recesses to receive and clamp J-rods or posts around their peripheries in spaced apart relation.

Another object of the invention is to provide a new and improved carrier for percussion instruments comprising a novel supporting vest.

Another object of the invention is to provide a new and improved carrier for percussion instruments comprising a novel supporting vest in two parts supported adjustably for movement of the parts toward and away from each other.

Another object of the invention is to provide a new and improved carrier for percussion instruments comprising a novel supporting vest in two parts supported adjustably for movement of the parts toward and away from each other.

Another object of the invention is to provide a new and improved carrier for percussion instruments comprising a novel supporting vest in two parts supported adjustably on a clamp having a plurality of polygonal recesses to receive and clamp supporting rods or posts for movement of the vest parts toward and away from each other.

Another object of the invention is to provide a new and improved carrier for percussion instruments comprising a novel supporting vest having separate pieces, a vest of composite material (Fiberglas), rigid shoulder straps of light metal, and back bar of light metal such as aluminum, magnesium, etc.

Another object of the invention is to provide a new and improved carrier for percussion instruments comprising a novel supporting vest having separate pieces, a vest of composite material (Fiberglas), rigid shoulder straps of light metal, and back bar of light metal such as aluminum, magnesium, etc., the shoulder straps being of two parts slidably fitted together for adjustment.

Another object of the invention is to provide a new and improved carrier for percussion instruments comprising a novel supporting vest having separate pieces, a vest of composite material (Fiberglas), rigid shoulder straps of light metal, and back bar of light metal such as aluminum, magnesium, etc., and a clamp having polygonal recesses to receive and clamp J-rods or posts around their peripheries in spaced relation on said vest.

Another object of the invention is to provide a new and improved carrier for percussion instruments comprising a novel T-bar carrier with belly plate, shoulder straps, and back bar of light metal such as aluminum, magnesium, etc.

Another object of the invention is to provide a new and improved carrier for percussion instruments comprising a novel T-bar carrier with belly plate, shoulder straps, and back bar of light metal such as aluminum, magnesium, etc. the shoulder straps being of two parts slidably fitted together for adjustment.

Another object of the invention is to provide a new and improved carrier for percussion instruments comprising a novel T-bar carrier with belly plate, shoulder straps, and back bar of light metal such as aluminum, magnesium with J-bars mounted on the carrier for supporting cymbals or other percussion instruments.

Another object of the invention is to provide a new and improved carrier for percussion instruments comprising a novel T-bar carrier with belly plate, shoulder straps, and back bar of light metal such as aluminum, magnesium with a fluted tube mounted on the carrier having adjustably pivoted arms for supporting cymbals or other percussion instruments in a variety of positions.

Another object of the invention is to provide a new and improved carrier for percussion instruments comprising a novel T-bar carrier with belly plate, shoulder straps, and back bar of light metal such as aluminum, magnesium with J-rod receptors on the belly plate and a fluted tube mounted on extensions to the ends of the belly plate having adjustably pivoted arms for supporting cymbals or other percussion instruments in a variety of positions.

Another object of the invention is to provide a new and improved carrier for percussion instruments comprising a novel T-bar carrier having a construction permitting almost universal adjustment of the points of attachment and location of the percussion instruments.

Another object of the invention is to provide a new and improved carrier for percussion instruments, particularly marching hardware, a construction permitting almost universal adjustment of the points of attachment and location of the percussion instruments and further having adjustable connections for the shoulder straps permitting longitudinal and angular adjustment.

Other objects of the invention will become apparent throughout the specification and claims as hereinafter related.

DESCRIPTION OF THE PREFERRED EMBODIMENTS

FREE FLOATING SNARE ASSEMBLY

Figure 1:
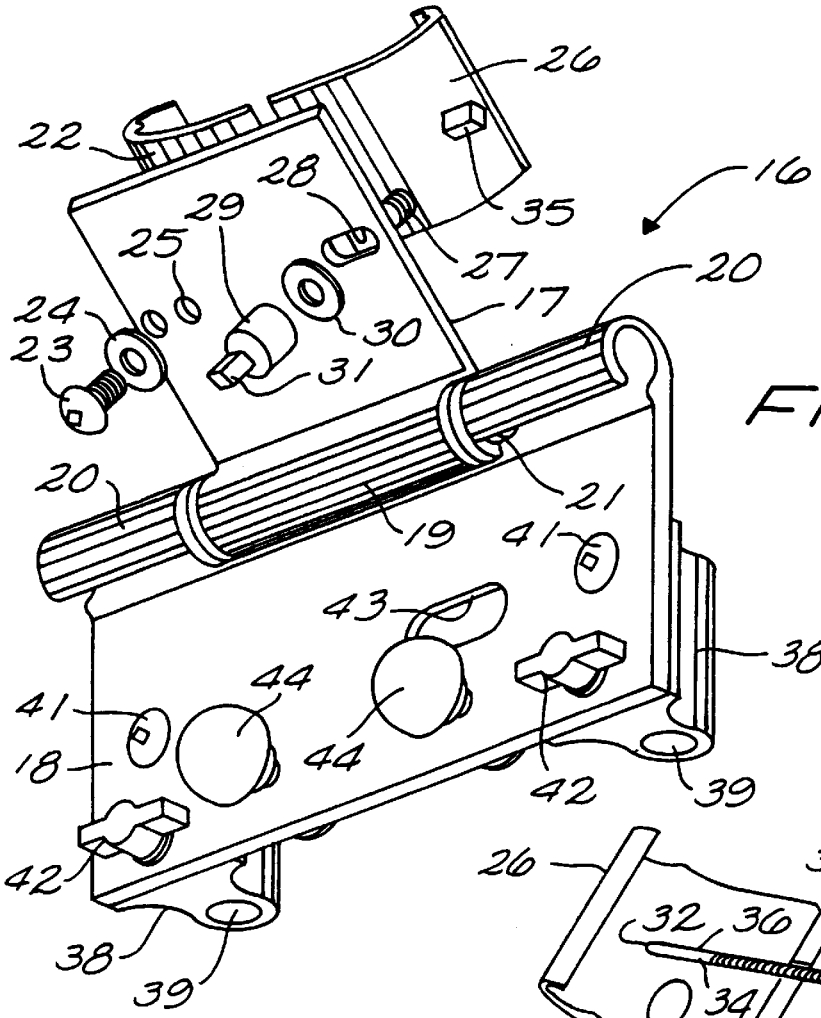
FIG. 1 is a rear isometric view, partly exploded, of hardware for supporting a snare drum, in accordance with a preferred embodiment of the invention.
Figure 2:
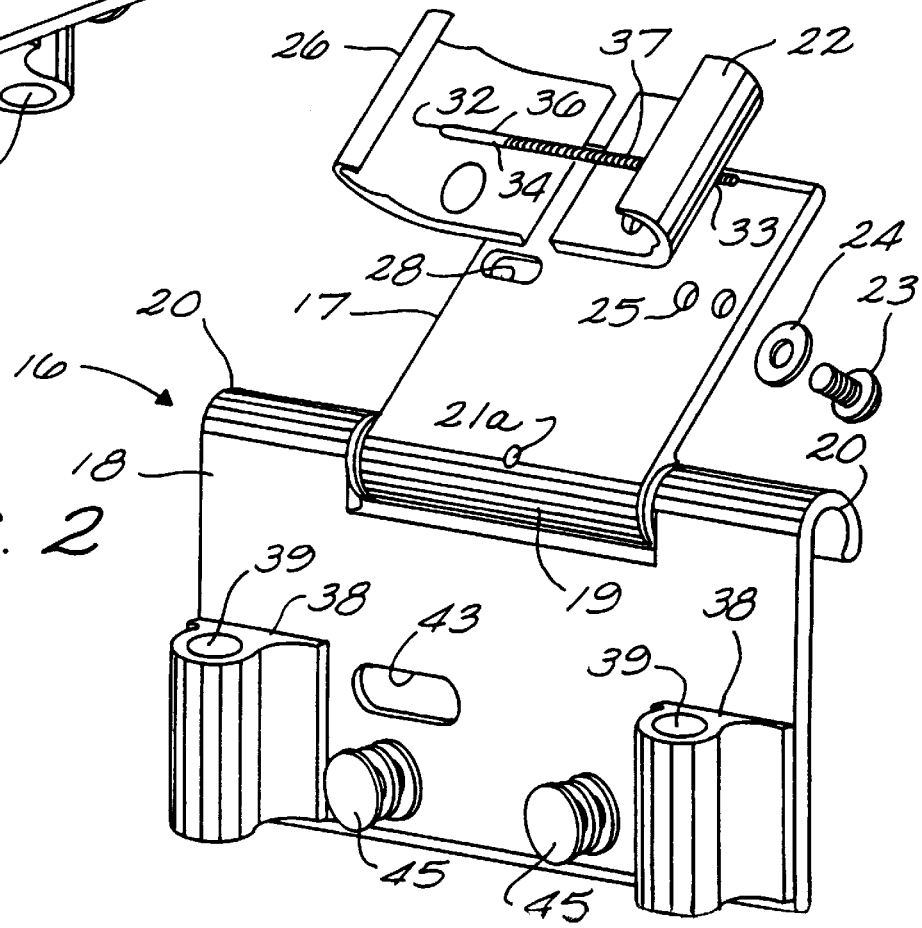
FIG. 2 is a front isometric view, partly exploded, of hardware for supporting a drum as shown in FIG. 1.
Figure 3:
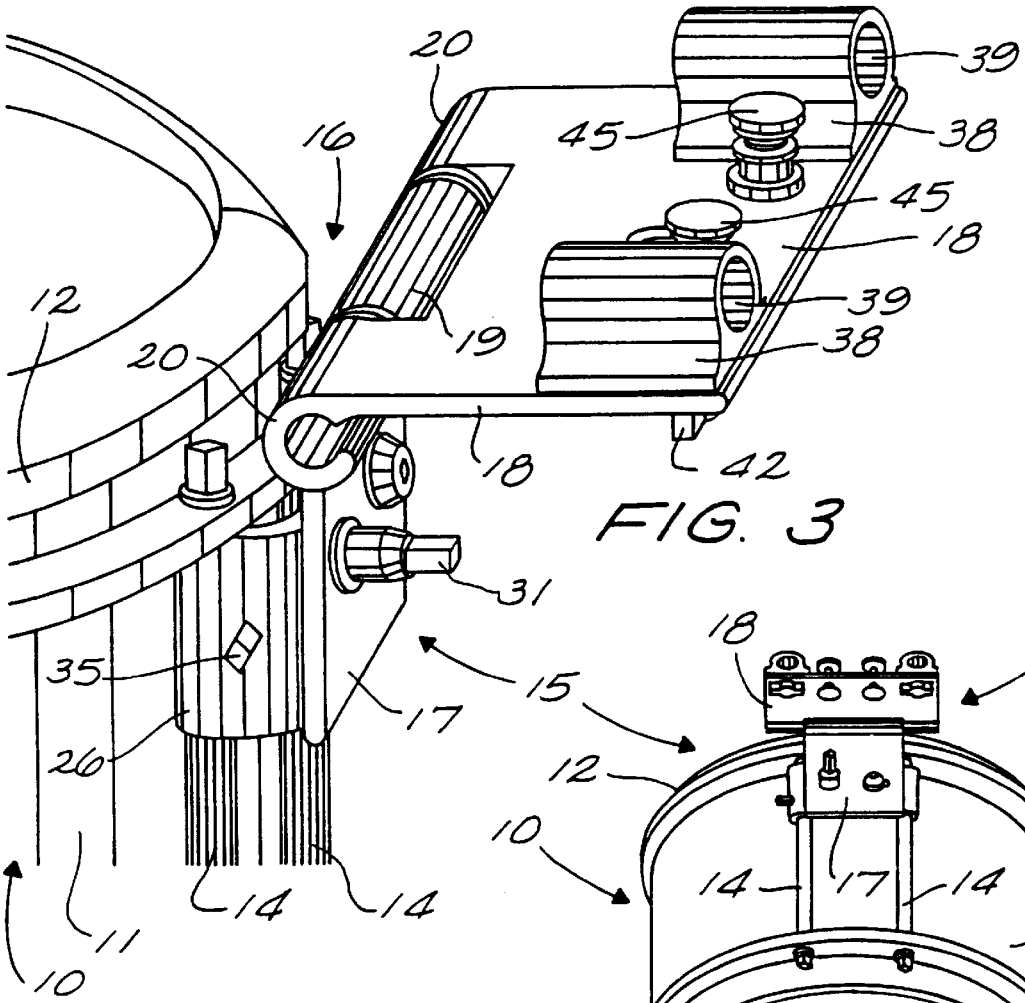
FIG. 3 is a side isometric view of the hardware shown in FIGS. 1 and 2 connected in supporting relation to the tension rods of a drum.
Figure 4:
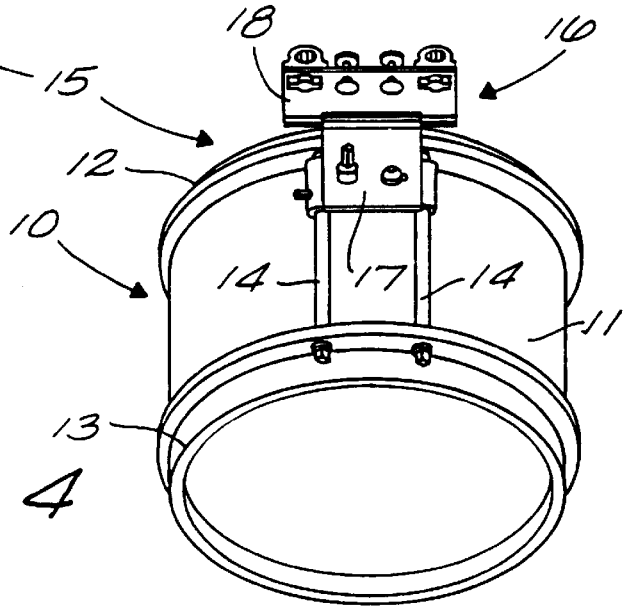
FIG. 4 is an isometric view of the drum and hardware shown in FIG. 3 showing the connection of the hardware to the drum and the underside of the hardware fully opened.
Figure 5:
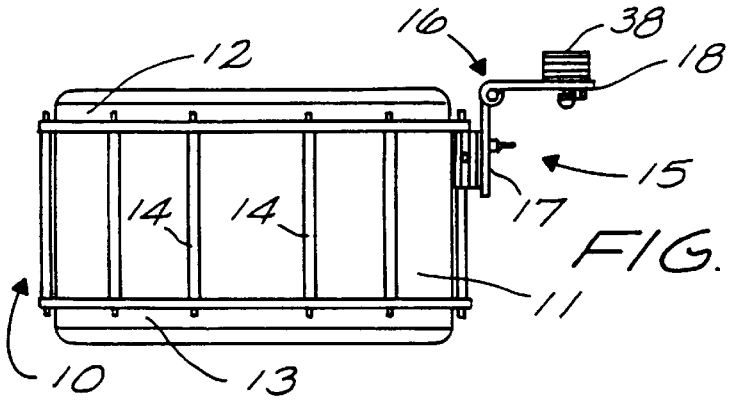
FIG. 5 is a side elevation of the drum and hardware shown in FIG. 3.

Referring to the drawings by numerals of reference, and more particularly to FIGS. 1–6, a snare drum 10 (FIGS. 4–6), is shown of conventional construction, having a shell 11, upper and lower drum heads 12 and 13, secured by tension rods 14 interconnecting the rims of drum heads 12 and 13.

A novel hardware assembly 15 (FIGS. 1–6) is secured on drum 10 and is referred to as a free floating snare assembly. Hardware 15 comprises the combination with drum 10 of a supporting hinge assembly 16 having a stationary hinge plate 18 and rotation hinge plate 17 with knuckles 19 and 20, respectively, interconnected by hinge pin 21 held in place by a set screw 21*a*.

Rotation hinge plate 17 supports a stationary clamp 22 secured in a fixed position by bolt 23, and washer 24, extending through hole 25. Adjustable clamp 26 is secured on rotation hinge plate 17 by bolt 27 extending through slot 28 and cooperating lock nut 29 and washer 30. The head 31 of lock nut 29 is configured for operation by a drum key. Stationary clamp 22 has a threaded hole 33 and adjustable clamp 26 has a hole 32 for receiving an adjustable clamp tension rod 34. Rod 34 has a head 35 configured for operation by a drum key and has a smooth portion 36 smoothly rotatable in hole 32 and a threaded end portion 37 threaded into hole 33 for adjusting the lateral positioning of the clamps.

Figure 6:
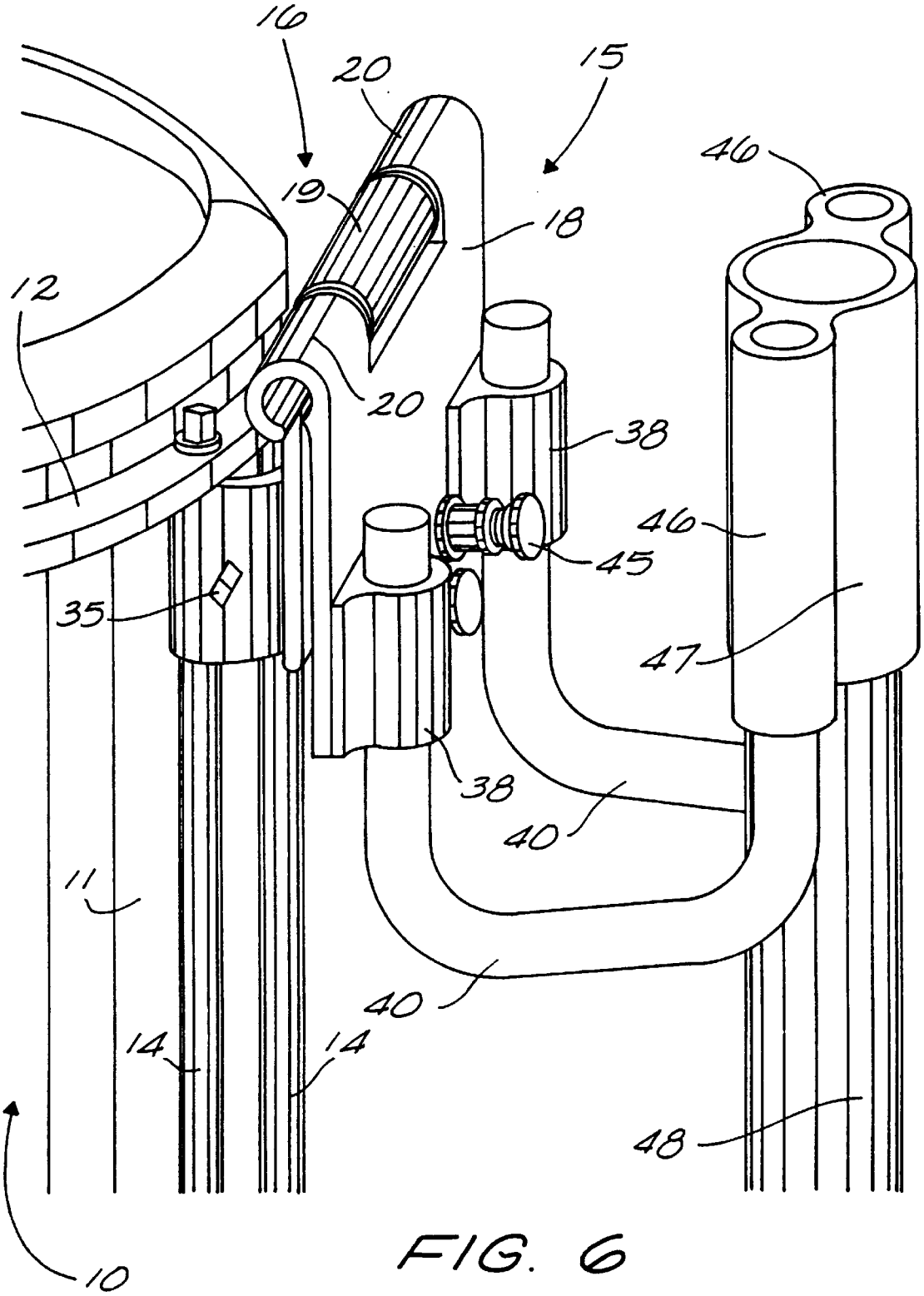
FIG. 6 is an isometric view of the fully assembled drum and supporting hardware supported on J-bars on a pedestal support.

Stationary hinge plate 18 supports a pair of receptacles 38 having longitudinal holes 39 for receiving J-rods 40 (FIG. 6). Receptacles 38 are secured on stationary hinge plate 18 by bolts 41 and T-bolts 42. A slot 43 is aligned with and receives lock nut head 31 to permit adjustment when the hinge is closed. A pair of adjustable bumpers 44, for tilt adjustment, are secured through holes in stationary hinge plate 18 by knobs 45 threaded on bolts extending from the bumpers. J-rods 40 have one end extending into and supporting receptacles 38 and another end extending into receptacles 46 on a supporting bracket 47 positioned on the post 48 of a tripod (not shown) such as that shown in May U.S. Pat. No. 5,072,910. J-rods 40 may also be supported in any other suitable support, such as in the various marching carriers shown and described below.

OPERATION

The operation of this supporting hardware should be apparent but will be described in some detail for clarity of understanding. Referring to FIGS. 1–6, hardware 16 is installed on drum 10 by placing rotation hinge plate 17 against the drum with clamps 22 & 26 hooked over two of the drum tension rods 14. Tension rod 34 is rotated by application of a drum key (not shown) to head 35 to draw the clamps 22 & 26 together, with lock nut 29 loosened to permit clamp 26 and its bolt 27 to slide in slot 28. After the clamps 22 & 26 are tightened on tension rods 14, lock nut 29 is tightened to secure the hardware 16 in place. Next, knobs 45 are rotated to adjust bumpers 44 to set the desired amount of tilt of the drum 10. Stationary hinge plate 18 is then assembled on a suitable support by inserting J-rods 40 into holes 39 in receptacles 38. J-rods 40 are in turn supported in receptacles 46 on bracket 47 supported on tripod post 48 or in other supports such as the supporting vests or T-bar supports described below.

ANOTHER EMBODIMENT OF DRUM HARDWARE

Another hardware assembly 49 (FIGS. 7–12) is secured on drum 10*a* and is referred to as a modified floating snare assembly. Hardware 49 comprises the combination with drum 10*a* of a supporting hinge assembly 50 having a stationary hinge plate 51 and rotation hinge plate 52 with knuckles 53 and 54, respectively, interconnected by hinge pin 55 held in place by a set screw 64.

Rotation hinge plate 52 (FIG. 9) supports a pair of clamps 56 secured removably thereon by bolts 57 and nuts 58 for securing this hinge plate to drum 10*a* by clamping on two of the drum tension rods 59. Bolts 57 extend through oversized holes or slots 57*a* which allow for a small amount of lateral adjustment to cover small variances in the spacing of drum tension rods 59 and also in different sized drums, e.g. 13" and 14" drums. Knuckle 54 has aligned holes through which hinge pin 55 extends and washers 60 on opposite ends thereof.

Figure 7:
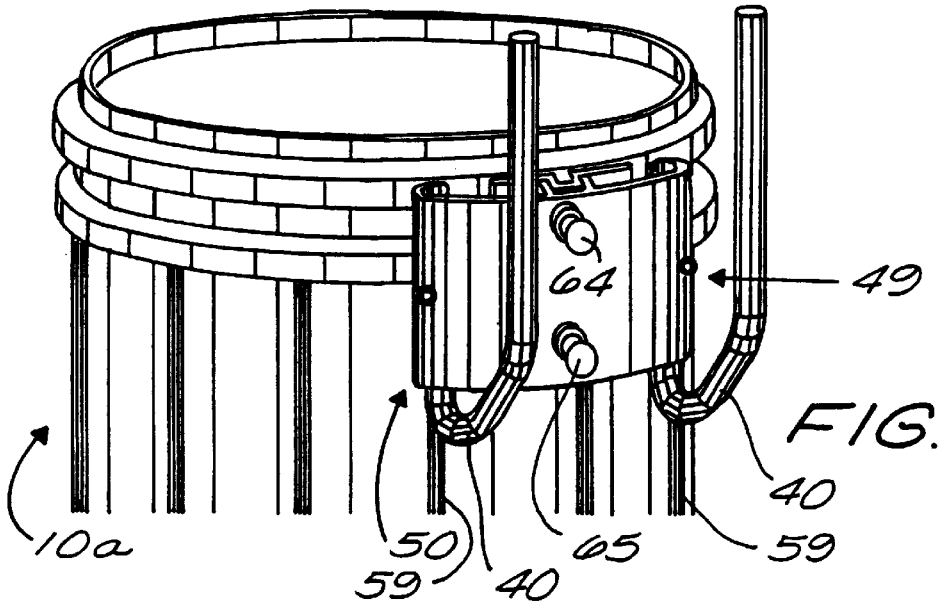
FIG. 7 is an isometric view of hardware supporting a drum for tilting or rotation in accordance with another embodiment of the invention.
Figure 8:
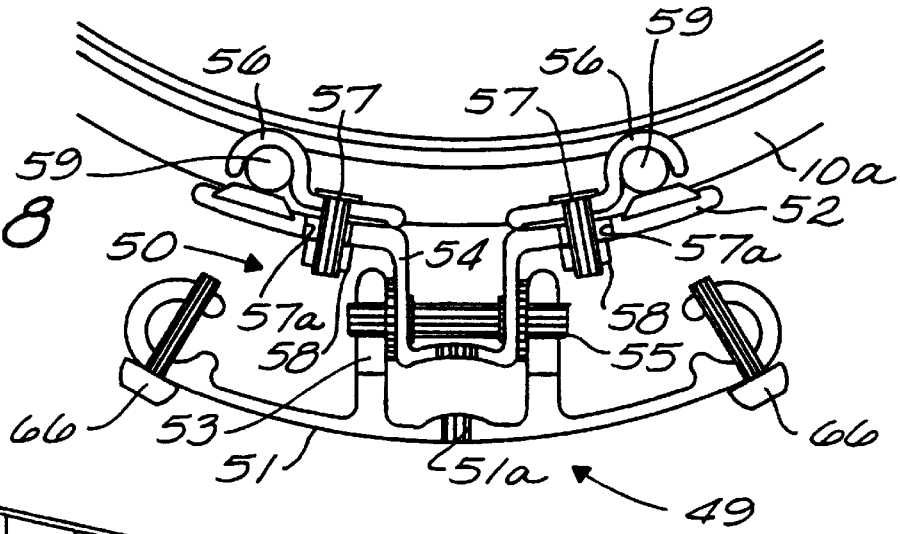
FIG. 8 is a top plan view of the assembled hardware and drum of FIG. 7.
Figure 9:
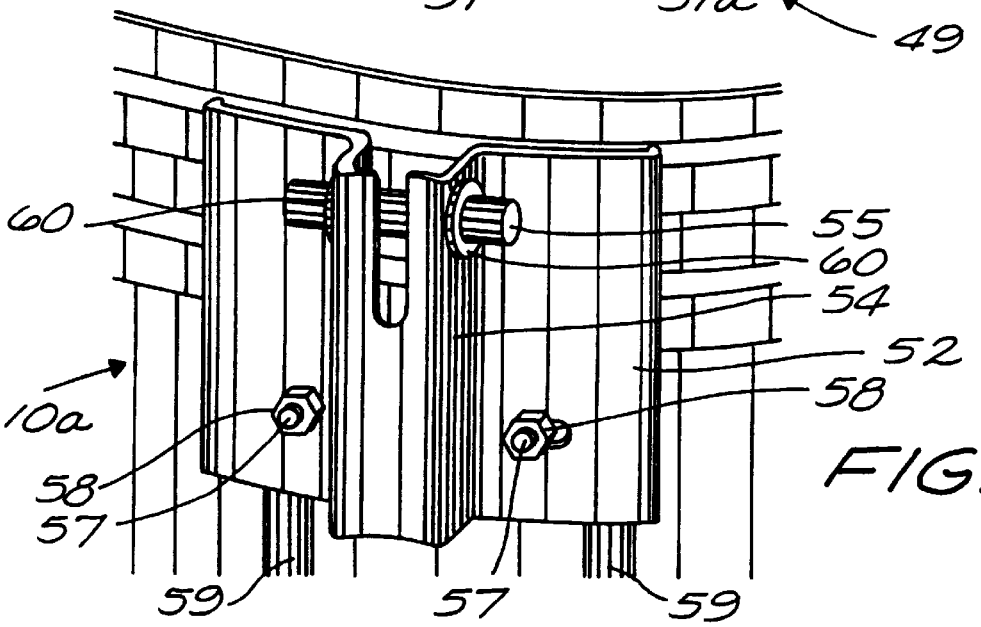
FIG. 9 is a detail view of the stationary hinge of another embodiment of the hardware assembled on a drum with the rotation hinge removed.
Figure 10:
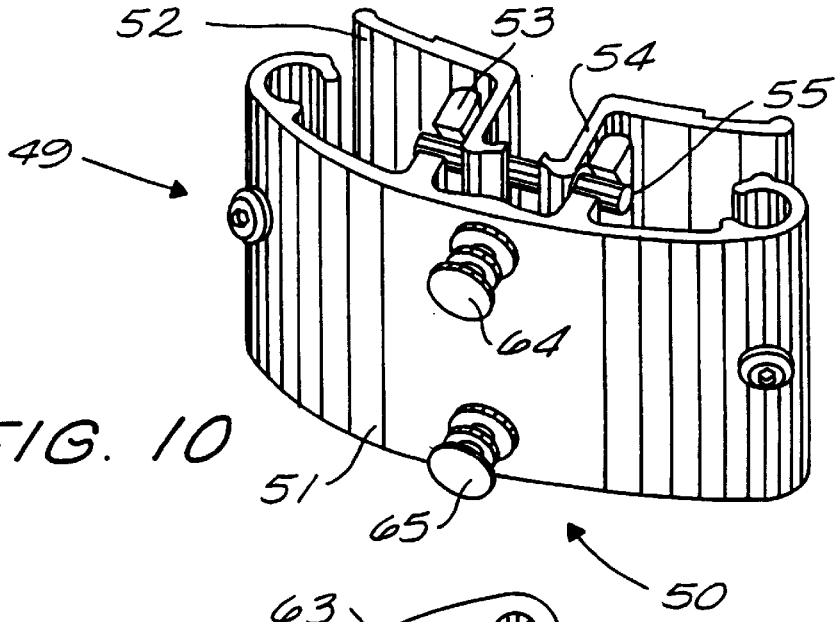
FIG. 10 is a top isometric view of the supporting hardware of FIG. 9 with the stationary hinge plate in place.
Figure 11:
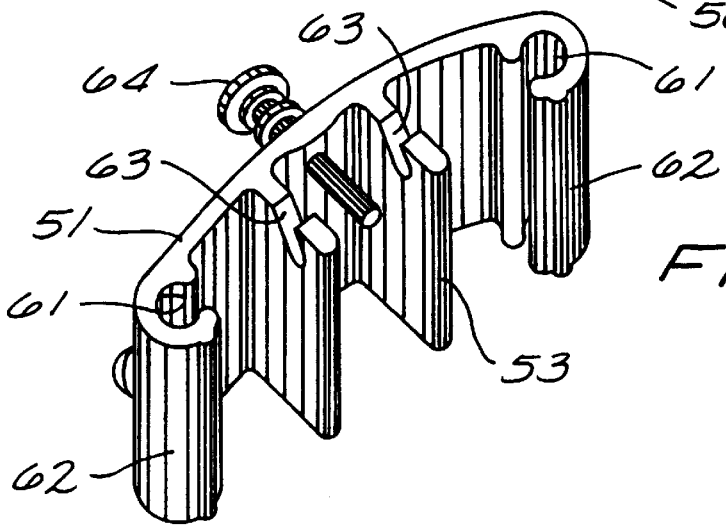
FIG. 11 is a top isometric view of the inside of the stationary hinge supporting hardware of FIG. 10.
Figure 12:
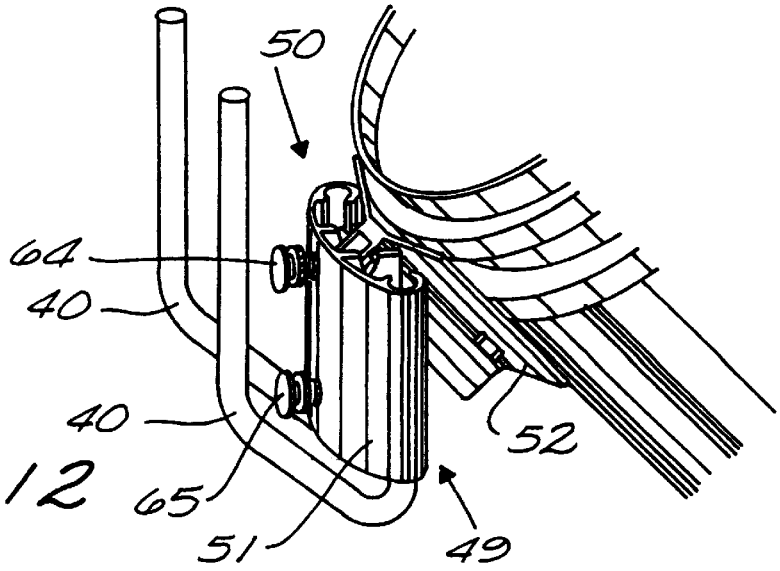
FIG. 12 is an isometric view of the fully assembled drum and supporting hardware of FIG. 10 with J-bars positioned for supporting the drum.

Stationary hinge plate 51 has a pair of circular channels 61 at opposite sides providing receptacles 62 for receiving J-rods 40 (FIGS. 7 & 12). Receptacles 62 are thus integral with stationary hinge plate 51 and do not require assembly as in the preceding example. Knuckle 53 has open top slots 63 at the top for ease of assembly of hinge pin 55 thereon.

Stationary hinge plate 51 has a pair of vertically spaced holes 51*a* (FIG. 8) in which there are positioned knob operated threaded pins 64 & 65. Upper pin 64 is threadedly adjustable into a position engaging hinge pin 55 to secure the assembly together and also functions to provide tilt pivot of the drum. Lower pin 65 functions as a bumper for tilt adjustment.

J-rods 40 have one end extending into and supporting receptacles 61, limited by threaded pins 66, and another end for support as in FIG. 6 in any other suitable support, such as in the various marching carriers shown and described below.

OPERATION

The operation of this supporting hardware should be apparent but will be described in some detail for clarity of understanding. Referring to FIGS. 7–12, hardware 49 is installed on drum 10*a* by first securing rotation hinge plate 52 against the drum with clamps 56 hooked over two of the drum tension rods 59 and bolts 57 extended through holes 57*a* and nuts 58 loosely secured thereon. Nuts 58 are then tightened, after any needed lateral adjustment of bolts 57, to secure hinge plate 52 tightly on tension rods 59. Hinge pin 55 and washers 60 are then installed. Next, rotation is installed by hooking knuckle 53 slots 63 on hinge pin 55 to establish a pivotal connection. Knob operated pin 64 is then adjusted to engage hinge pin 55 to secure the assembly. Knob operated pin 65 is adjustable for varying the tilt of the drum 10*a*. J-rods 40 (FIGS. 7 & 12) are then supported in receptacles 62 on stationary hinge plate 51 and may have the other ends supported as in FIG. 6 or in other supports such as the supporting vests or T-bar supports described below.

AN EMBODIMENT FOR SUPPORTING MULTIPLE DRUM ASSEMBLIES

Figure 13:
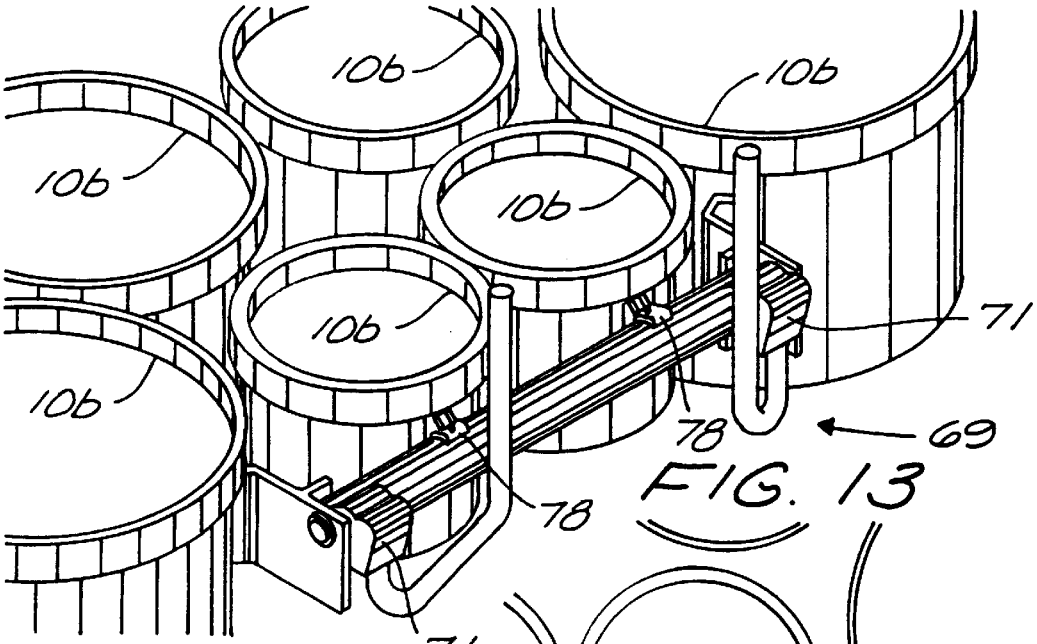
FIG. 13 is an isometric view of another embodiment of supporting hardware supporting an assembly of drums, as in a marching drum assembly.

Another hardware assembly 68 (FIGS. 13–16) is provided for supporting a multiple drum assembly 69 as used in marching bands. Multiple drum assembly or array 69 (FIG. 13) comprises a plurality, typically 2–6, of drums 10*b* secured together for support and carrying by a drummer as in a marching band. In this embodiment, hardware assembly 68 is varied from the previous examples, but utilizes the same principles of construction, to provide a hinged support between the drum assembly 69 and a suitable marching carrier as described in the embodiments described below.

Hardware assembly 68 (FIG. 14 & 15) comprises the combination with drum assembly 69, at the end drums 10*b*, of a supporting hinge assembly 70 having a stationary hinge portion comprising J-rod supporting members 71 and rotation hinge portion comprising end brackets 72. A cylinder 73 functions as the hinge pin for the assembly. Cylinder 73 has longitudinally extending flutes 74 in which the hooked jaws 75 of member 71 slide. T-bolt 76*a* on member 71 releasably fixes the position of member 71 longitudinally of cylinder 73. Members 71 are therefore adjustable in position according to the spacing of the J-rods on which the drum assembly is being supported and also function to vary the forward spacing of the drum assembly from the drummer.

Rotation hinge member, i.e., end brackets 72, have hooked portions 76 which may be physically attached, as by screws to the drum shells or may hook into tension rods or other abutments on the end drums 10*b* in the drum assembly. Members 77 having hooked jaws 78 slide longitudinally along flutes 74 and are fixed in position by T-bolts 79. Members 77 carry carriage bolts 80 (FIGS. 15 & 16) which penetrate the drum shell and are secured to the drum by a nut (not shown). End plates 72 are secured in position for rotation on the ends of fluted cylinder 73.

A pair of adjustable bumpers 81, for tilt adjustment, are secured through holes in a flange 82 on end plates 72 and abut fixed abutments 83 extending from fluted cylinder 73. Adjustable bumpers 82 are operated by knobs 84 on bolts extending from the bumpers to provide tilt adjustment of the drum assembly. J-rods 40 have one end extending into and supporting receptacles in members 71, and another end for support as in the various marching carriers shown and described below.

OPERATION

Figure 14:
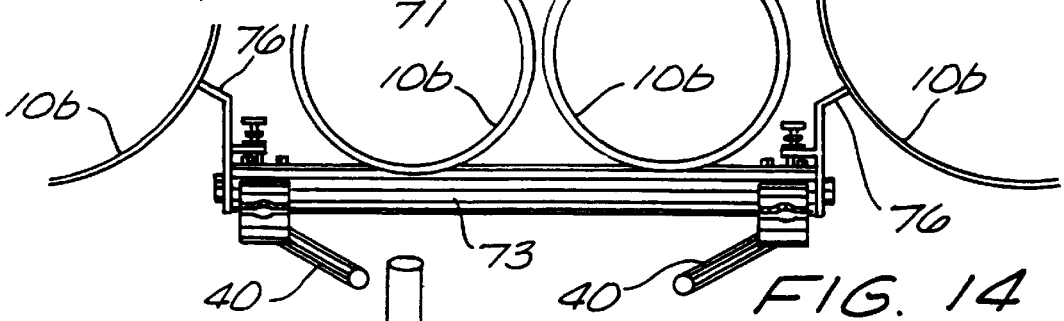
FIG. 14 is a top detail view of the hardware and a portion of the drums as shown in FIG. 13.
Figure 15:
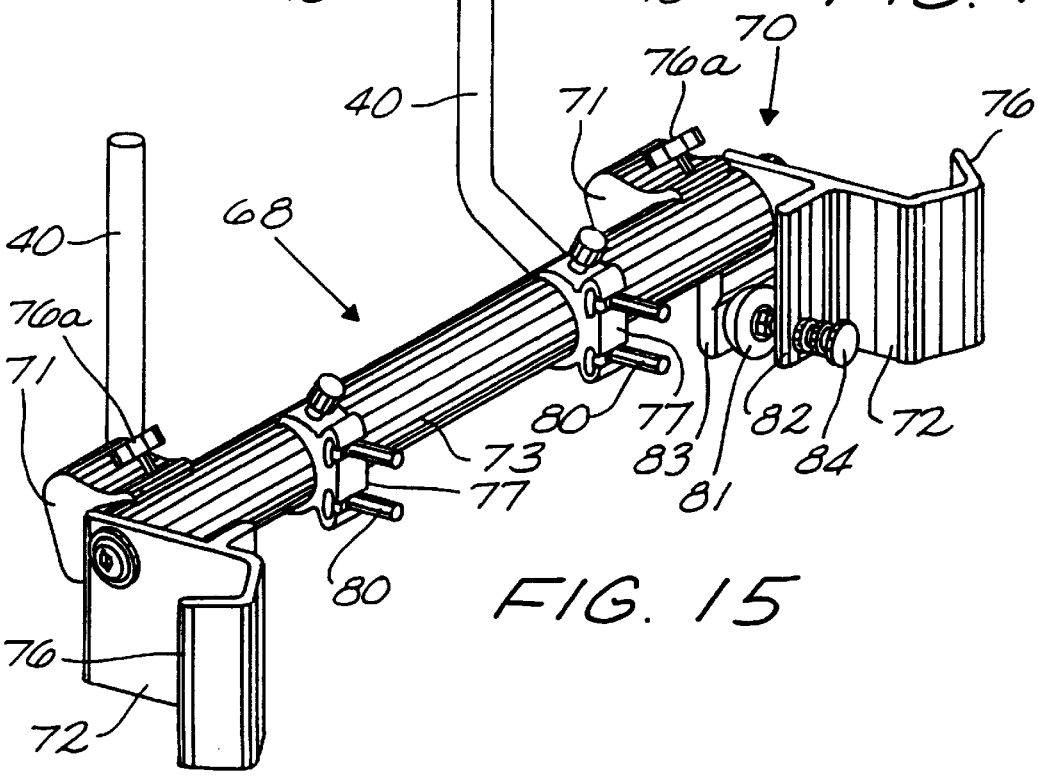
FIG. 15 is a detail isometric view of the hardware as shown in FIG. 13 showing the manner of connection of the supporting rods.
Figure 16:
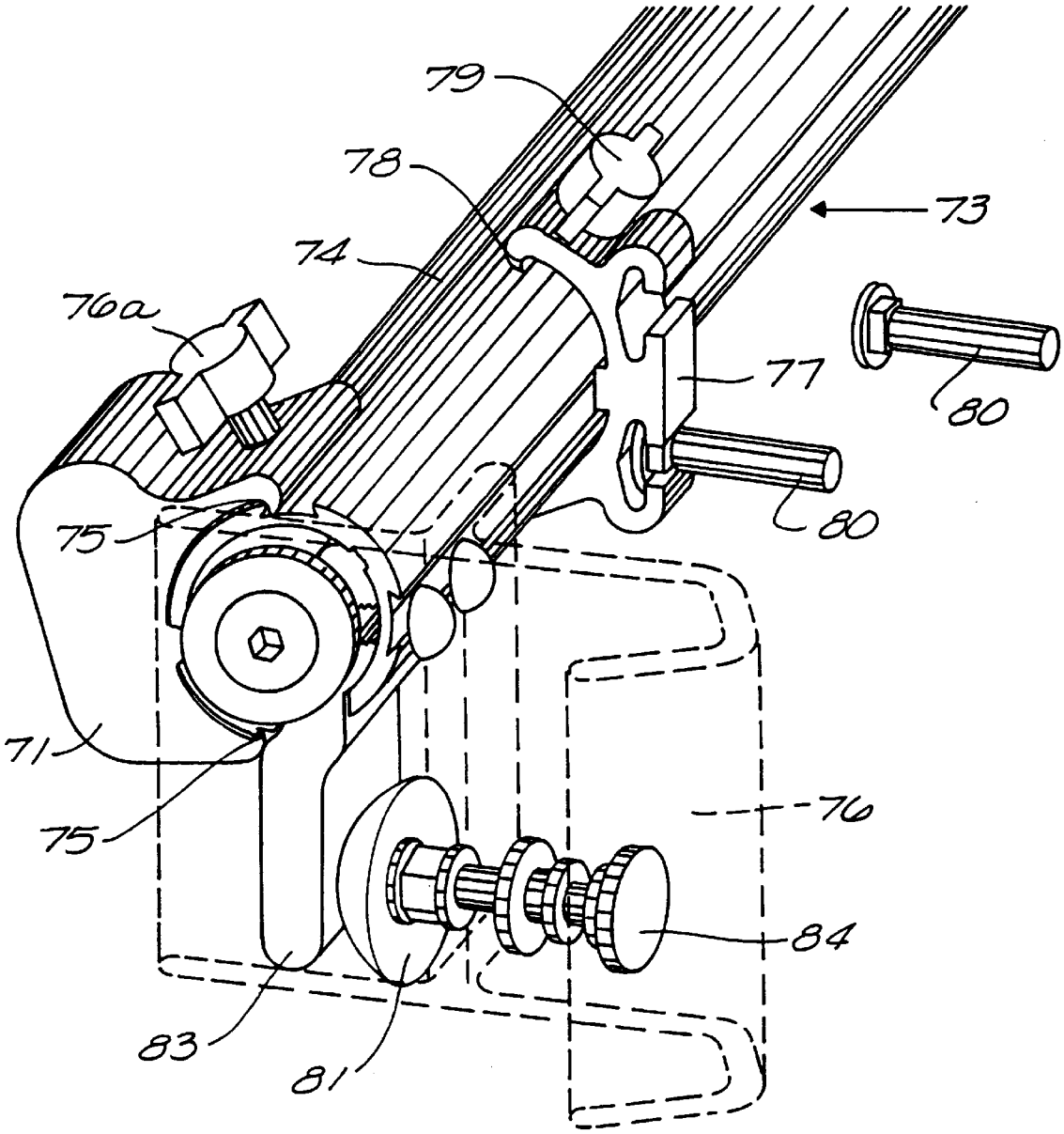
FIG. 16 is a detail isometric view of the hardware as shown in FIG. 15 showing the manner of connection of the supporting rods and the adjustable tilt feature.

The operation of this supporting hardware should be apparent but will be described in some detail for clarity of understanding. Referring to FIGS. 13–16, hardware 69 is installed on the end drums 10*b* by first securing rotation hinge members, i.e., end plates 72 against the drum assembly with hooked portions 76 secured to the drum shell by screws or hooked over two of the drum tension rods or over abutments on the end drums 10*b* of the drum assembly (FIG. 14). In this position, the drum assembly is supported on hooked portions 76 and carriage bolts 80 on members 77. Next, knob 84 is adjusted to set the amount of tilt of the drum assembly. J-rods 40 (FIGS. 13–15) are then supported in receptacles in members 71 and have their other ends supported in the supporting vests or T-bar supports described below or in J-rod supporting abutments in a fixed stand (FIG. 6).

MARCHING VEST SUPPORT FOR DRUMS AND OTHER PERCUSSION INSTRUMENTS

Figure 17:
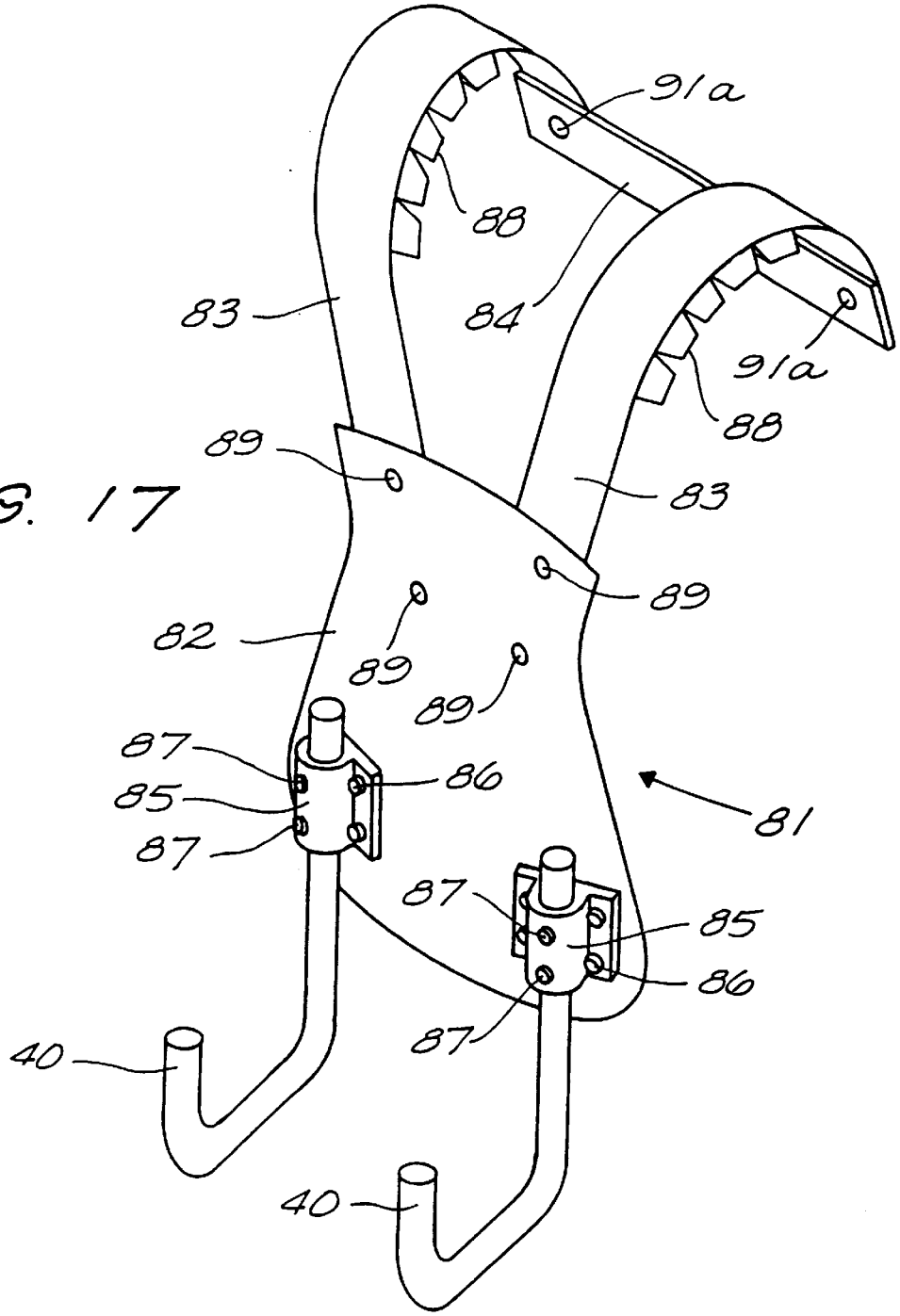
FIG. 17 is an isometric view of a novel supporting vest for marching drum assemblies.

Referring to FIG. 17, there is shown a vest- or harness-type supporting member or carrier 81 for percussion instruments which comprises a vest portion 82, shoulder straps 83 and back bar 84. Back bar 84 is removably secured to shoulder straps 83 by screws or bolts 91*a*. Where desired, back bar 84 may be fixed as by welding or the like. Vest portion 82 is removably secured to shoulder straps 83 by screws or bolts 89 and has a pair of J-rod receptacles 85 secured by screws or bolts 86. J-rods 40 are supported in receptacles 85 and secured in position by T-bolts or set screws 87. Shoulder straps 83 have pads 88 to cushion the load of the instruments carried by carrier 81.

The materials of construction used in this carrier 81 are very important for achieving the desired result. The vest portion 82 is preferably a strong, light-weight composite material such as Fiberglas®. Back bar 84 and shoulder straps 83 are rigid and made of a light metal such as aluminum, magnesium or titanium. Some prior art vests of this type have been of a one-piece Fiberglas® construction. There were incidents of failure of the shoulder straps from repeated flexing. The metal shoulder straps do not fail in flexure and also have the advantage that different sizes are readily accommodated. The vest portion 82 can be of a single size and separate shoulder straps 83 of differing radii for small, medium, large or extra large size.

Figure 17A:
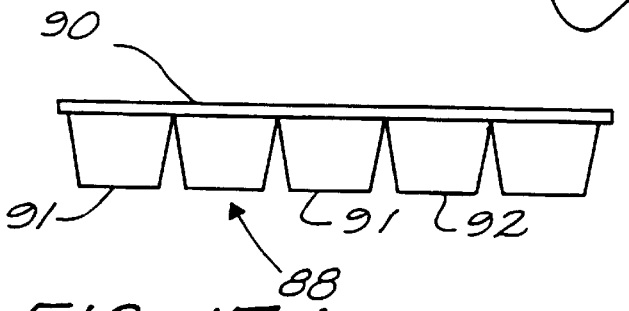
FIG. 17A is a detail view, in side elevation, of the cushions or pads used in the shoulder pieces of the supporting vest for marching drum assemblies as shown in FIG. 17.
Figure 24:
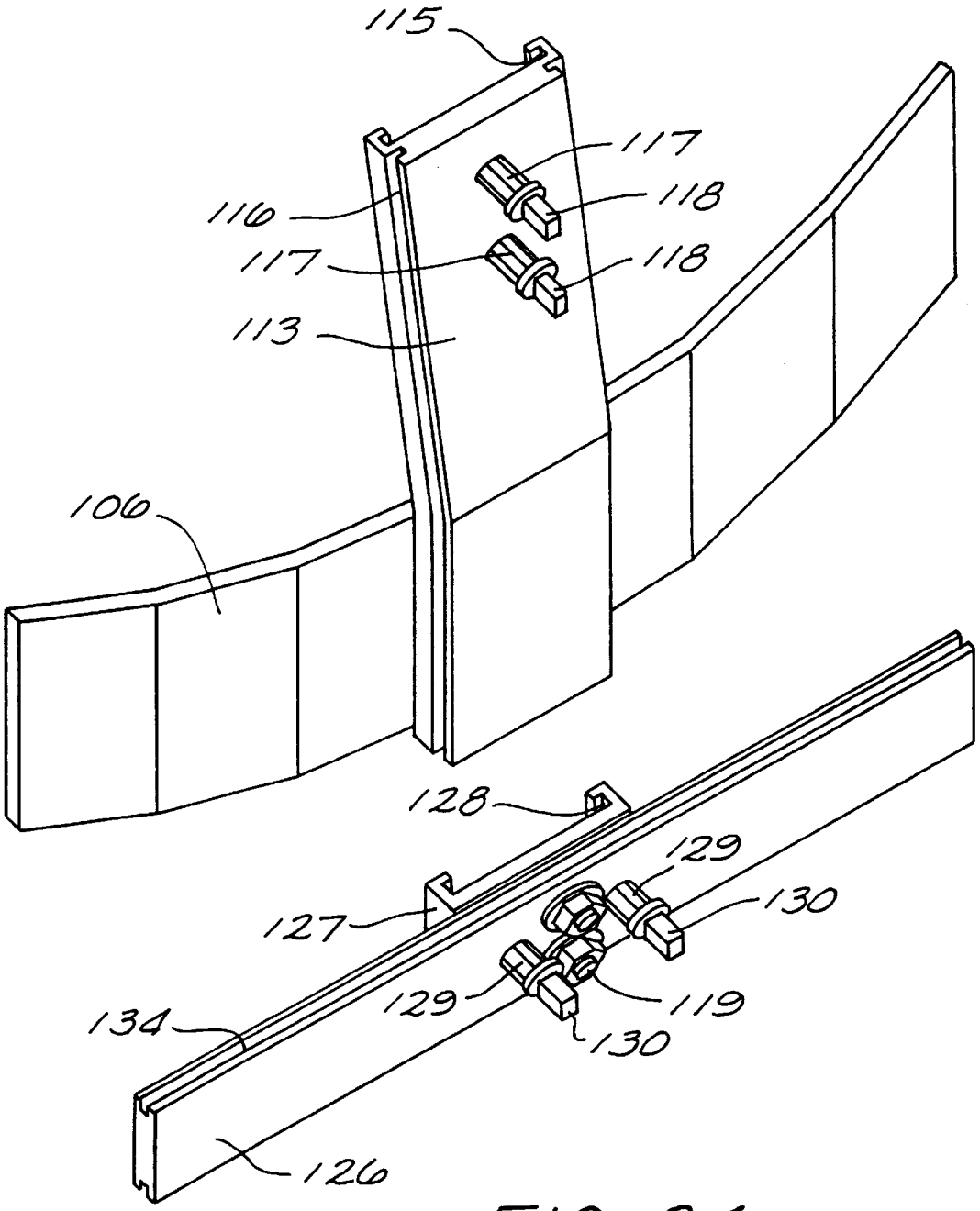
FIG. 24 is a detail front isometric view of the lower vertical bar, belly plate and lower cross bar of the T-bar assembly shown in FIG. 19 in exploded relation.

The cushions 88 (FIG. 17A) are of a type used to pad the interior of football and other sports helmets. Cushions have a backing strip 90 of polyvinyl plastic film. A thin sheet of polyvinyl film encloses blocks of closed pore plastic (e.g., polystyrene or polyurethane) foam and is sealed to backing strip 90 to enclose separate blocks 91. The blocks 91 are separately compressible and provide more comfort to the wearer of the carrier when fully loaded. It should be noted that shoulder straps 83 may be made adjustable as in FIGS. 42 and 43 below. J-rod supports may be made adjustable as in FIG. 24 below. Post 159 for supporting cymbal hardware may be used as in FIGS. 27–33.

OPERATION

The operation of this carrier should be apparent but will be described briefly for clarity. The carrier 81 is worn by the musician with the shoulder straps 83 positioned over the shoulders and the vest 82 supported against his abdomen. Pads 88 on shoulder straps 83 cushion the load of the instruments carried by carrier 81. Pads 88 may also be used in padding back bar 84 or vest belly plate portion 82.

Vest 82 may have suitable padding over its inner surface, as needed, to avoid discomfort from the bolts or screws 89 used to assemble the straps to the vest or bolts or screws 86 used to assemble receptacles 85 on the vest Back bar 84 may be removed or omitted for the convenience of drummers who prefer an open back as in some prior art drum carriers. J-rods 40 are inserted in position and secured in place by tightening set screws 87. The short outer ends of the J-rods are inserted into the J-rod receptacles on the percussion instrument being carried, e.g., drums (single or array), cymbals, xylophone, marimba, or the like.

MARCHING T-BAR SUPPORT FOR DRUMS AND OTHER PERCUSSION INSTRUMENTS

Figure 18:
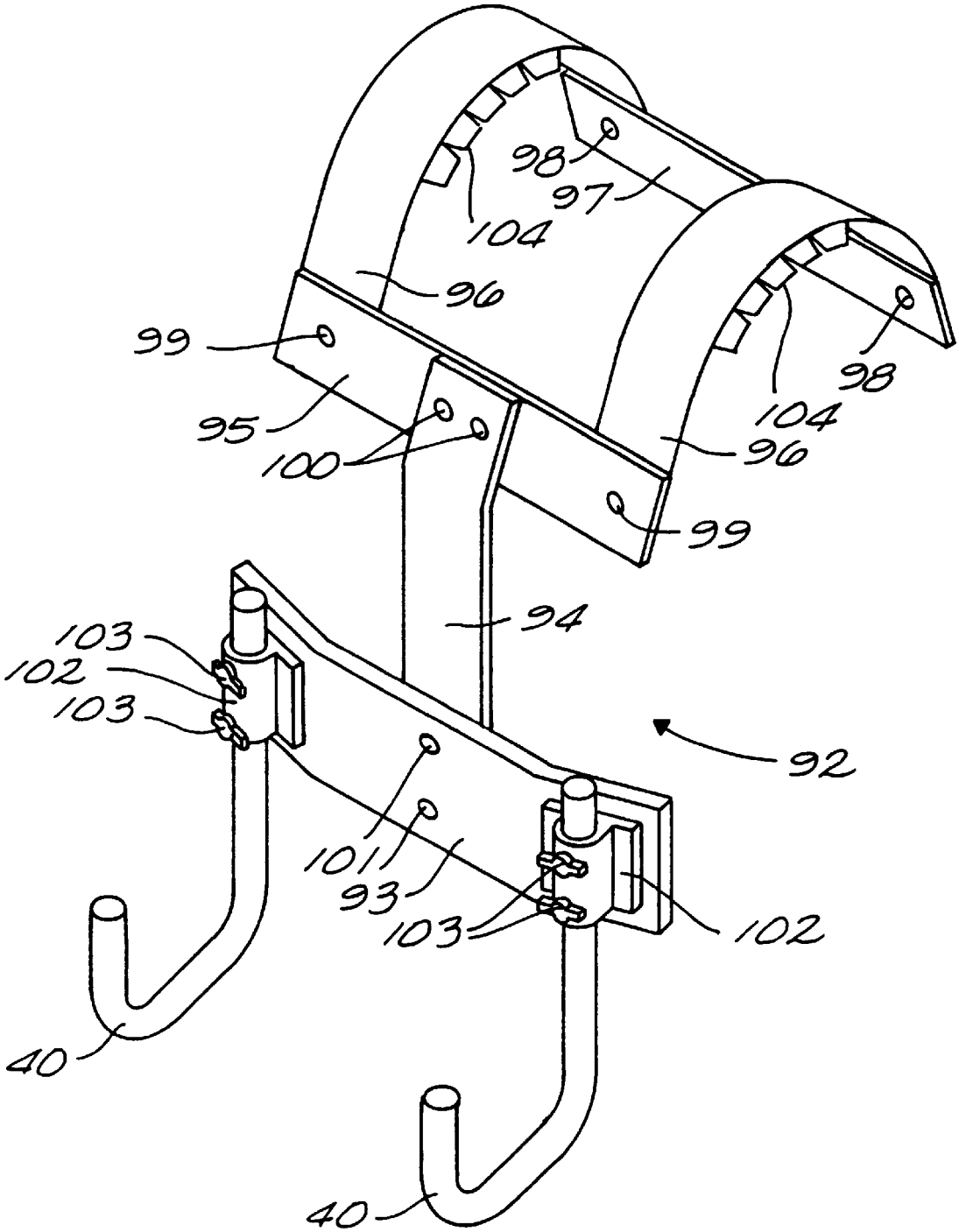
FIG. 18 is an isometric view of a novel T-bar assembly for supporting drums containing features of the supporting vest of FIG. 17. for marching drum.

Referring to FIG. 18, there is shown a T-bar-type supporting member or carrier 92 for percussion instruments which comprises a belly plate 93, vertical bar 94, upper horizontal bar 95, shoulder straps 96 and back bar 97. Back bar 97 is removably secured to shoulder straps 96 by screws or bolts 98. Where desired, back bar 97 may be fixed as by welding or the like. Upper horizontal bar 95 is removably secured to shoulder straps 96 by screws or bolts 99. Upper horizontal bar 95 is removably secured to the upper end of vertical bar 94 by screws or bolts 100.

Belly plate 93 is removably secured to the lower end of vertical bar 94 by screws or bolts 101. A pair of J-rod receptacles 102 are secured on belly plate 93 by screws or bolts or the like. J-rods 40 are supported in receptacles 102 and secured in position by T-bolts 103. Shoulder straps 96 have pads 104 (FIG. 17A) to cushion the load of the instruments carried by T-bar carrier 92. Pads 104 may also be used in padding back bar 97 or vest belly plate portion 93.

The materials of construction used in this carrier 92 are very important for achieving the desired result. The belly plate 93, vertical bar 94, upper horizontal bar 95, shoulder straps 96 and back bar 97 are rigid and made of a light metal such as aluminum, magnesium or titanium. The metal shoulder straps have the advantage that different sizes are readily accommodated. The sub-assembly of the belly plate 93, vertical bar 94, upper horizontal bar 95 can be of a single size and separate shoulder straps 96 of differing radii used for small, medium, large or extra large size. The cushions 104 are of a type used to pad the interior of football and other sports helmets. The construction is as described for cushions 88 in FIG. 17A above. As described above, the separate blocks 91 are separately compressible and provide more comfort to the wearer of the carrier when fully loaded. It should be noted that shoulder straps 83 may be made adjustable as in FIGS. 42 and 43 below. J-rod supports may be made adjustable as in FIG. 24 below. Post 159 for supporting cymbal hardware may be used as in FIGS. 27–33.

OPERATION

The operation of this carrier should be apparent but will be described briefly for clarity. The carrier 92 is worn by the musician with the shoulder straps 96 positioned over the shoulders and the belly plate 93 supported against his abdomen. Pads 104 (FIG. 17A) on shoulder straps 96 cushion the load of the instruments carried by carrier 92. Belly plate 93 and back bar 97 may have suitable padding over inner surfaces, as needed, to avoid discomfort from the bolts or screws 100 used to assemble the straps to the upper horizontal bar 95 or bolts or screws 101 used to assemble belly plate 93 to vertical bar 94. J-rods 40 are inserted in position and secured in place by tightening T-bolts 103. The short outer ends of the J-rods are inserted into the J-rod receptacles on the percussion instrument being carried, e.g., drums (single or array), cymbals, xylophone, marimba, or the like.

UNIVERSALLY ADJUSTABLE MARCHING T-BAR SUPPORT FOR DRUMS AND OTHER PERCUSSION INSTRUMENTS

Referring to FIGS. 19–27, there is shown a T-bar-type carrier of the type shown in FIG. 18 which has been modified to provide almost universal adjustment of the points of attachment and location of the percussion instruments. Pads corresponding to the pads 88/104 on shoulder straps 83/96 used to cushion the load of the instruments carried by the carrier in the embodiments of FIGS. 17 and 18, are used in this embodiment but are not shown to avoid interfering with the showing of the various adjustment features.

Adjustable supporting member of carrier 92 (FIG. 19) for percussion instruments comprises a belly plate 106, vertical bar assembly 107, upper horizontal bar 108, shoulder straps 109 and back bar 110. Back bar 110 is removably secured to shoulder straps 109 by screws or bolts. Upper horizontal bar 108 is removably secured to shoulder straps 109 by bolts 110*a*. Upper horizontal bar 108 is removably secured to the upper end of vertical bar assembly 107 by bolts 111. Upper horizontal bar 108 has grooves 116 in the upper and lower edges for receiving adjustable sliding members in another embodiment of the invention.

Vertical bar assembly 107 (FIGS. 19 & 22) comprises an upper bar member 112 and lower bar member 113. Upper bar member 112 has a pair of longitudinal grooves 114 in opposite edges. Lower bar member 113 has a pair of inner grooves 115 on opposite sides thereof and a pair of outer grooves 116. Bar members 112 and 113 are assembled with grooves 114 and 115 in telescoping relation for adjustable movement of the bars. Lower bar member 113 has a pair of bolts 117 with square heads 118 which are adjustable into and out of engagement with upper bar member 112 to secure bar assembly 107 together in any predetermined position. Square heads 118 are of a size for operation by a standard drum key.

Belly plate 106 is secured to a short mounting bar 120 by flat headed bolts 121. (FIG. 25) Mounting bar 120 has edge grooves 122 of a size fitting grooves 115 in lower bar member 113 on which the mounting bar is assembled. Mounting bar 120 has a pair of bolts 123 with square heads 124 which are adjustable into and out of engagement with lower bar member 113 to secure the lower bar/mounting bar assembly together in any predetermined vertical location of the belly plate 106. Square heads 124 are of a size for operation by a standard drum key.

A J-rod receptor assembly (FIGS. 23 & 24) consists of a fixed horizontal supporting bar 126, having edge grooves 134, and a supporting slide member 127 secured thereon by flat headed bolts 119. Slide member 127 has internal grooves 128 of a size fitting grooves 116 in lower bar member 113 on which the slide member is assembled. Supporting bar 126 has a pair of bolts 129 with square heads 130 which are adjustable into and out of engagement with lower bar member 113 to secure the lower bar/J-bar receptor assembly together in any predetermined vertical location relative to the belly plate 106. Square heads 130 are of a size for operation by a standard drum key.

J-rod receiving brackets 131 have vertical holes 132 sized to receive a J-rod 40 as in the other embodiments. Brackets 131, however, are adjustably supported on supporting bar 126. Brackets 131 have internal grooves 133 which fit supporting bar edge grooves 134 for sliding movement thereon and have bolts 135 with square heads 136 and bolts 137 with square heads 138. Square heads 136 and 138 are of a size for operation by a standard drum key. Bolts 135 set the position of brackets 131 on supporting bar 126 and bolts 137 secure J-rods 40 in place.

Figure 19:
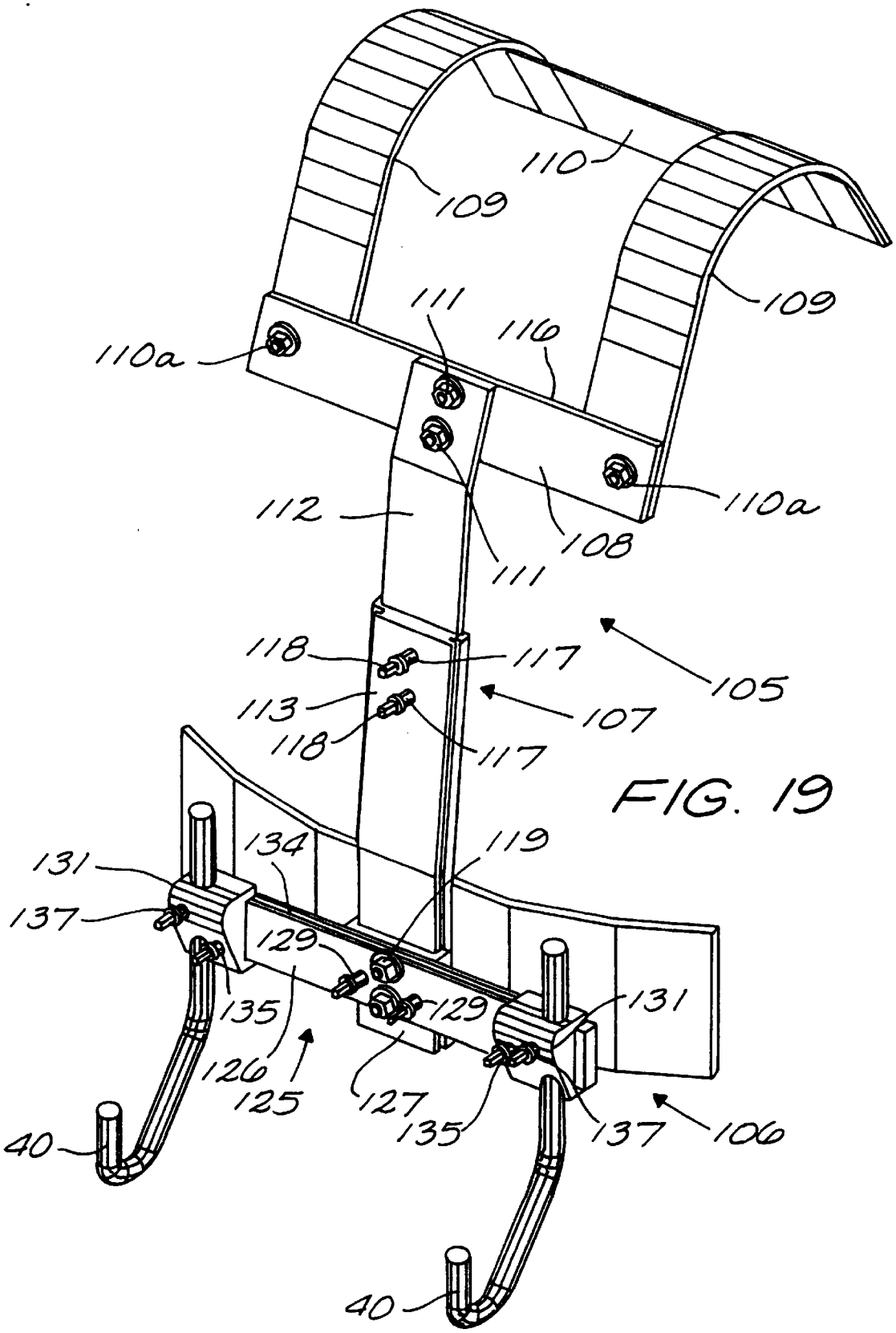
FIG. 19 is an isometric view of a novel T-bar assembly for supporting drums as in FIG. 18 containing features permitting both vertical and lateral adjustment of the points of connection to drum supporting hardware and for positioning the drums.
Figure 20:
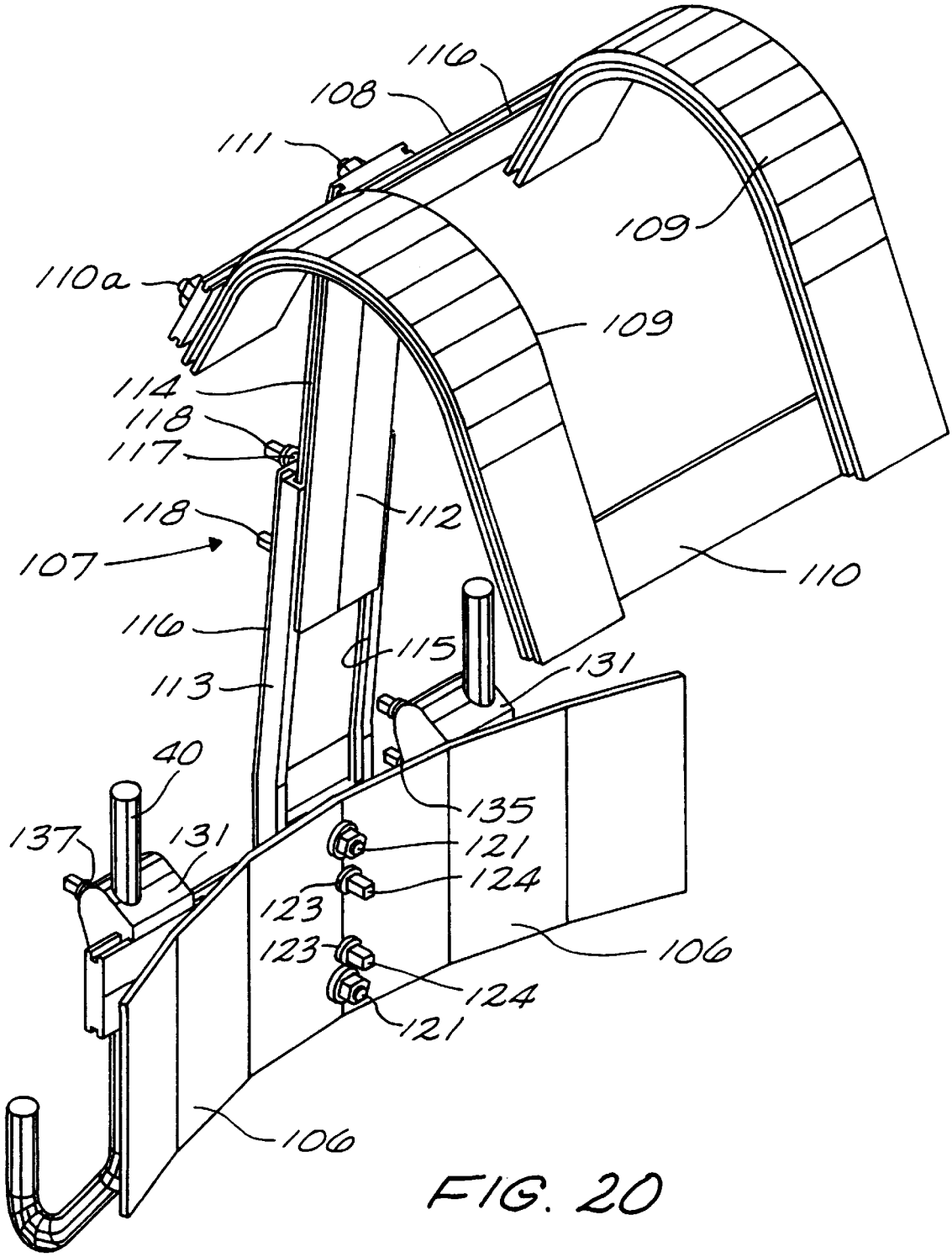
FIG. 20 is a rear isometric view of the T-bar assembly for supporting drums shown in FIG. 19.
Figure 21:
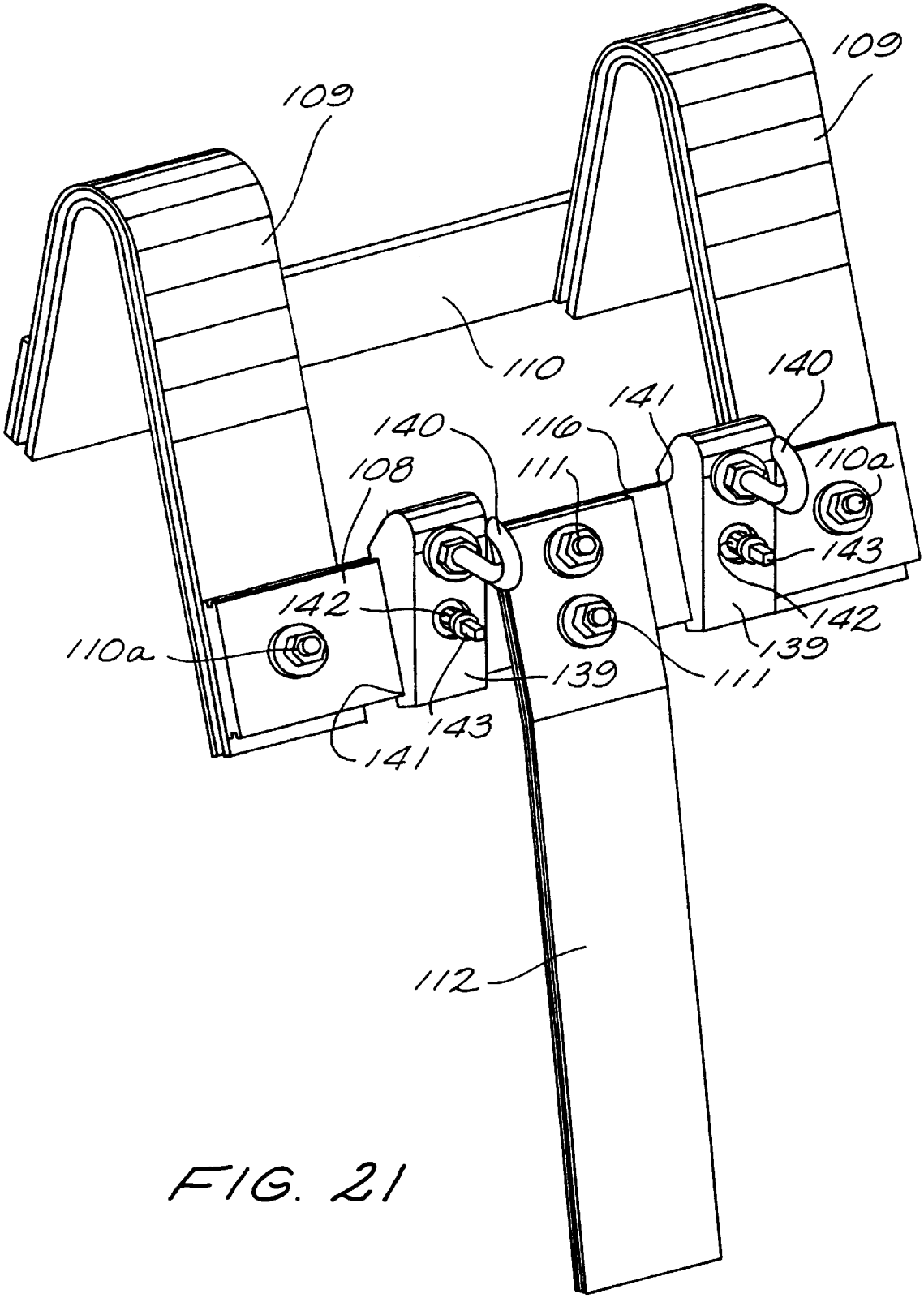
FIG. 21 is a detail isometric view of the shoulder straps, back bar, upper cross bar and upper vertical bar of the T-bar assembly shown in FIG. 19.
Figure 26:
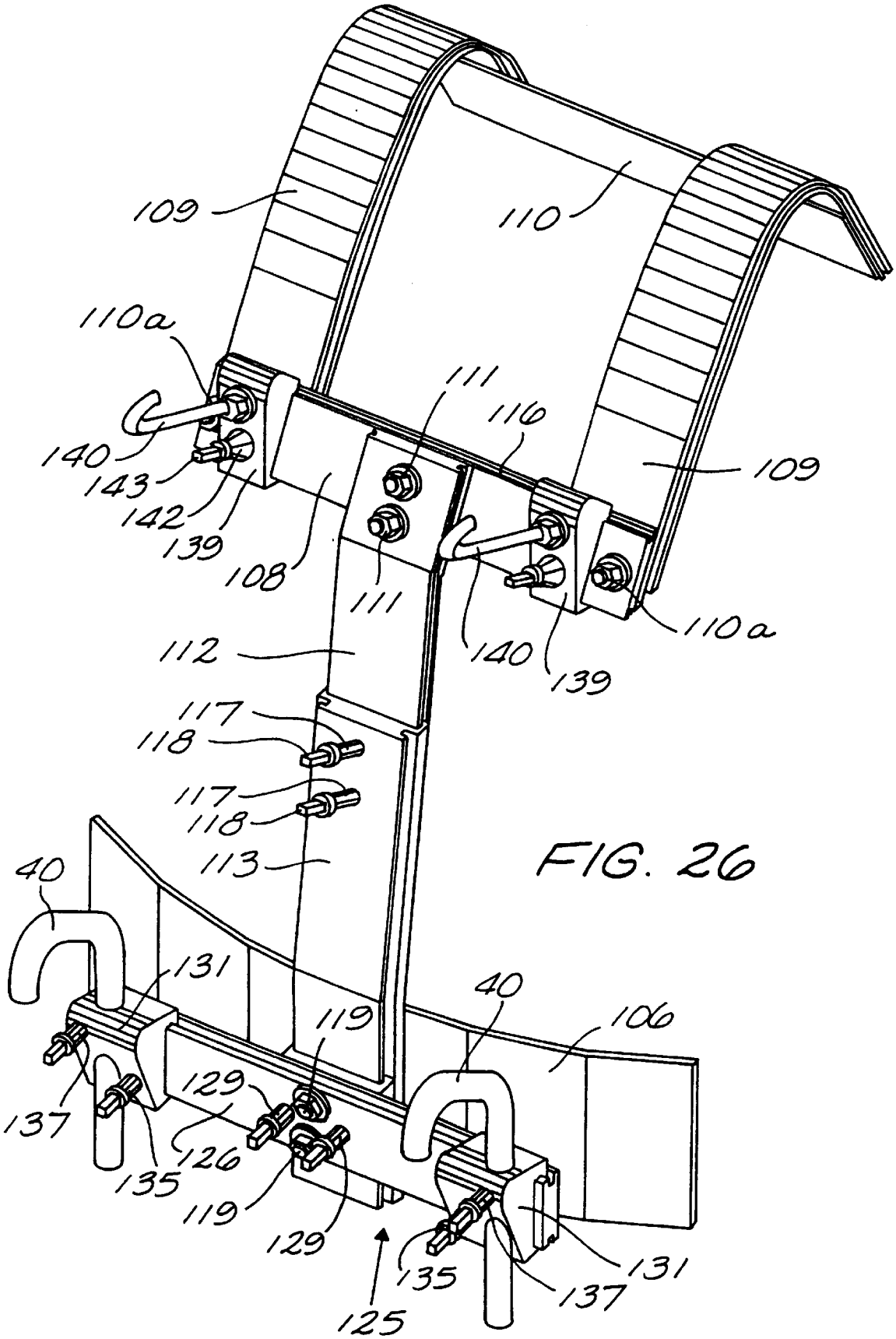
FIG. 26 is an isometric view of a novel T-bar assembly for supporting drums as in FIG. 19 modified for carrying a bass drum.

The embodiment of FIG. 26 is identical to that of FIG. 19 except that J-rods 40 are positioned upside down relative to the other embodiments and sliding brackets 139 are provided on upper horizontal bar 108. Brackets 139 have J-bolts 140 secured thereon to provide securing hooks where needed. Brackets 139 have internal grooves 141 which fit supporting bar edge grooves 116 for sliding movement thereon and have bolts 142 with square heads 143 of a size for operation by a standard drum key. Bolts 142 set the position of brackets 139 on upper supporting bar 108. In this embodiment, brackets 139 must be installed on supporting bar 108 before assembling shoulder straps 109 in place. The shoulder straps 109 have pads, as in the other embodiments.

The materials of construction used in this carrier are very important for achieving the desired result. The belly plate 106, J-rod supporting bar 126, vertical bars 112 and 113, upper horizontal bar 108, shoulder straps 109 and back bar 110 are semi-rigid and made of a light metal such as aluminum, magnesium or titanium. The metal shoulder straps have the advantage that different sizes are readily accommodated. The sub-assembly of the belly plate 106, J-rod supporting bar 126, vertical bars 112 and 113, and upper horizontal bar 108 can be of a single size and separate shoulder straps 109 of differing radii used for small, medium, large or extra large size.

The shoulder strap cushions are of a type used to pad the interior of football and other sports helmets. The construction is as described for cushions 88 in FIG. 17A above. As described above, the separate blocks 91 are separately compressible and provide more comfort to the wearer of the carrier when fully loaded.

The assembly of this carrier is preferably carried out by forming two sub-assemblies and then assembling them together. Belly plate 106, suitably cushioned, is assembled on lower vertical bar 113 with grooves 122 fitted in sliding relation to internal grooves 115 and bolts 123 fixing the location. J-rod receptor supporting bar 126 is secured on its mounting slide 127 and slid into position on external grooves 116 on lower vertical bar 113 and fixed in position by tightening bolts 129. J-rod receptor brackets 131 are slid into position on supporting bar grooves 134 and fixed in position by tightening bolts 135. This completes the lower sub-assembly.

The upper sub-assembly is produced by fastening the upper vertical bar 112 to upper horizontal bar 108. If upper brackets 139 are used, they are installed next. In either case, upper horizontal bar 108 is assembled to shoulder straps 109 and back bar 110 is secured thereon. The cushioning is then installed on the underside of shoulder straps 109 and back bar 110. This sub-assembly is now complete.

The upper sub-assembly and lower sub-assembly are then assembled by fitting upper vertical bar 112 into sliding relation in lower vertical bar 113. Grooves 114 in bar 112 fit into grooves 115 in bar 113 in sliding relation. The bars 112 and 113 are fixed in position by tightening bolts 118. The assembly is now complete.

OPERATION

The operation of this carrier should be apparent but will be described briefly for clarity. The carrier 105 is worn by the musician with the shoulder straps 109 positioned over the shoulders and the belly plate 106 supported against his abdomen. Belly plate 106, back bar 110, and shoulder straps 109 upper horizontal bar 108 may have suitable padding over their inner surfaces to avoid discomfort. J-rods 40 are inserted in position and secured in place by tightening bolts 137. The short outer ends of the J-rods are inserted into the J-rod receptacles on the percussion instrument being carried, e.g., drums (single or array), cymbals, xylophone, marimba, or the like.

The carrier is universally adjustable. The positioning of the belly plate 106 is adjusted by adjusting the length of the vertical bar assembly 107 by sliding bars 112 and 113 to a desired position and re-tightening the set bolts 117. The lateral spacing of the J-rod supporting brackets 131 is adjustable by loosening bolts 135, setting brackets 131 to the desired position and retightening bolts 135. J-bolts 40 are set to the desired vertical position and angular orientation by set bolts 137. In the embodiment of FIG. 26, the upside-down positioning of J-rods 40 and the use of upper brackets 139 fits the connections to a bass drum for carrying on this carrier.

T-BAR SUPPORT AND HARDWARE FOR DRUMS AND CYMBALS

Referring to FIGS. 29–37, there is shown a T-bar-type carrier of the type shown in FIG. 19 and associated hardware which is especially useful in supporting cymbals, alone or together with snare drums or the like.

Adjustable supporting member or carrier 144 (FIG. 27) for percussion instruments, especially cymbals, comprises a belly plate 145, vertical bar assembly 146, upper horizontal bar 147 and shoulder straps 148. Back bar 149 is optional and may be made integral with the shoulder straps by welding or may be removably secured to shoulder straps 149 by screws or bolts. Upper horizontal bar 147 is removably secured to shoulder straps 149 by bolts 150. Upper horizontal bar 147 is removably secured to the upper end of vertical bar assembly 146 by bolts 151.

Vertical bar assembly 146 comprises an upper bar member 152 and lower bar member 153. Upper bar member 154 has a pair of longitudinal grooves 152 in opposite edges. Lower bar member 153 has a pair of inner grooves 155 on opposite sides thereof and a pair of outer grooves 156. Bar members 154 and 153 are assembled with grooves 152 and 155 in telescoping relation for adjustable movement of the bars. Lower bar member 153 has a pair of bolts 157 with square heads 158 which are adjustable into and out of engagement with upper bar member 154 to secure bar assembly 146 together in any predetermined position. Square heads 158 are of a size for operation by a standard drum key.

Figure 22:
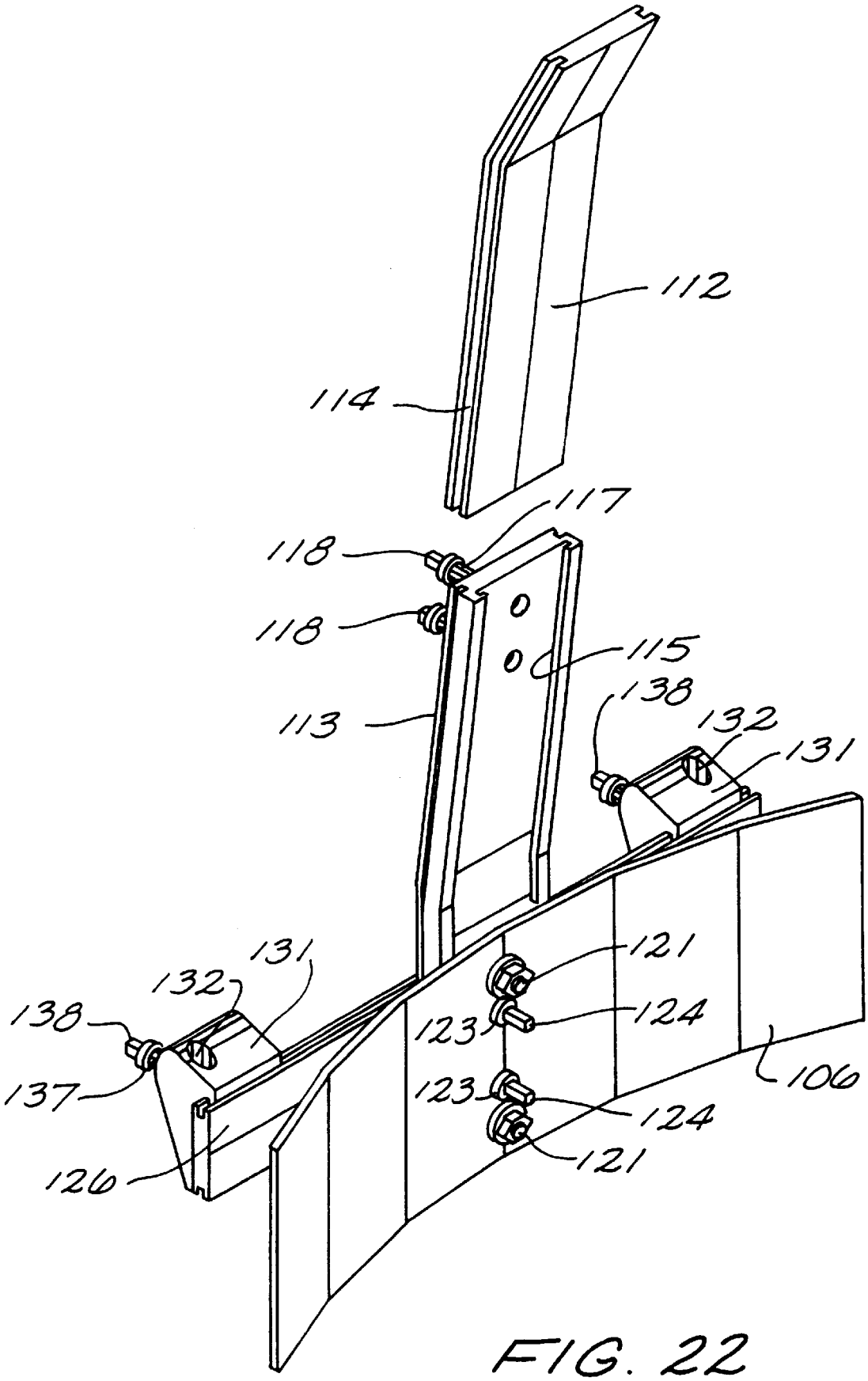
FIG. 22 is a detail rear isometric view of the lower vertical bar and belly plate of the T-bar assembly shown in FIG. 19.
Figure 23:
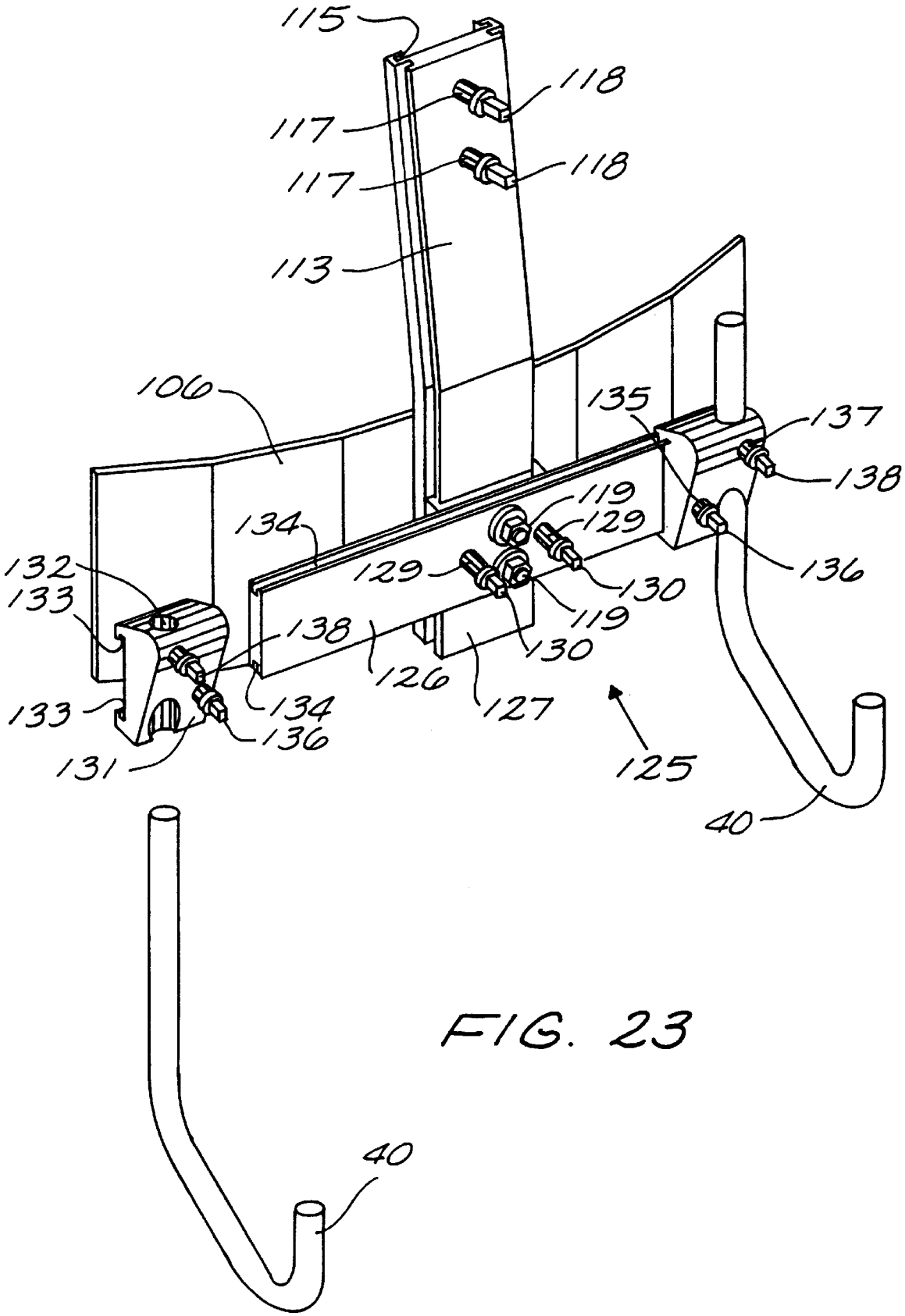
FIG. 23 is a detail front isometric view of the upper vertical bar, lower vertical bar and belly plate of the T-bar assembly shown in FIG. 22 with one of the J-bars in exploded relation.
Figure 25:
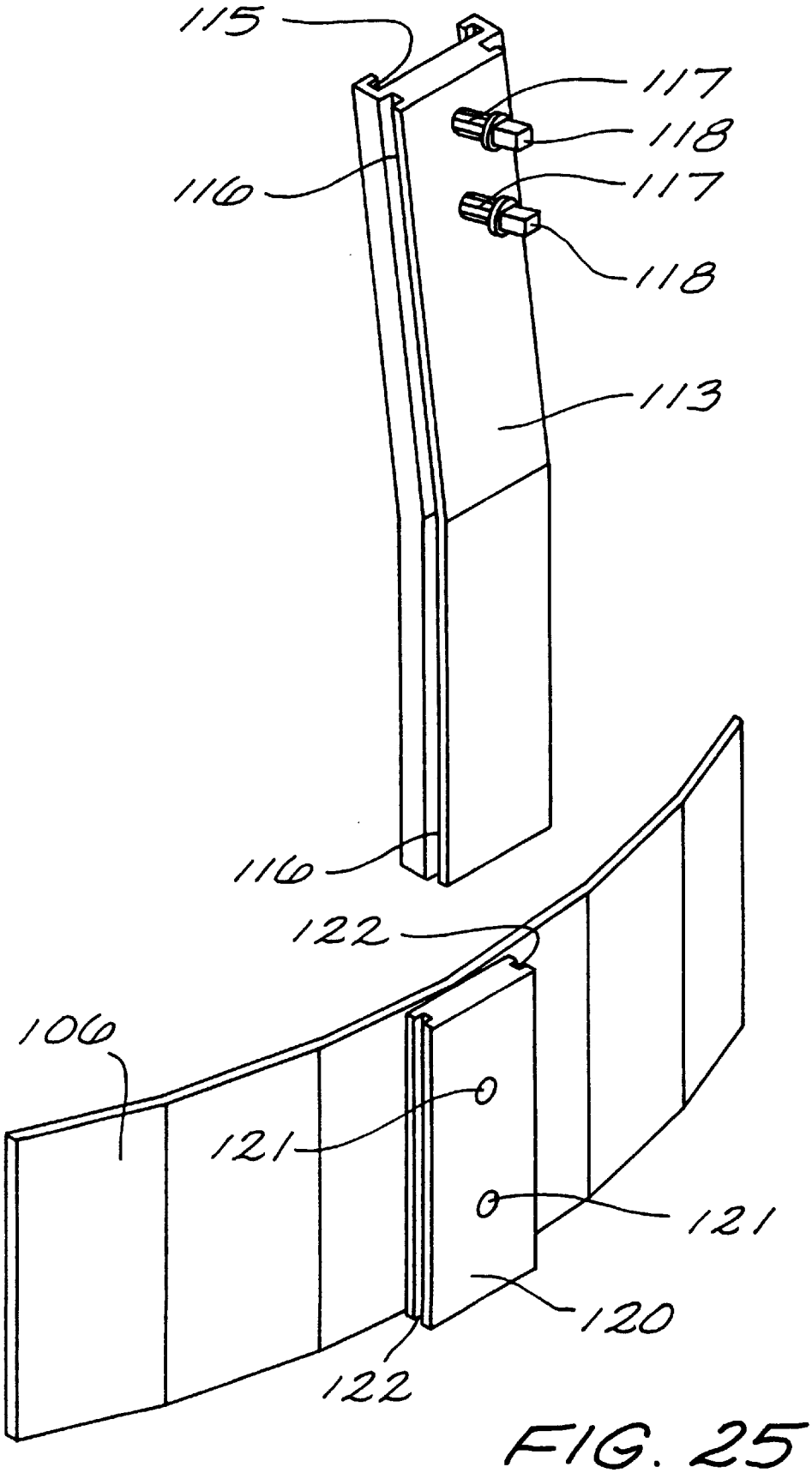
FIG. 25 is a detail front isometric view of the lower vertical bar and belly plate of the T-bar assembly shown in FIG. 19 in exploded relation.
Figure 27:
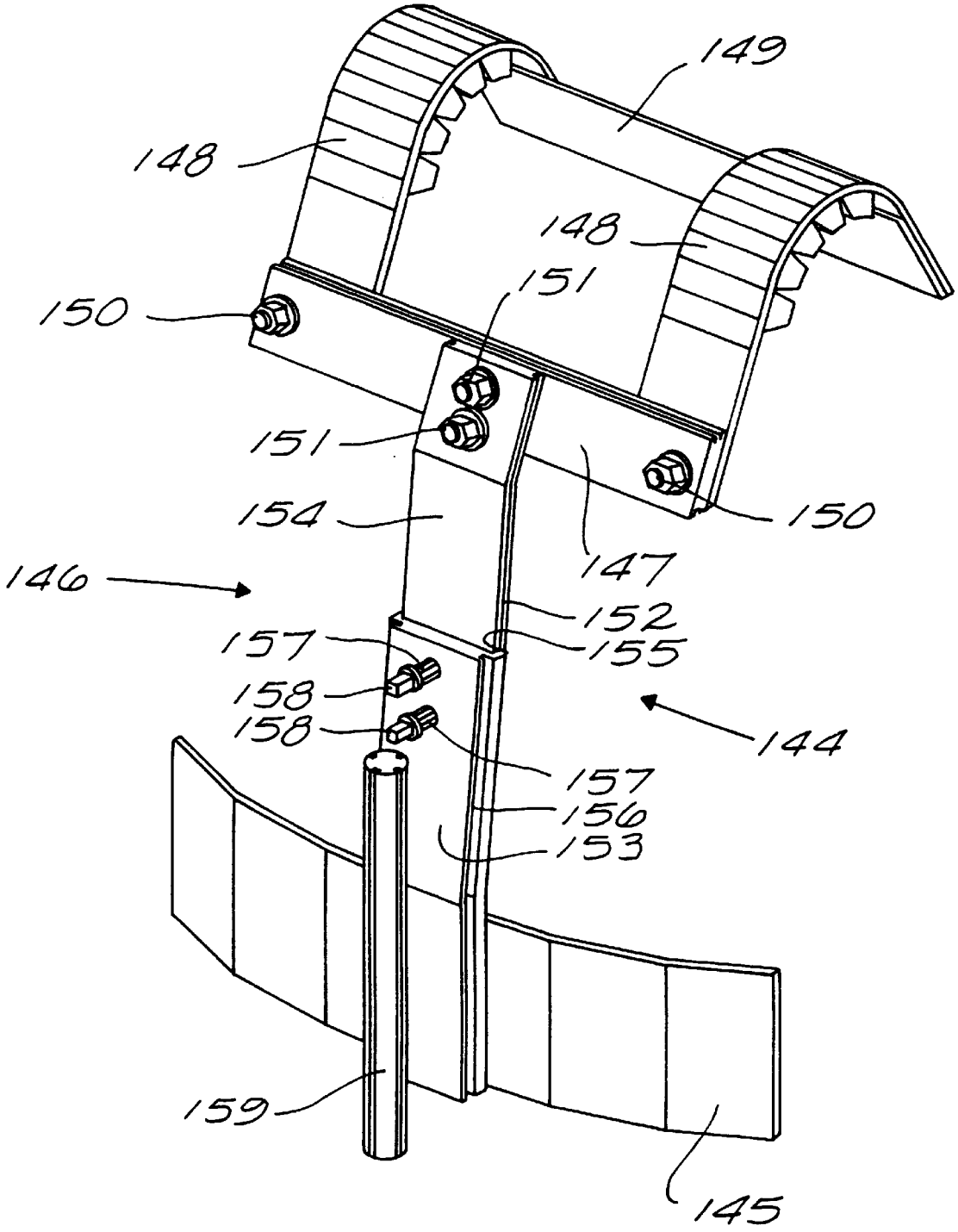
FIG. 27 is an isometric view of a novel T-bar assembly as in FIG. 18 having a clamp holding a fluted tube for supporting cymbals.

Belly plate 145 is secured to a short mounting bar, see FIGS. 22, 25, 27, by flat headed bolts. The mounting bar has edge grooves of a size fitting grooves 155 in lower bar member 153 on which the mounting bar is assembled. The mounting bar has a pair of bolts with square heads (see FIGS. 22, 25, 27) which are adjustable into and out of engagement with lower bar member 153 to secure the lower bar/mounting bar assembly together in any predetermined vertical location of the belly plate 145. The square heads are of a size for operation by a standard drum key.

A fluted tube 159 is secured on lower bar member 153 or optionally on belly plate 145 for supporting pivot arms and cymbal-supporting as described below. The assembly of fluted tube 159 and pivot arms is constructed the same as the supporting rod and pivoted legs in May U.S. Pat. No. 5,072,910 with the pivoted legs of the patent being adapted herein as pivoted arms for supporting cymbal hardware.

Tubular member 159 has a plurality of circumferentially spaced grooves extending longitudinally on its exterior surface. Referring to FIGS. 29–32, in this embodiment, four grooves are shown, two diametrically opposed grooves 160 being generally square in cross section, and the other two diametrically opposed grooves 161 being dovetail shaped in cross section.

Figure 28:
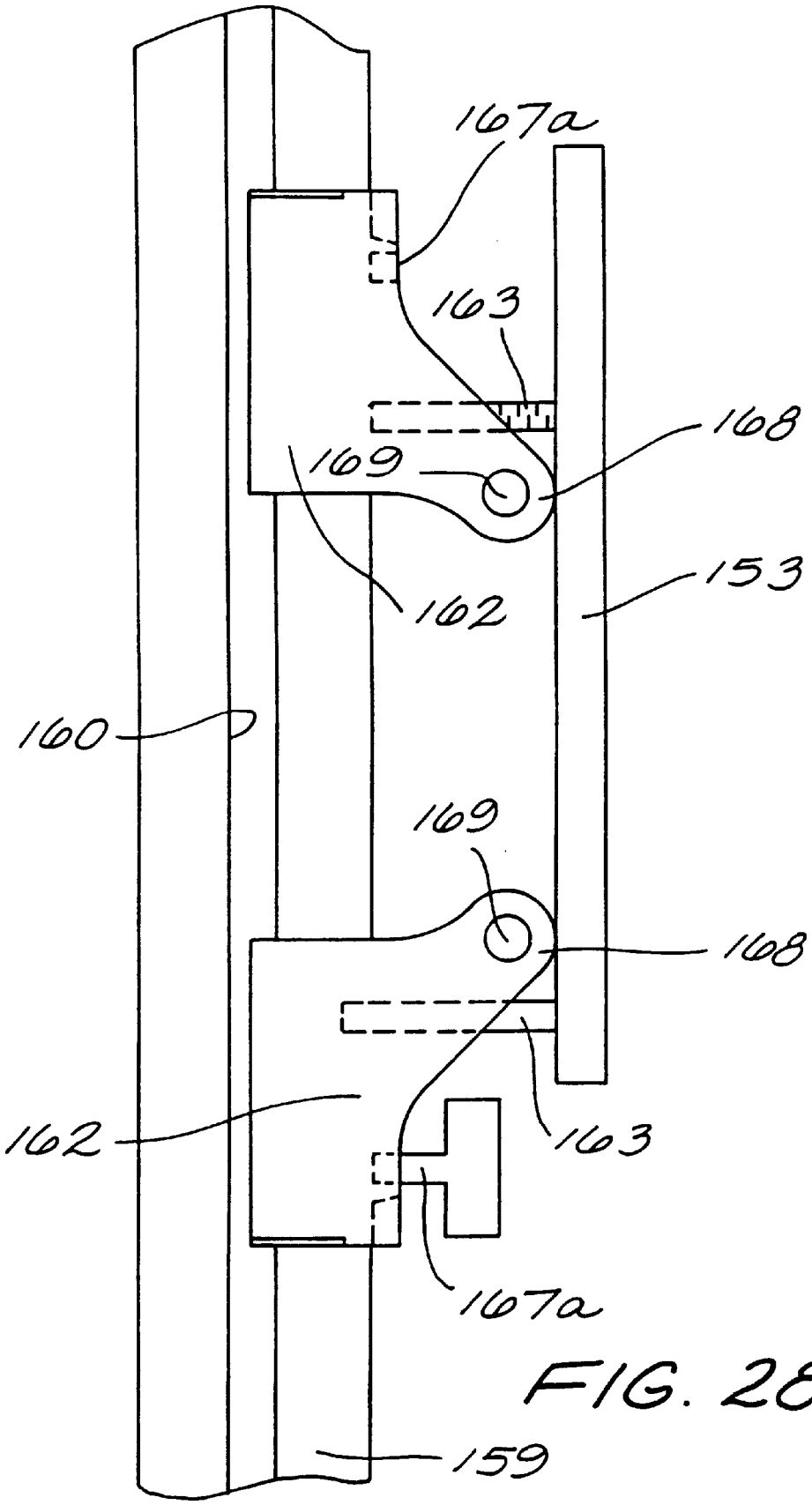
FIG. 28 is a detail side view of the apparatus of FIG. 27 showing the clamp and fluted tube.
Figure 29:
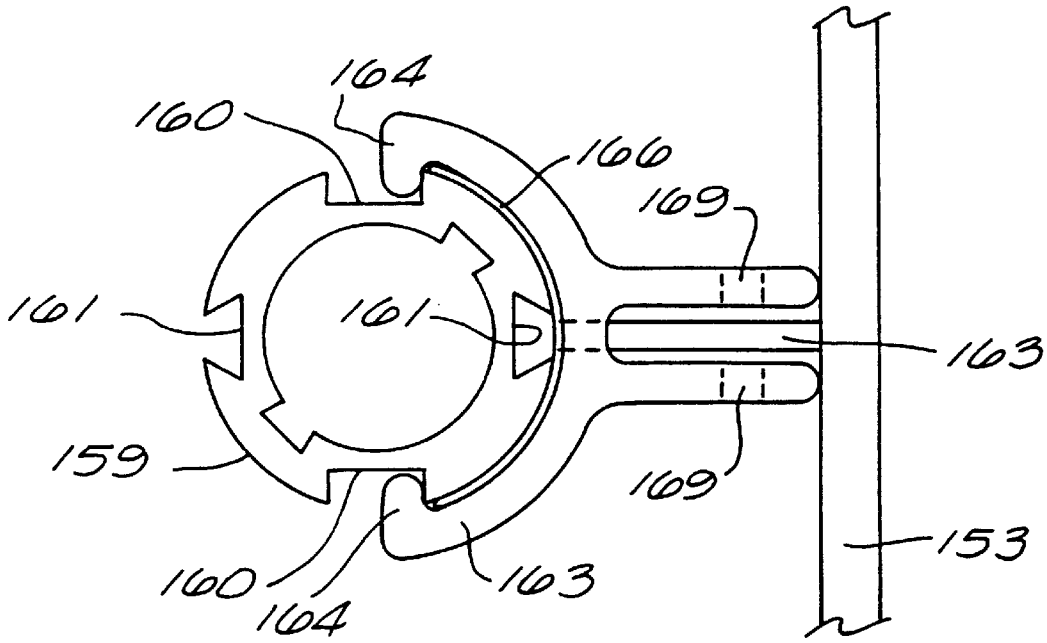
FIG. 29 is a plan view of the clamp and fluted tube shown in FIG. 28.
Figure 30:
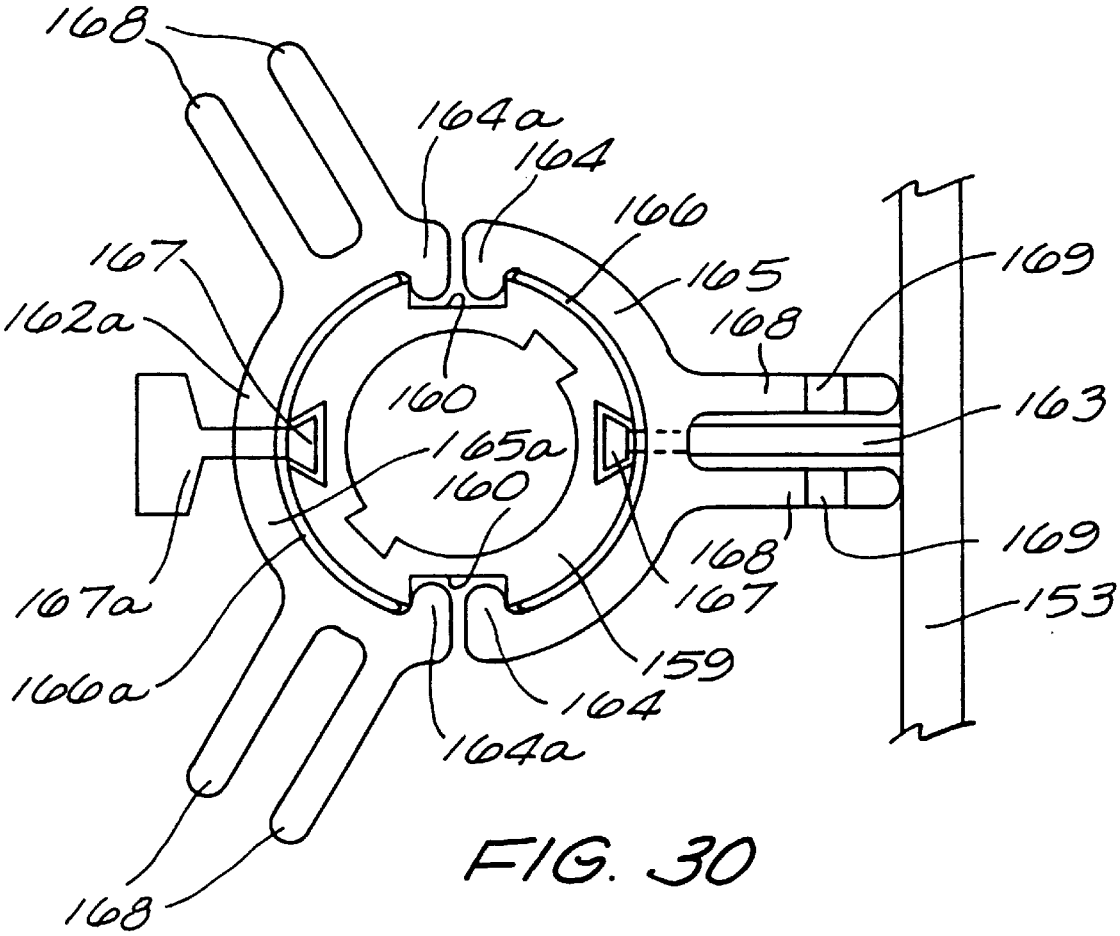
FIG. 30 is a plan view of the clamp and fluted tube shown in FIG. 29 with the pivot arms added for supporting cymbals.

As seen in FIGS. 28–30, a pair of semi-circular tube support collar members 162 are secured on lower vertical bar member 153 by bolts 163 with the inner surfaces aligned to receive, support and guide fluted tube 159. Collar members 162 are constructed in the same by reference herein. Each of the collar members 162 has a semi-circular cross section, i.e., C-shaped, portion 163 with the longitudinal edges 164 bent inwardly to be received within the longitudinal grooves 160.

A semi-circular sleeve element (sleeve washer) 166 is installed between the exterior of the fluted tube member 159 and the interior of each collar segment 162. The sleeve element 166 is of a low friction material, such as nylon, to facilitate sliding movement of the fluted tube 159 in collar segments 162. The heads of bolts 163 are flush with or recessed below the surface of C-shaped portion 165 so as not to interfere with movement of fluted tube 159. Wedge elements 167 are slidably received within the dovetail grooves 161 adjacent to each of the collar segments 162. Each wedge 167 is slightly smaller in cross section than the dove-tail groove 161. A hole (not shown) extends radially through the side wall of each collar segment 162 and each sleeve and each wedge 167 has a threaded stud. Nuts 167*a* are provided which have a shank portion internally threaded to fit the stud of wedge 167, one being a wing nut or T-nut and the other a short Allen nut. When the nuts 167 are tightened, the fluted tube 159 is locked in place and when loosened, the position of fluted tube 159 can be moved to a different position. The fluted tube 159, thus installed, supports hardware for cymbals.

One or more additional collar members 162*a* is mounted for sliding movement on the other side of fluted tube 159. Each of the collar members 162*a* has a semi-circular cross section, i.e., C-shaped, portion 165*a* with the longitudinal edges 164*a* bent inwardly to be received within the longitudinal grooves 160. A semi-circular sleeve element (sleeve washer) 166*a* is installed between the exterior of the fluted tube 159 and the interior of each collar segment 162*a*. The sleeve element 166*a* is of a low friction material, such as nylon, to facilitate sliding movement of the collar segments 162*a* on fluted tube 159.

Wedge elements 167 are slidably received within the dovetail grooves 161 adjacent to each of the collar segments 162*a*. Each wedge 167 is slightly smaller in cross section than the dovetail groove 161. A hole (not shown) extends radially through the side wall of each collar segment 162*a* and each sleeve and each wedge 167 has a threaded stud. Nuts 167*a* are provided which have a shank portion internally threaded to fit the stud of wedge 167, one being a wing nut or T-nut and the other a short Allen nut. When the nuts 167 are tightened, the collar segments 162 are locked in place on fluted tube 159 and when loosened, the position of collar segments 162 can be moved to a different position.

As seen in FIGS. 28 & 30, the collar members 162*a* have integral yokes 168 projecting radially from their exterior, each having holes 169 for receiving a pivot pin for an arm to be pivotally supported thereon. The yokes are equally spaced apart circumferentially for mounting two legs thereon or one leg if collar member of the shape of collar 162 is used for mounting pivot arms. Collar members 162*a* and collar members 162 are not necessarily in the same plane since collar members 162, in FIG. 28, are fixed in position while collar members 162*a* slide up and down along fluted tube 159.

Figure 31:
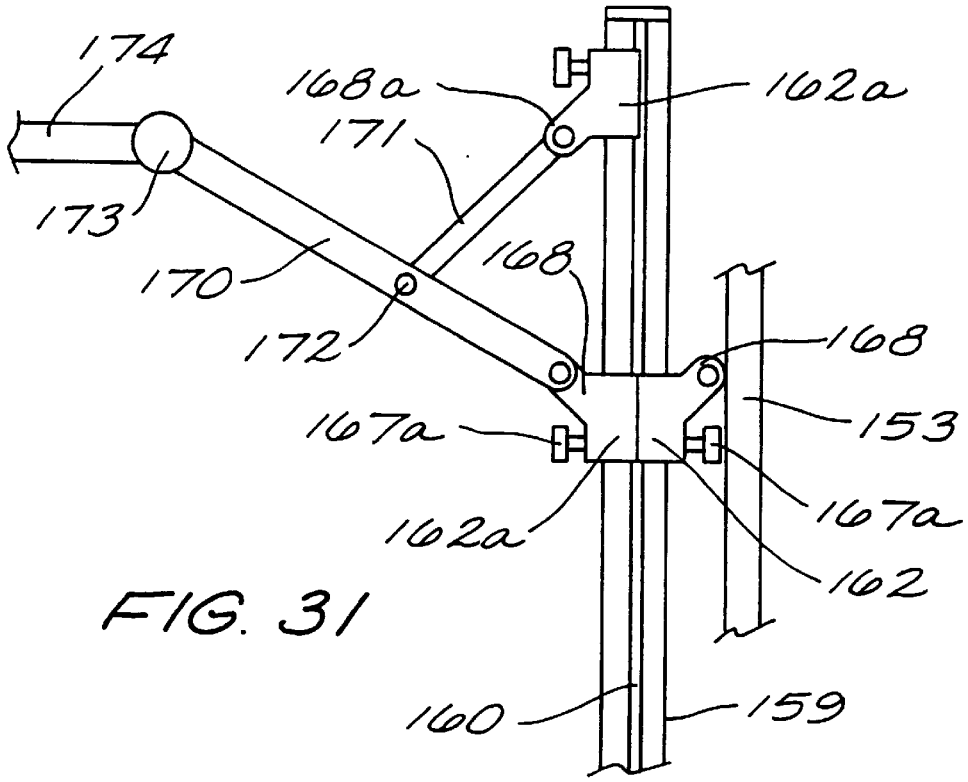
FIG. 31 is a view in elevation of the clamp, fluted tube and pivot arms for supporting cymbals.
Figure 32:
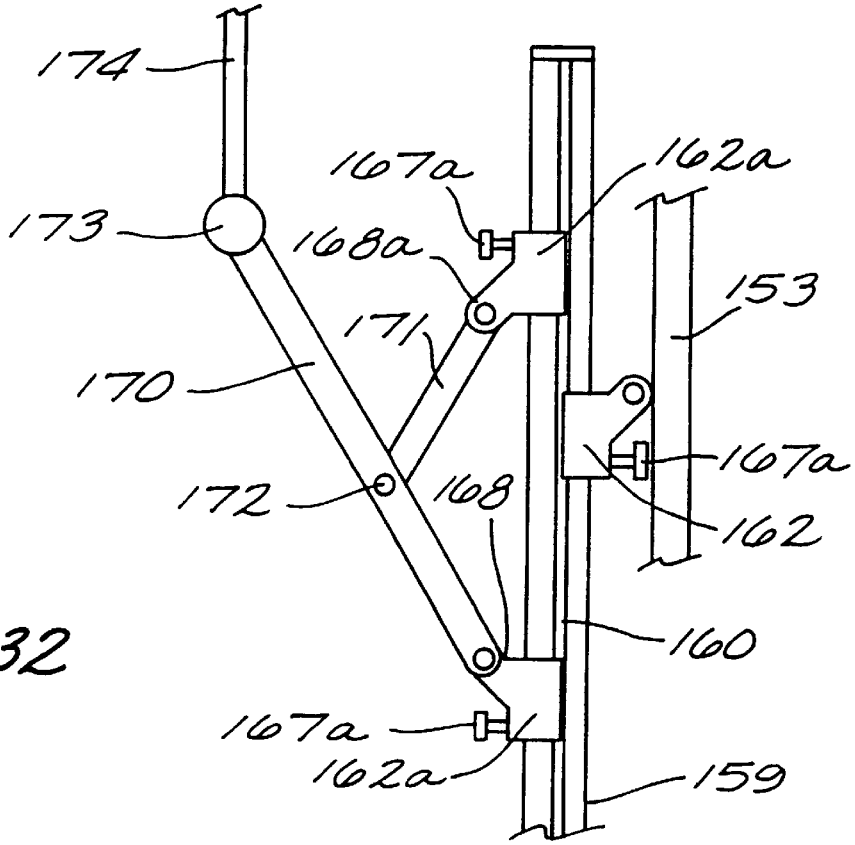
FIG. 32 is a view in elevation of the clamp, fluted tube and pivot arms for supporting cymbals, as in FIG. 31, with the pivot arms moved to different positions.

A pivot arm member 170 (FIGS. 31 & 32) is pivotally mounted on one yoke 168 and a brace member 171 is pivotally mounted at one end in another yoke 168*a*. The free end of the leg brace 171 is pivotally connected to the pivot arm member 170 intermediate its ends at pivot connection 172. A pivotal connector 173 is provided on the outer end of each pivot arm member 170. A rod 174 extends from each of the pivotal connectors 173 for supporting cymbal hardware as described below. As seen in FIGS. 31 and 32, collar segments 162*a* are movable toward and away from each other along fluted tube 159 resulting in angular movement of pivot arm 170 and brace 171 toward and away from the fluted tube support.

Details of the pivotal connector 173, cymbal-supporting rod 174 and associated cymbal-supporting hardware are shown in FIGS. 34–37. Pivotal connector 173 comprises a cylindrical hub 175 and two cylindrical bases 176. Bases 176 have cylindrical bosses 177 which fit rotatably in cylindrical recesses 178 in hub 175. Pivot arm 170 has two parallel portions which pit into slots 179 in bases 176 on opposite sides of pivotal connector 173. A bolt 180 extends through the pivotal connector 173 and has an Allen wrench recess 184 on one end and a wing nut 185. T-bolt 184 and nut 185 secure connector 173 together and, when tightened, secure the connector 173 against rotary movement and, when loosened, permit rotary movement of the pivotal connector.

Cymbal hardware is supported on rod 174 extending from connector 173. A washer 186 is positioned over rod 174 tangentially on the surface of hub 175. An assembly of a cylindrical hub 187, secured by wing bolt or T-bolt 187*a*, and supporting disc 188 having three coplanar rubber or plastic bumpers 189 is supported on rod 174 abutting washer 186. A cymbal 190 (shown in dotted line) is positioned over rod 174 and against bumpers 189. A cylindrical bumper member 191 with tapered end is positioned over rod 174 and abuts cymbal 190 under pressure of one end of a coil spring 192 surrounding rod 174. Another cylindrical bumper member 193 is slidable positioned on rod 174 against the other end of coil spring 192.

An adjustment assembly is secured on the end of rod 174 and abutting the bumper member 193. The adjustment assembly comprises a brass cylindrical hub 194, secured by wing bolt or T-bolt 194*a*, having a threaded tubular extension 195. An internally threaded tubular sleeve member 196 is positioned on extension 195 and movable longitudinally against bumper 193 on rotation by a handle 197. A cymbal 198 (shown in dotted line) is positioned between sleeve member 196 and bumper member 193.

OPERATION

The operation of this carrier and cymbal supports should be apparent but will be described briefly for clarity. The carrier 144 is worn by the musician with the shoulder straps 148 positioned over the shoulders and the belly plate 145 supported against his abdomen. Belly plate 145, back bar 149 and upper horizontal bar 147 may have suitable padding (FIG. 17A) over their inner surfaces, as needed, to avoid discomfort. The carrier is adjustable. The positioning of the belly plate 145 is adjusted by adjusting the length of the vertical bar assembly 146 by sliding bars 152 and 153 to a desired position and re-tightening the set bolts 157.

Fluted tube 159 is installed as described above. Cymbals 190 and 198 are installed during assembly of the supporting hardware as described above. The positioning of the cymbals 190 & 198 is accomplished by setting the position of fluted tube 159 and the brackets 162*a* and angular setting of pivot arms 170 as described above. The cymbal hardware is assembled as described and set at the desired angle. Adjustment of the cymbal hardware is by rotation of lever 197 which moves bumper 193 and cymbal against the force of spring 192 toward cymbal 190. This has the effect of tuning the cymbals.

T-BAR SUPPORT AND HARDWARE FOR BOTH DRUMS AND CYMBALS

Figure 33:
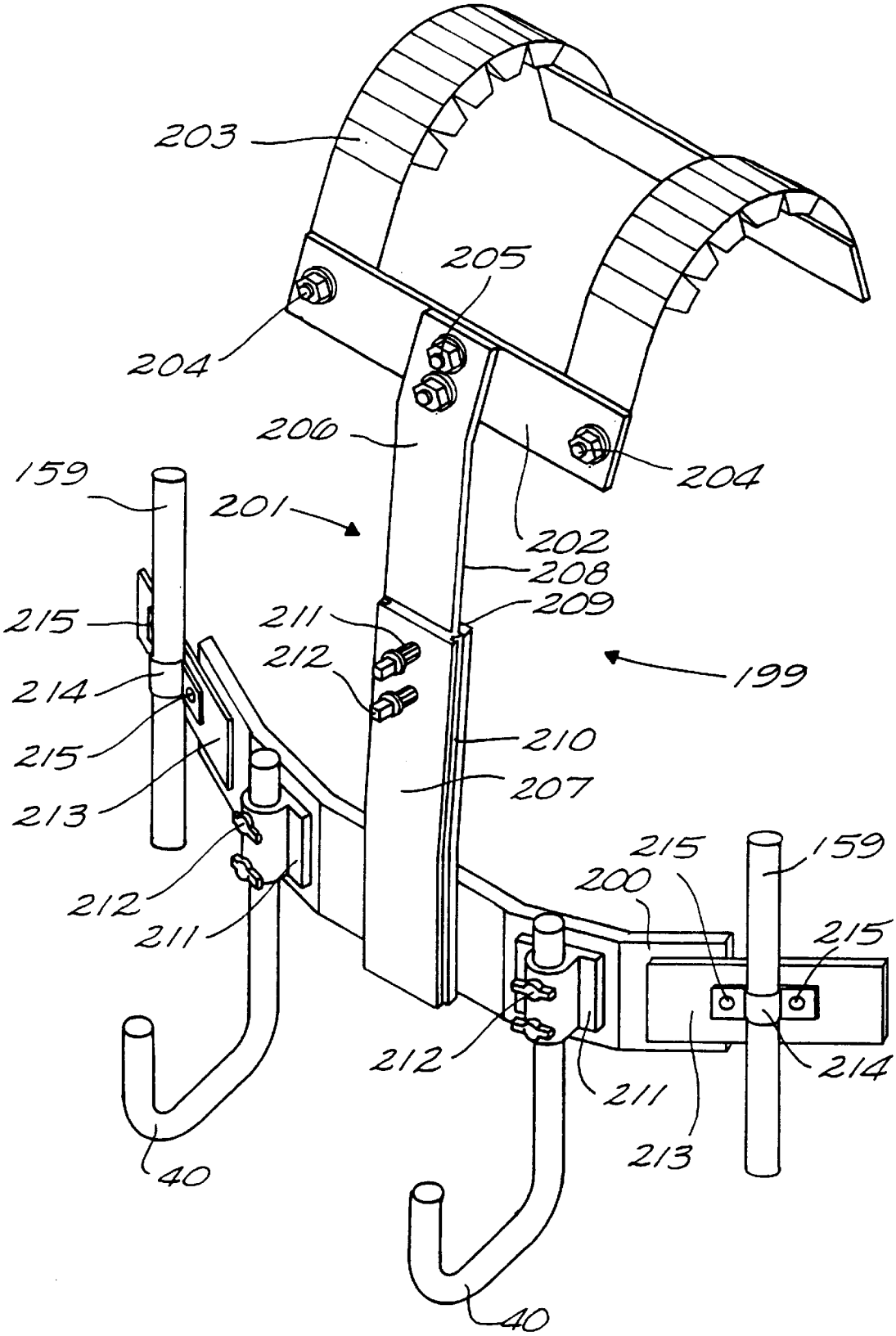
FIG. 33 is an isometric view of a novel T-bar assembly for supporting drums as in FIG. 19 showing J-rod receptors on the belly plate and supporting plated at opposite ends of the belly plate supporting fluted tubes for supporting cymbals as in FIGS. 27–32.
Figure 34:
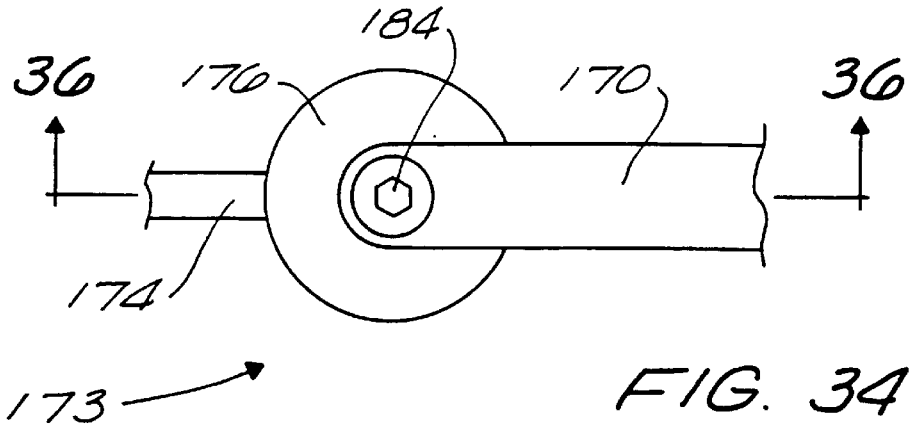
FIG. 34 is a detail view, in elevation, of the pivot connection for the cymbal support as in FIGS. 31 and 32.
Figure 35:
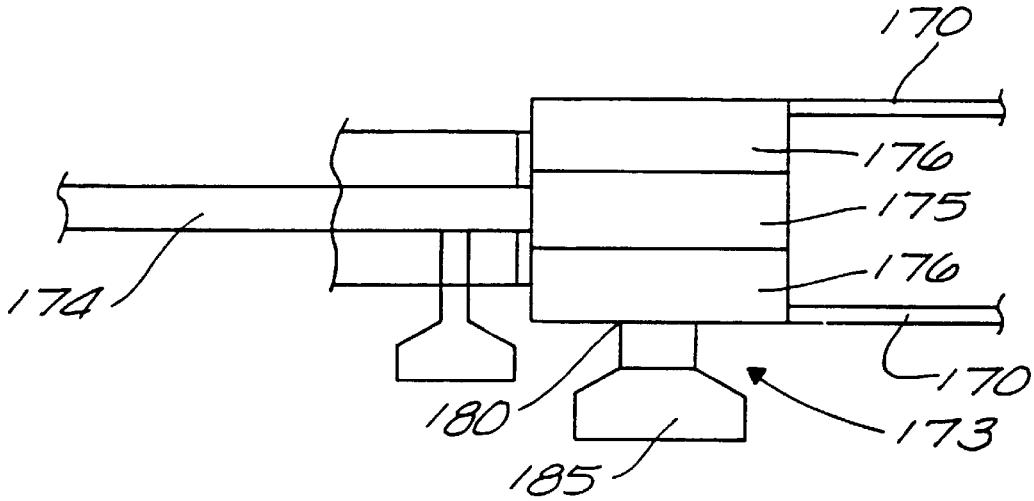
FIG. 35 is a detail plan view of the pivot connection for the cymbal support as in FIG. 34.
Figure 36:
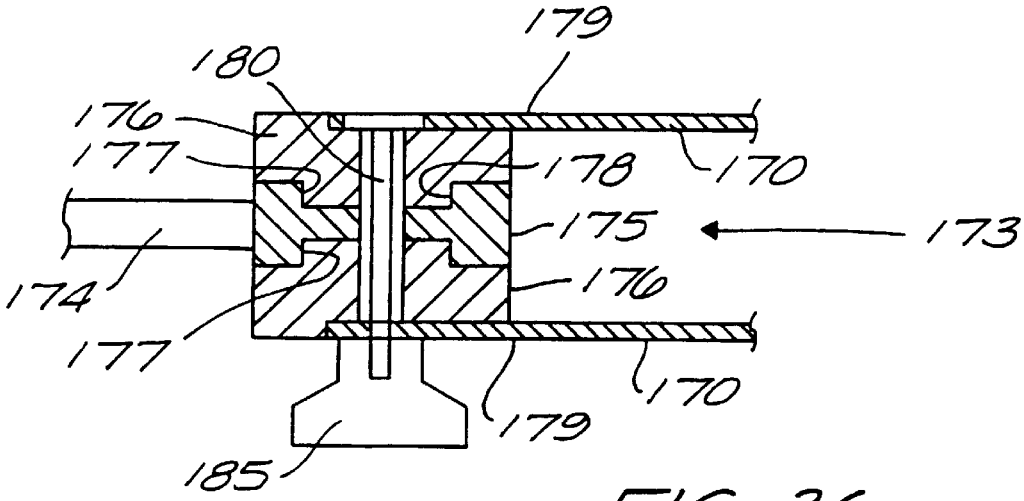
FIG. 36 is a detail view, in center section, of the pivot connection for the cymbal support as in FIGS. 34.
Figure 37:
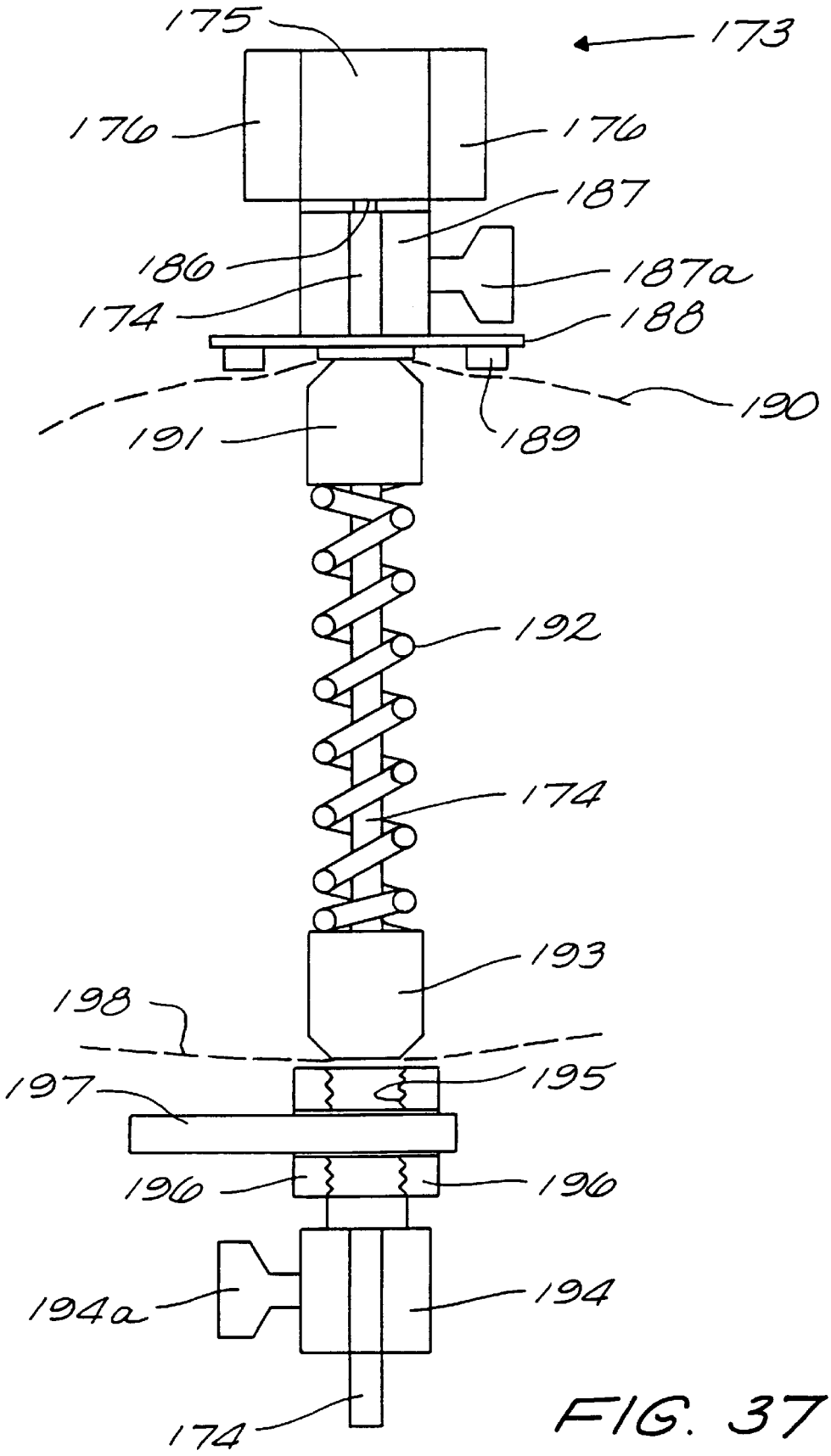
FIG. 37 is a view partly in elevation and partly in section, of the entire cymbal supporting assembly on the supporting rod of the pivot connection as in FIGS. 31–36.
Figure 38:
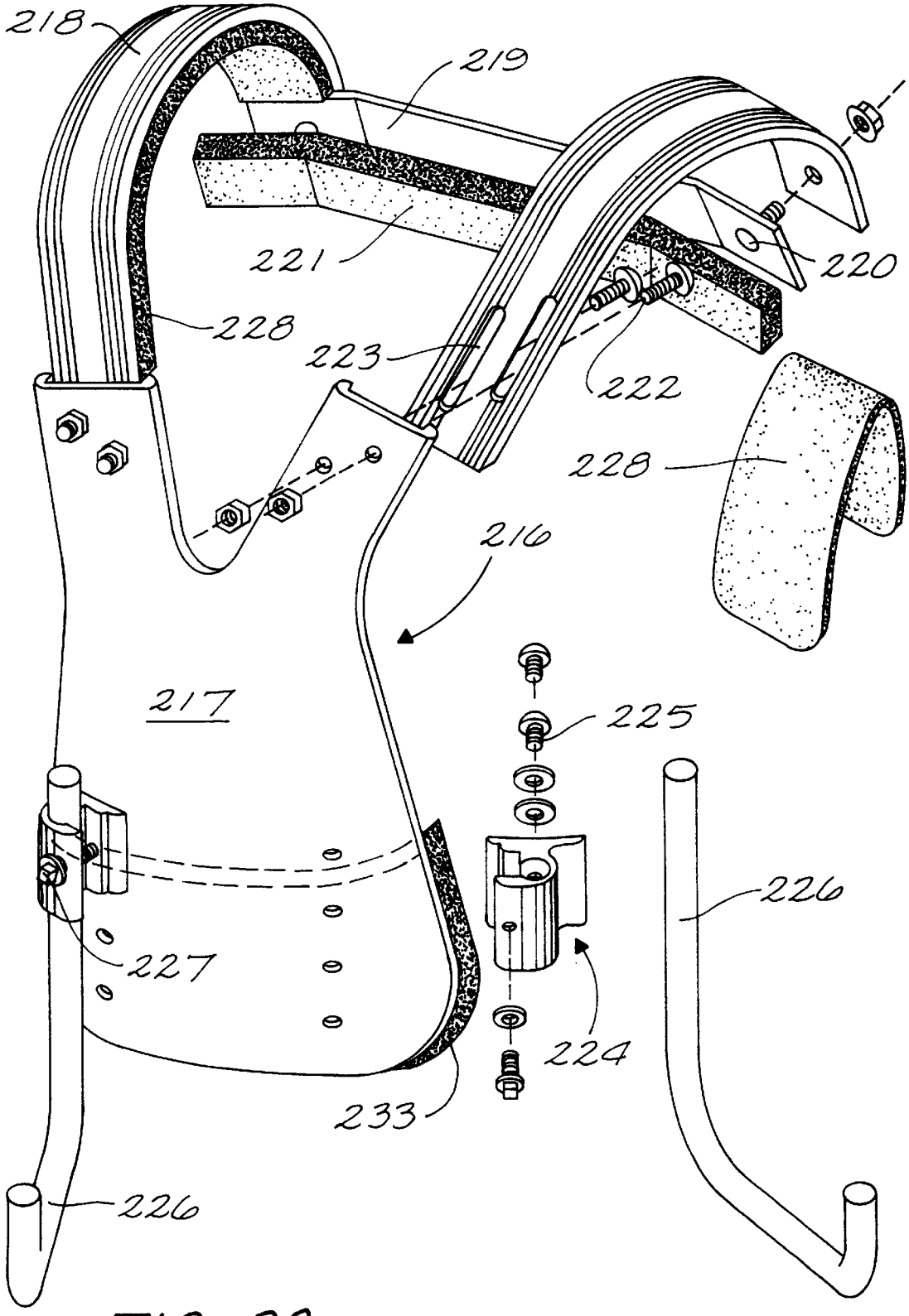
FIG. 38 is an exploded, isometric view of a novel supporting vest for marching drum assemblies, as in FIG. 17, which is constructed to permit adjustment the shoulder straps and the J-rods.
Figure 39:
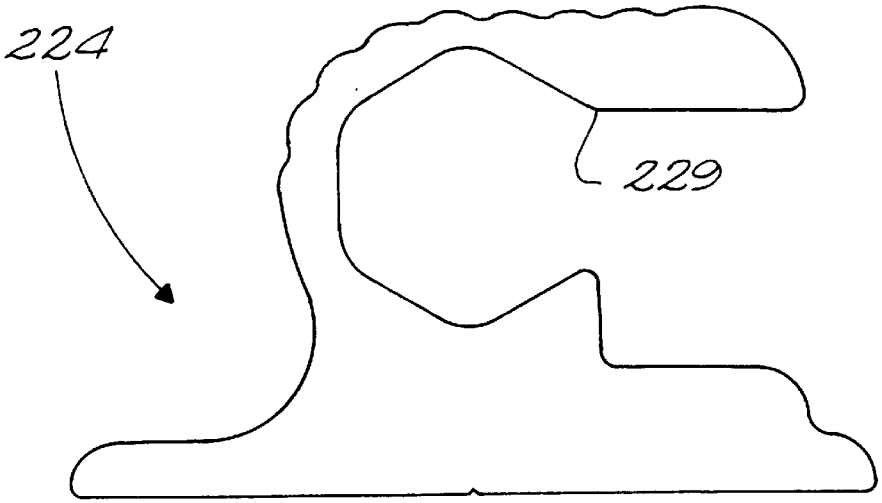
FIG. 39 is an end elevation and FIGS. 40 and 41 are left and right isometric views of the adjustable hardware for J-rods shown in FIG. 38.
Figure 40:
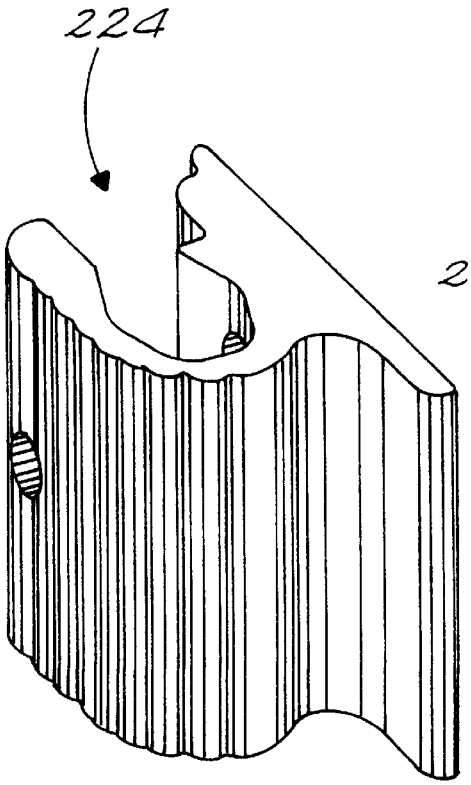
Figure 41:
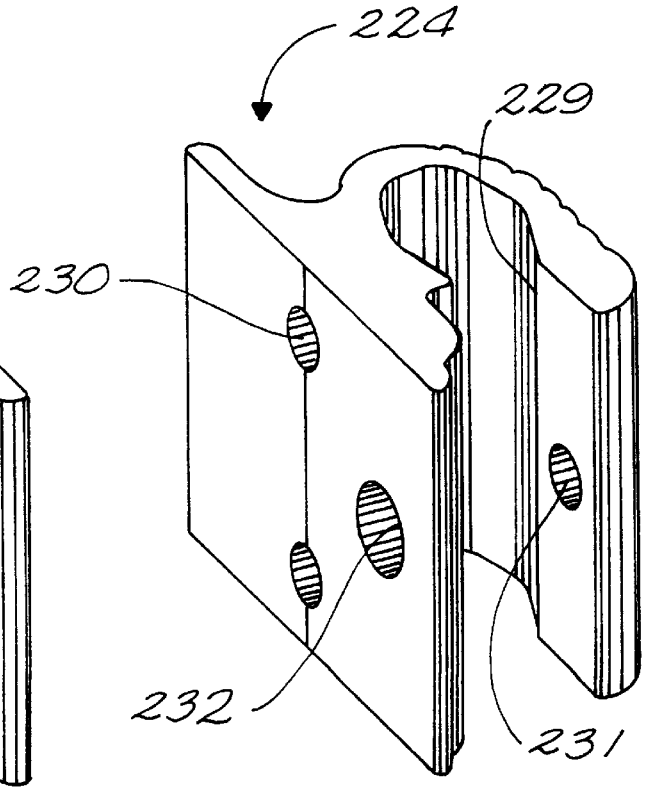

Referring to FIG. 33, there is shown a T-bar-type carrier of the type shown in FIG. 19 and associated hardware which is especially useful in supporting cymbals, alone or together with snare drums or the like.

Adjustable supporting member or carrier 199 (FIG. 33) for percussion instruments, especially cymbals, comprises a belly plate 200, vertical bar assembly 201, upper horizontal bar 202 and shoulder straps 203. The back bar is optional and may be made integral with the shoulder straps by welding or may be removably secured to shoulder straps 203 by screws or bolts. Upper horizontal bar 202 is removably secured to shoulder straps 203 by bolts 204. Upper horizontal bar 202 is removably secured to the upper end of vertical bar assembly 201 by bolts 205.

Vertical bar assembly 201 comprises an upper bar member 206 and lower bar member 207. Upper bar member 206 has a pair of longitudinal grooves 208 in opposite edges. Lower bar member 207 has a pair of inner grooves 209 on opposite sides thereof and a pair of outer grooves 210. Bar members 206 and 207 are assembled with grooves 208 and 209 in telescoping relation for adjustable movement of the bars. Lower bar member 207 has a pair of bolts 21 with square heads 212 which are adjustable into and out of engagement with upper bar member 206 to secure bar assembly 201 together in any predetermined position. Square heads 212 are of a size for operation by a standard drum key.

Belly plate 145 is secured to a short mounting bar, see FIGS. 22 & 25, by flat headed bolts. The mounting bar has edge grooves of a size fitting grooves 209 in lower bar member 207 on which the mounting bar is assembled. The mounting bar has a pair of bolts with square heads (see FIGS. 22 & 25) which are adjustable into and out of engagement with lower bar member 207 to secure the lower bar/mounting bar assembly together in any predetermined vertical location of the belly plate 200. The square heads are of a size for operation by a standard drum key. A pair of J-bar receptacles 211A are secured on belly plate 200 by screws or bolts or the like. J-bars 40 are supported in receptacles 211A and secured in position by T-bolts 212.

Flat plates 213 are secured on opposite ends of belly plate 200 by screws or bolts or the like. Fluted tubes 159 are secured tightly on plates 213 by metal straps 214 and screws or bolts 215. Tubular member 159 is constructed as described above and supports collar members 162*a* which support the pivot arms and cymbal hardware as described above.

OPERATION

The operation of this carrier and cymbal supports should be apparent but will be described briefly for clarity. The carrier 199 is worn by the musician with the shoulder straps 203 positioned over the shoulders and the belly plate 200 supported against his abdomen. Belly plate 200 and upper horizontal bar 202 may have suitable padding (FIG. 17A) over their inner surfaces, as needed, to avoid discomfort. The carrier is adjustable. The positioning of the belly plate 200 is adjusted by adjusting the length of the vertical bar assembly 201 by sliding bars 206 and 207 to a desired position and re-tightening the set bolts 211.

J-rods are installed as described in FIG. 17. Fluted tube 159 is installed by tightening straps 214 as described above. Cymbals 190 and 198 are installed during assembly of the supporting hardware as described above. The positioning of the cymbals 190 & 198 is accomplished by setting the position of fluted tube 159 and the brackets 162*a* and angular setting of pivot arms 170 as described above. The cymbal hardware is assembled as described and set at the desired angle. Adjustment of the cymbal hardware is by rotation of lever 197 which moves bumper 193 and cymbal against the force of spring 192 toward cymbal 190. This has the effect of tuning the cymbals.

ADJUSTABLE MARCHING VEST SUPPORT FOR DRUMS AND OTHER PERCUSSION INSTRUMENTS

Referring to FIGS. 38–41, there is shown a vest- or harness-type supporting member or carrier for percussion instruments which comprises a vest portion 217, shoulder straps 218 and back bar 219. Back bar 219 is removably secured to shoulder straps 218 by screws or bolts 220 and has padding 221. Vest portion 217 is adjustably and removably secured to shoulder straps 218 by screws or bolts 222 which extend through elongated slots 223 which permits adjustment of the straps 218 relative to vest portion 217. Shoulder straps 218 have pads 228 to cushion the load of the instruments carried by carrier 216.

Vest portion 217 has a pair of J-rod receptacles 224 secured by screws or bolts 225. J-rods 226 are supported in receptacles 224 and secured in position by square head bolts 227 which may be operated by a drum key (not shown). Receptacles 224 are cast or extruded and have an open edge portion which can flex to clamp J-rods 226 adjustably. Receptacles 224 have an inner surface that is polygonal, in this case, hexagonal, in section which provides a plurality (in this case five) of surfaces which clamp the surface of the J-rods 226. This is a superior clamping arrangement to set screws that provide only one or two point clamping contact. Holes 230 in the base of each receptacle are used for mounting by means of bolts or screws or the like. Aligned holes 231, 232 receive clamping screws 227 which operate on adjustment to clamp or to release the J-rod 226.

The materials of construction used in this carrier 216 are very important for achieving the desired result. The vest portion 217 is preferably a strong, light-weight composite material such as Fiberglas®. Back bar 219 and shoulder straps 218 are rigid and made of a light metal such as aluminum, magnesium or titanium. Some prior art vests of this type have been of a one-piece Fiberglas® construction. There were incidents of failure of the shoulder straps from repeated flexing. The metal shoulder straps do not fail in flexure and also have the advantage that different sizes are readily accommodated. The vest portion 217 can be of a single size and separate shoulder straps 218 of differing radii for small, medium, large or extra large size may be used or the straps 218 may be adjustable is in the additional embodiments described below. The cushions 221, 228 (FIG. 38) may be of a type used to pad the interior of football and other sports helmets as previously described.

OPERATION

The operation of this carrier should be apparent but will be described briefly for clarity. The carrier 216 is worn by the musician with the shoulder straps 218 positioned over the shoulders and the vest 217 supported against his abdomen. Pads 221, 228 on shouls der straps 218 and back bar 219 cushion the load of the instruments carried by carrier 216. The straps 218 are adjustable by means of slots 223 and screws 222 and the J-rods 226 are adjustable in position by means of receptacles 224 and adjustment screws 225, 227.

Vest 216 may have suitable padding 233 over its inner surface, as needed, at the belly plate or at suitable locations to avoid discomfort from the bolts or screws 222 used to assemble the straps to the vest or bolts or screws 225 used to assemble receptacles 224 on the vest. J-rods 40 are inserted in position and secured in place by tightening set screws 87. The short outer ends of the J-rods are inserted into the J-rod receptacles on the percussion instrument being carried, e.g., drums (single or array), cymbals, xylophone, marimba, or the like.

ADJUSTABLE MARCHING VEST SUPPORT FOR DRUMS AND OTHER PERCUSSION INSTRUMENTS

Referring to FIGS. 42–46, there is shown a carrier 234 for percussion instruments or for use as the shoulder strap portion of one of the other marching vest supports as previously described. Carrier 234 comprises shoulder straps 235 having edge grooves 236 for adjustability. The upper, rear end portion of shoulder straps 235 is connected to back bar assembly 237 (corresponding to back bar 110 in FIG. 26) and the lower, front end portion is connected to horizontal bar assembly 238 (corresponding to horizontal bar 108 in FIG. 26).

Back bar assembly 237 comprises an elongated, fixed bar member 239 and two adjustable mounted supporting plates 240 and 241 thereon. Bar member 239 has internally facing grooves 242. Plates 240 and 241 have outwardly facing grooves 243 which are assembled telescopically with grooves 242 for adjustable telescoping assembly of plates 240 and 241 on bar member 239. Each of the plates 240 and 241 has a locking screw 244 for clamping plates 240 and 241 in a fixed position on bar member 239. Supporting plates 245 are secured pivotally on plates 240 and 241 (see FIG. 44) and have inwardly facing grooves 246 which are assembled telescopically with grooves 236 on shoulder straps 235. This permits adjustment of the back bar assembly 237 relative to shoulder straps 235 which are fixed in any selected position by locking screws 247.

Shoulder straps 235 are adjustably secured to telescoping members 248 which have inwardly facing grooves 249 slidably fitting grooves 236. The lower, front end portion of shoulder straps 235 is connected to horizontal bar assembly 238 (corresponding to horizontal bar 108 in FIG. 26). Horizontal bar assembly 238 comprises an elongated, fixed bar member 250 and two adjustable mounted supporting plates 251 and 252 thereon. Fixed bar member 250 has internally facing grooves 253. Plates 251 and 252 have outwardly facing grooves 256 which are assembled telescopically with grooves 253 for adjustable telescoping assembly of plates 251 and 252 on bar member 250. The ends of telescoping members 248 for shoulder straps 235 are secured by bolts 254 on supporting plates 251 and 252 for pivotal movement thereon. Arcuate slots 255 on telescoping members 248 and bolts 256 secure shoulder straps 235 in angular adjustment within the limits of the arcuate slots (see FIG. 26).

Figure 42:
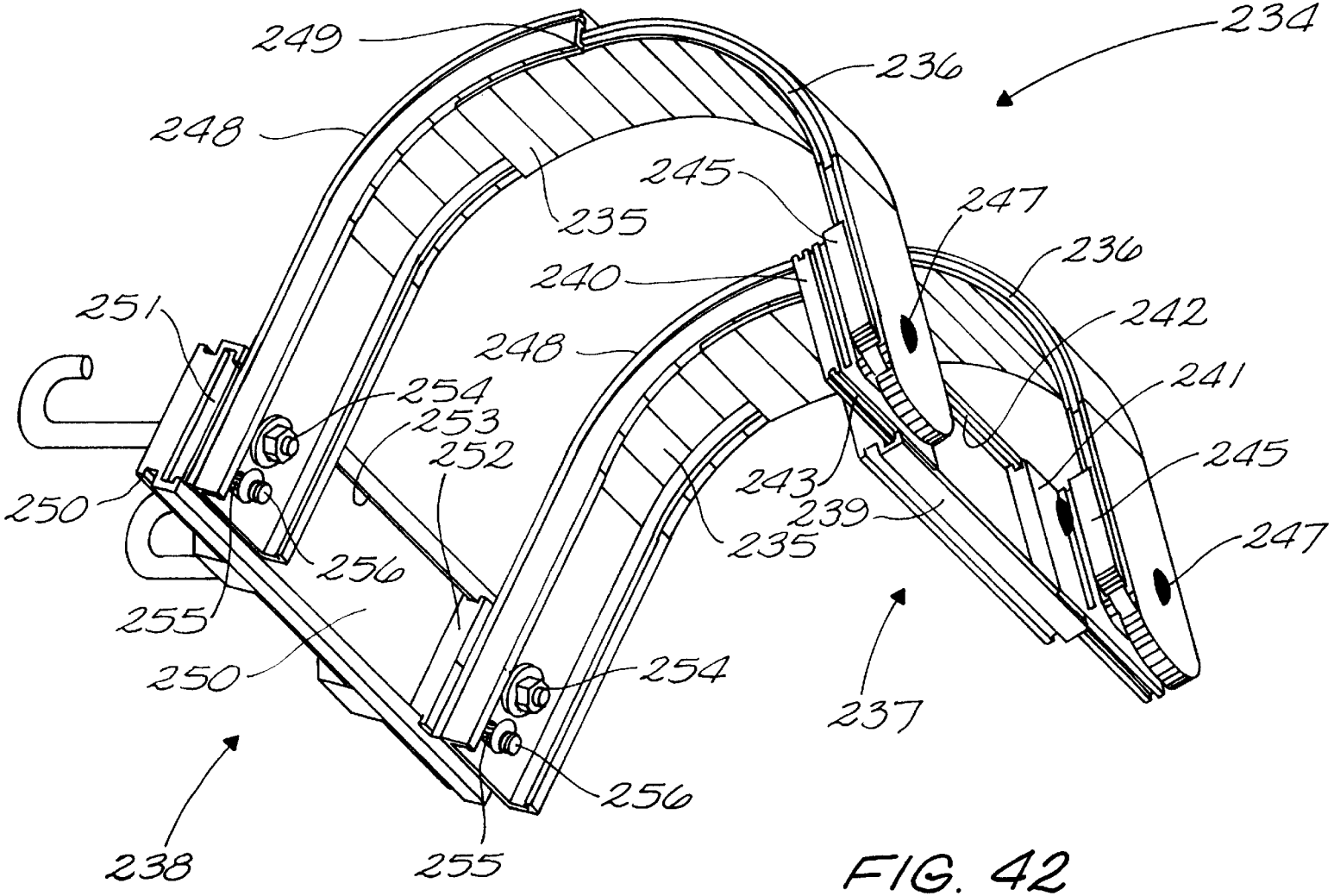
FIG. 42 is an isometric view of another embodiment of marching hardware for drums and the like having adjustable shoulder straps.
Figure 43:
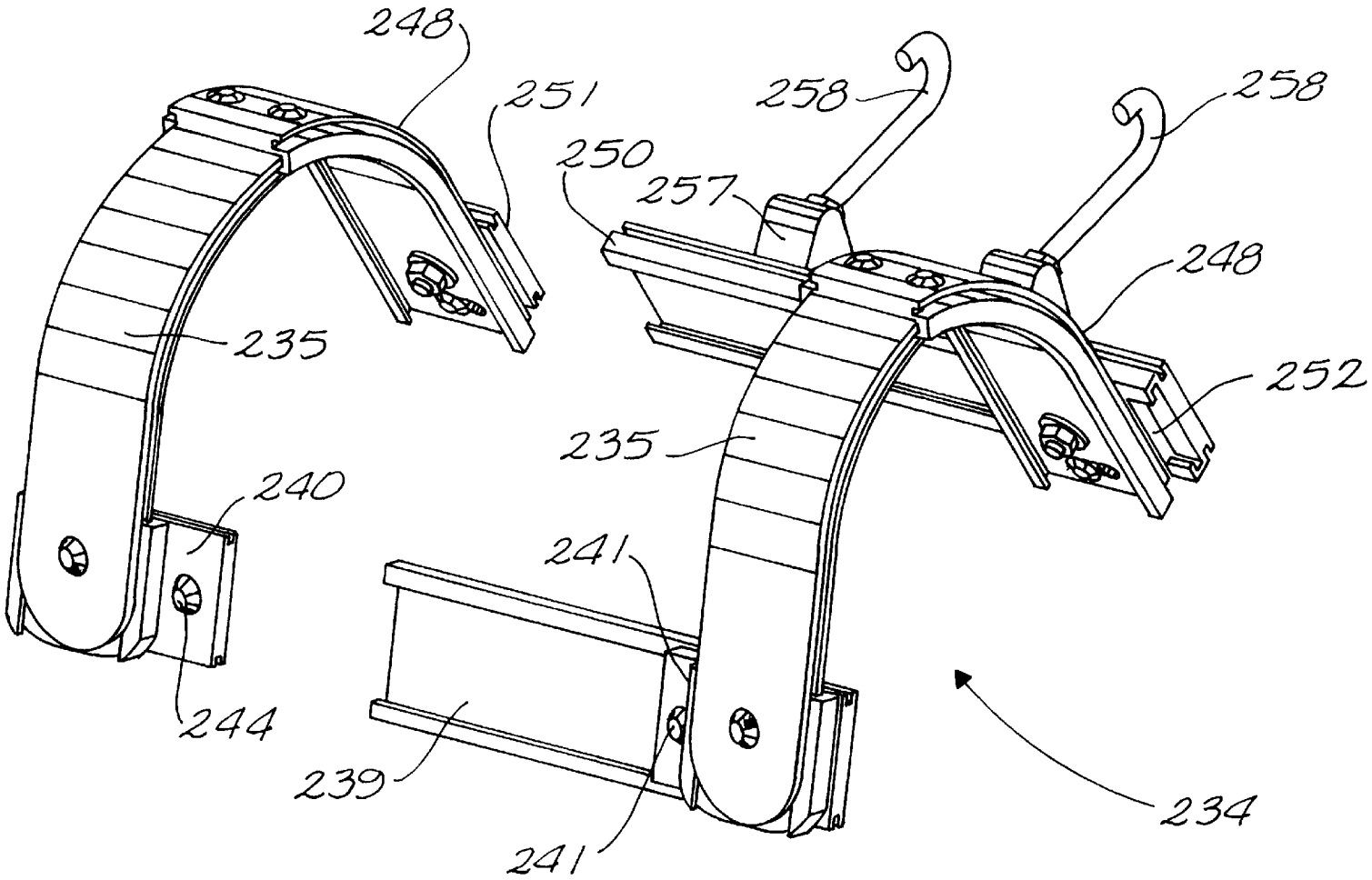
FIG. 43 is an exploded isometric view of the adjustable shoulder straps shown in FIG. 42.
Figure 44:
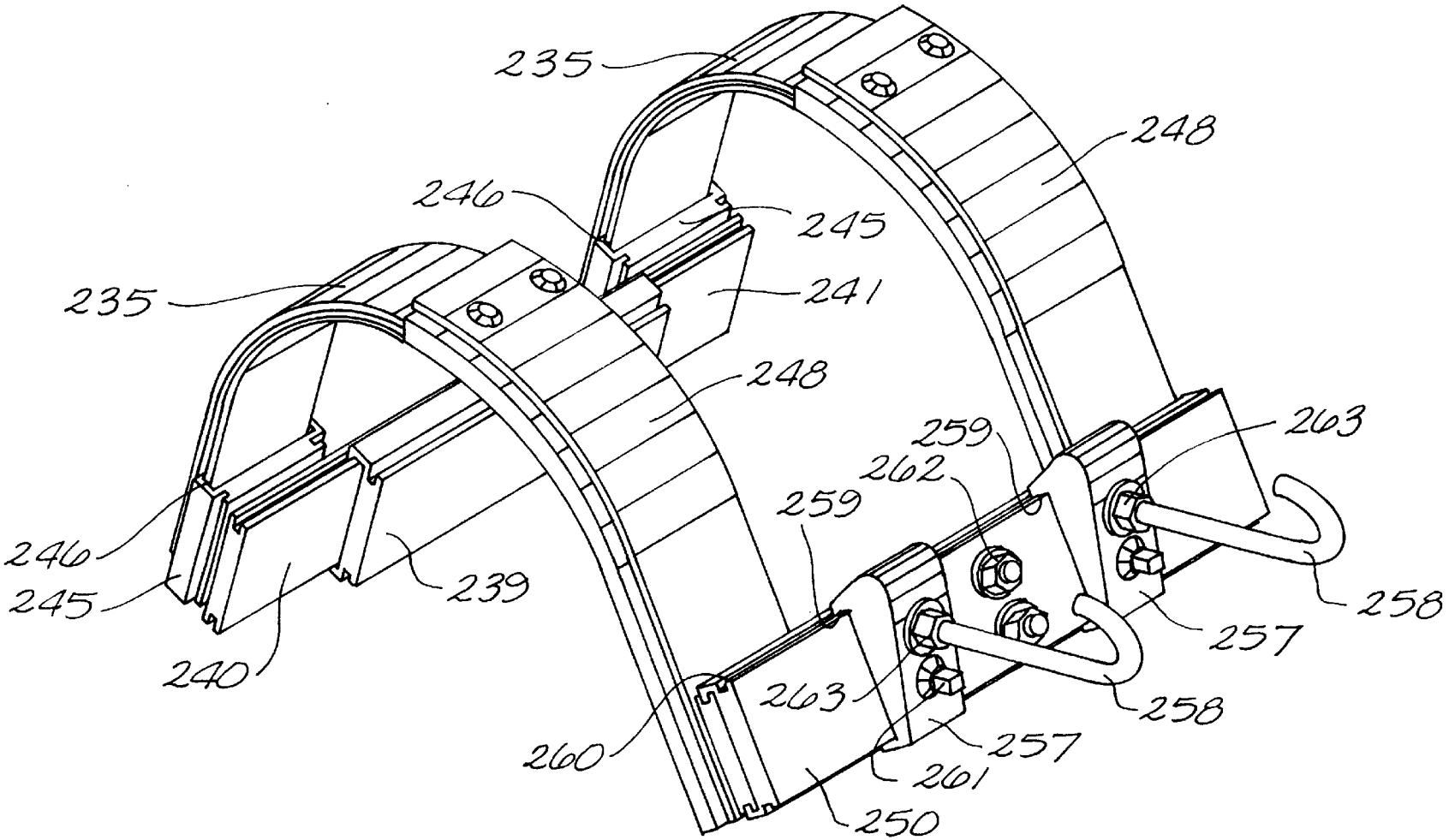
FIG. 44 is an isometric view of an opposite side of FIG. 42.
Figure 45:
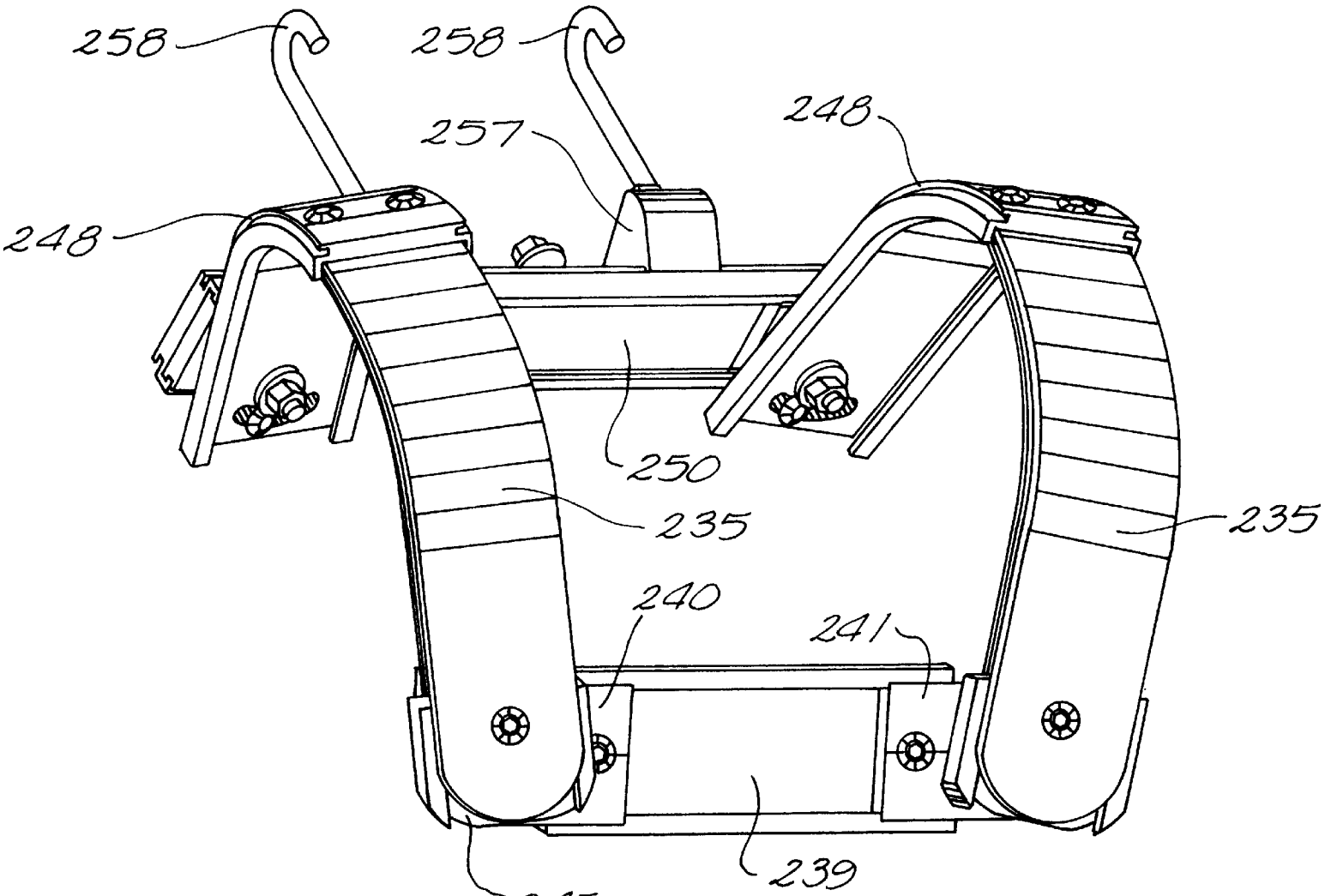
FIG. 45 is an isometric view as in FIG. 44, showing the shoulder straps adjusted angularly.
Figure 46:
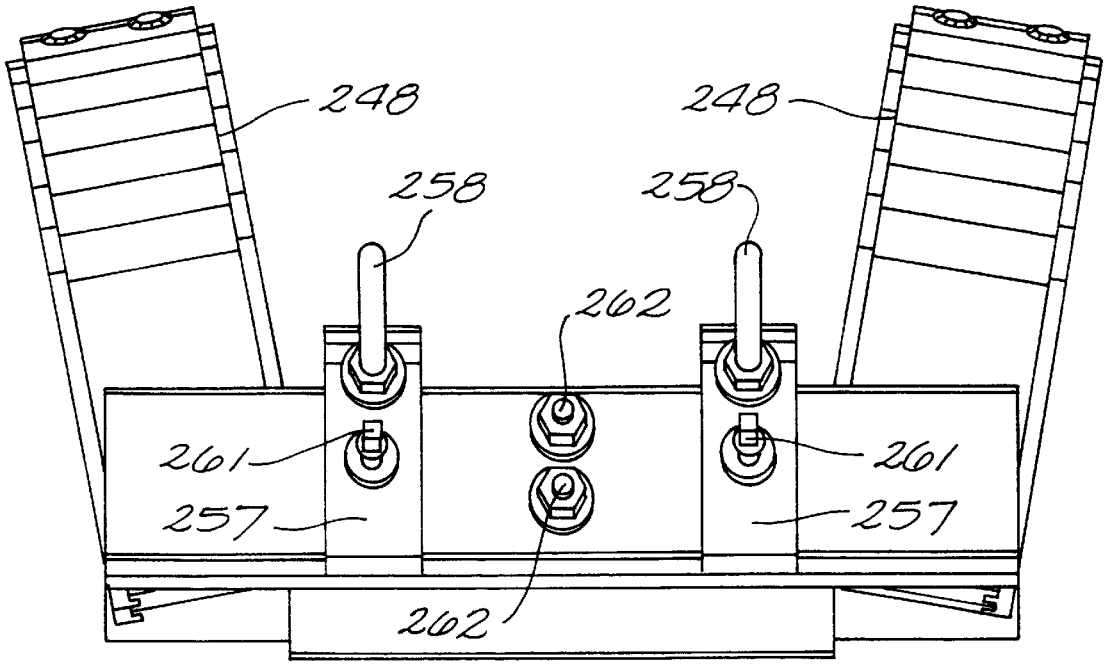
FIG. 46 is a view in front elevation of the marching hardware shown in FIG. 45.

Brackets 257 (corresponding to brackets 139) have J-bolts 258 secured thereon to provide securing hooks where needed. Brackets 257 have internal grooves 259 which fit supporting bar 250 edge grooves 260 for sliding movement thereon and have bolts with square heads 261 of a size for operation by a standard drum key. Bolts 261 set the position of brackets 257 on supporting bar 250 (FIGS. 42, 44). Bolts 262 (corresponding to bolts 111) are provided on bar 250 for connection of the shoulder strap assembly to a lower portion of the supporting harness as in FIG. 26.

OPERATION

The operation of this carrier should be apparent but will be described briefly for clarity. The shoulder straps 235 are worn by the musician positioned over the shoulders and the belly plate, if any, supported against his abdomen. J-bolts 258 are inserted in position and secured in place by tightening bolts. The short outer ends of the J-rods are inserted into the J-rod receptacles on the percussion instrument being carried, e.g., drums (single or array), cymbals, xylophone, marimba, or the like.

The carrier is universally adjustable. The lateral spacing of the J-rod supporting brackets 257 is adjustable by loosening bolts 261, setting the brackets to the desired position and re-tightening the bolts. J-bolts 258 are set to the desired vertical position and angular orientation by nuts 263. The pivotal connections 256 and 247 permit angular adjustment of the shoulder straps 235. The upper ends of shoulder straps 235 are adjustable by telescoping movement of plates 240 and 241. The length of shoulder straps 235 is adjustable at the sliding connection between members 235 and 248 and between member 235 and plates 245.

J-ROD OR POST SUPPORT WITH MORE SECURE CLAMPING

Figure 47:
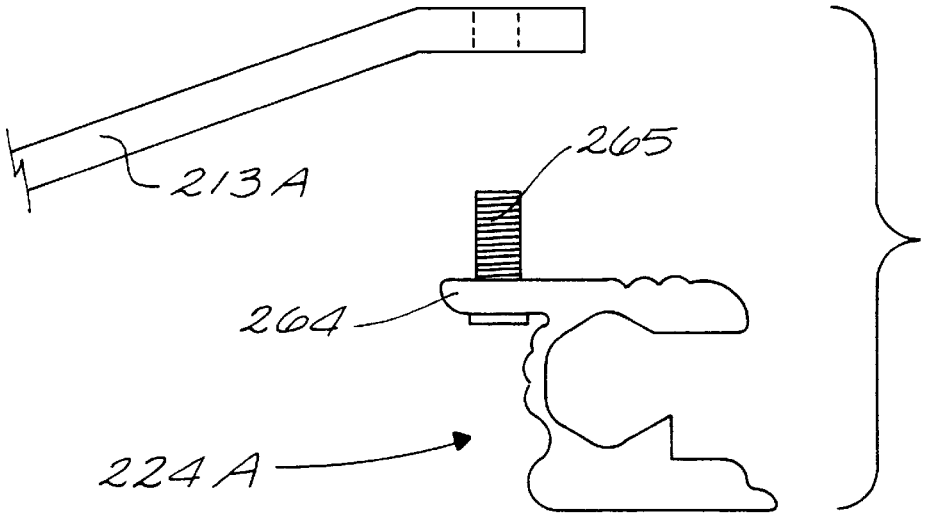
FIG. 47 is a view in end elevation of a novel clamp for posts and J-rods and having an extension for connection to a supporting plate on a marching harness for percussion instruments.
Figure 48:
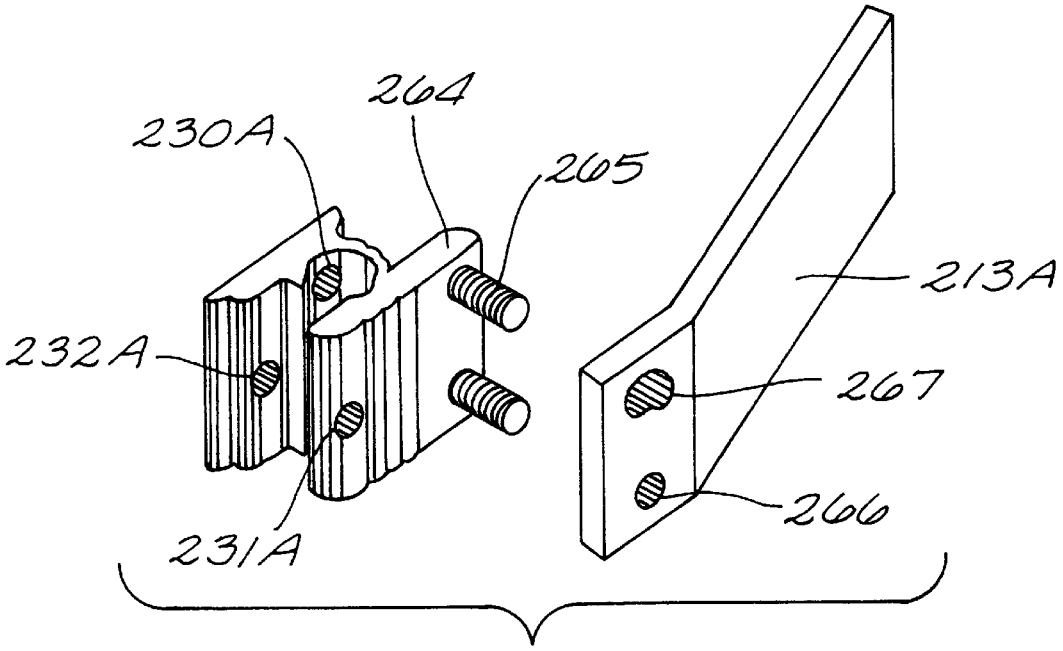
FIG. 48 is a left hand isometric view of the clamp shown in FIG. 47.
Figure 49:
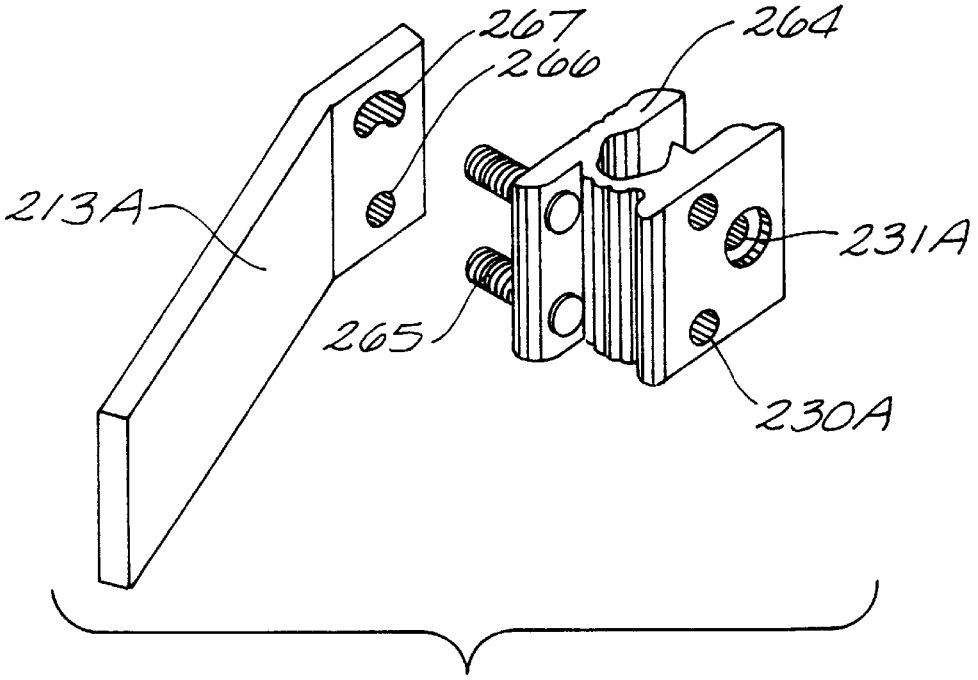
FIG. 49 is a right hand isometric view of the clamp shown in FIG. 47.

In FIGS. 47–49 there is shown an improved clamp for J-rods or posts for percussion hardware or other apparatus having an extension for attachment to other components of the apparatus. J-rod or post receptacles 224A support J-rods or posts as described for FIG. 38. Receptacles 224A are cast or extruded and have an open edge portion which can flex to clamp J-rods or posts adjustably. Receptacles 224A have an inner surface that is polygonal, in this case, hexagonal, in section which provides a plurality (in this case five) of surfaces which clamp the surface of the J-rods or posts. This is a superior clamping arrangement to set screws that provide only one or two point clamping contact. Holes 230A in the base of each receptacle are used for mounting by means of bolts or screws or the like. Aligned holes 231, 232 receive clamping screws which operate on adjustment to clamp or to release the J-rod or post. The upper portion of receptacle 224A has an extension 264 with threaded studs 265 secured therein for connection to a plate member 213A which corresponds to plate 213 in FIG. 33. Plate 213A has holes 266 and 267 which receive studs 265 for clamping by nuts threaded thereon. Hole 267 is elongated as a slot which allows receptacle to be pivoted in position on plate 213A. This arrangement is used as a modification to FIG. 33 or at any place where an extension is needed to offset J-rods or posts from the rest of the apparatus.

J-ROD RECEPTACLES FOR LATERAL ADJUSTMENT ON BELLY PLATE

Figure 50:
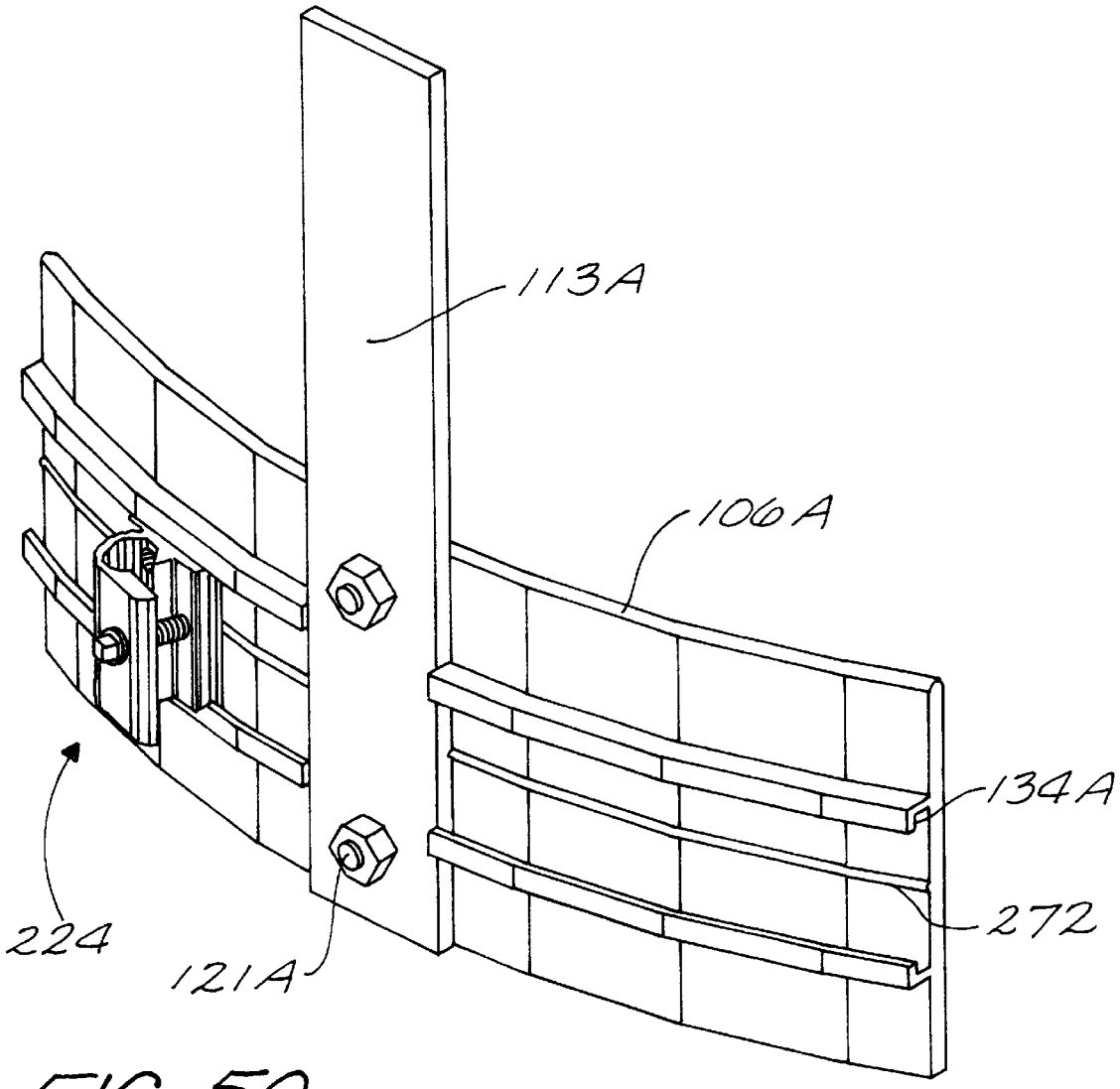
FIG. 50 is a view of the lower portion of the T-bar assembly shown in FIG. 23 utilizing the clamp of FIG. 47–49 for adjustable supporting the J-rods.
Figure 51:
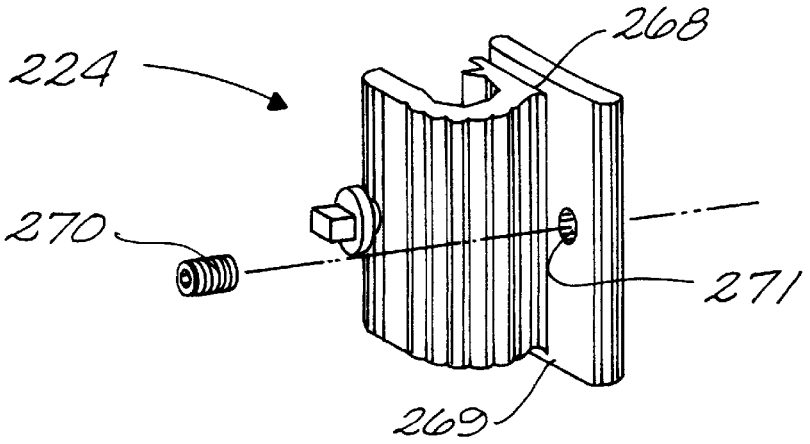
FIG. 51 is an isometric view of the J-rod supporting member of FIG. 50.

This embodiment is a modification of the embodiments shown in FIGS. 19 and 26 where the J-rod receptacles are mounted for lateral movement on a separate supporting bar. In this embodiment, belly plate 106A is secured to a short vertical mounting bar 113A by flat headed bolts 121A. (FIG. 50) Belly plate 106A is an extrusion having inwardly facing grooves 134A. Receptacle 224 has edges 268 and 269 sized to fit grooves 134A on belly plate 106A. Set screw 270 extends through hole 271 and is tightened into groove 272 on belly plate 106A to secure the receptacles in any selected position.

DOUBLE FACING J-ROD RECEPTACLES AND APPLICATION

Figure 52:
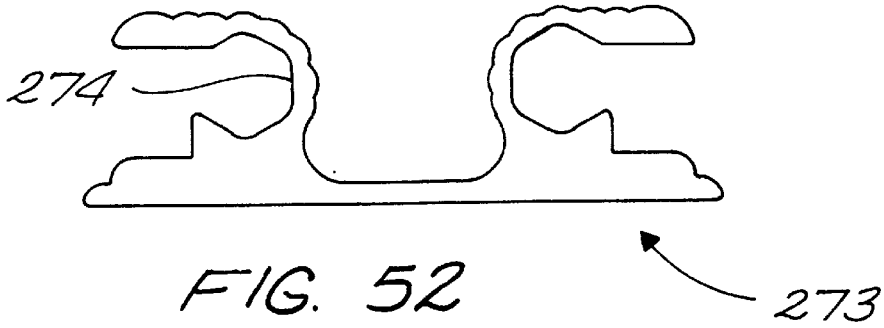
FIG. 52 is a view in end elevation of a novel double clamp for supporting a plurality of posts and/or J-rods.
Figure 53:
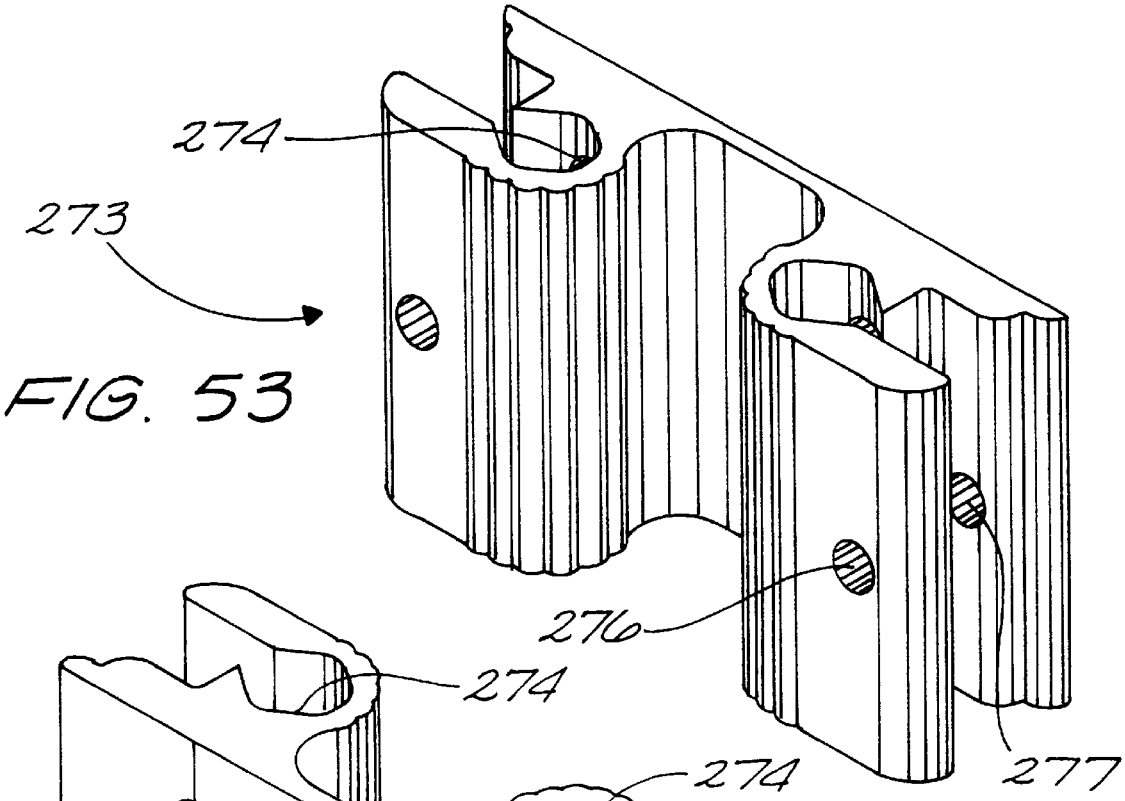
FIG. 53 is a front isometric view of the clamp shown in FIG. 52.
Figure 54:
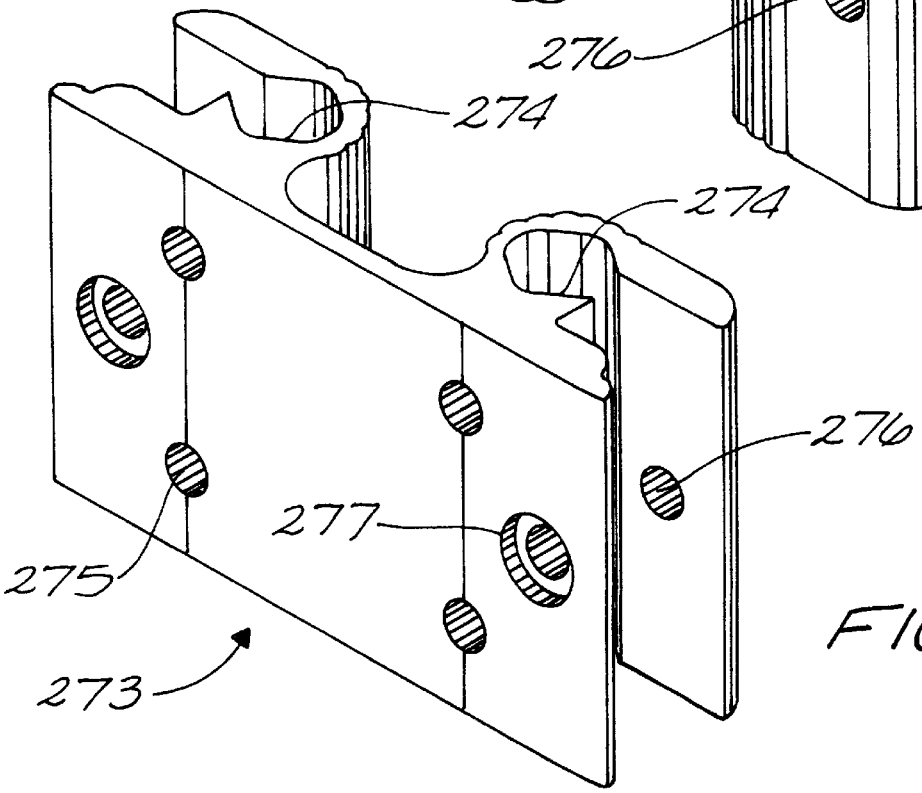
FIG. 54 is a rear isometric view of the clamp shown in FIG. 52.
Figure 55:
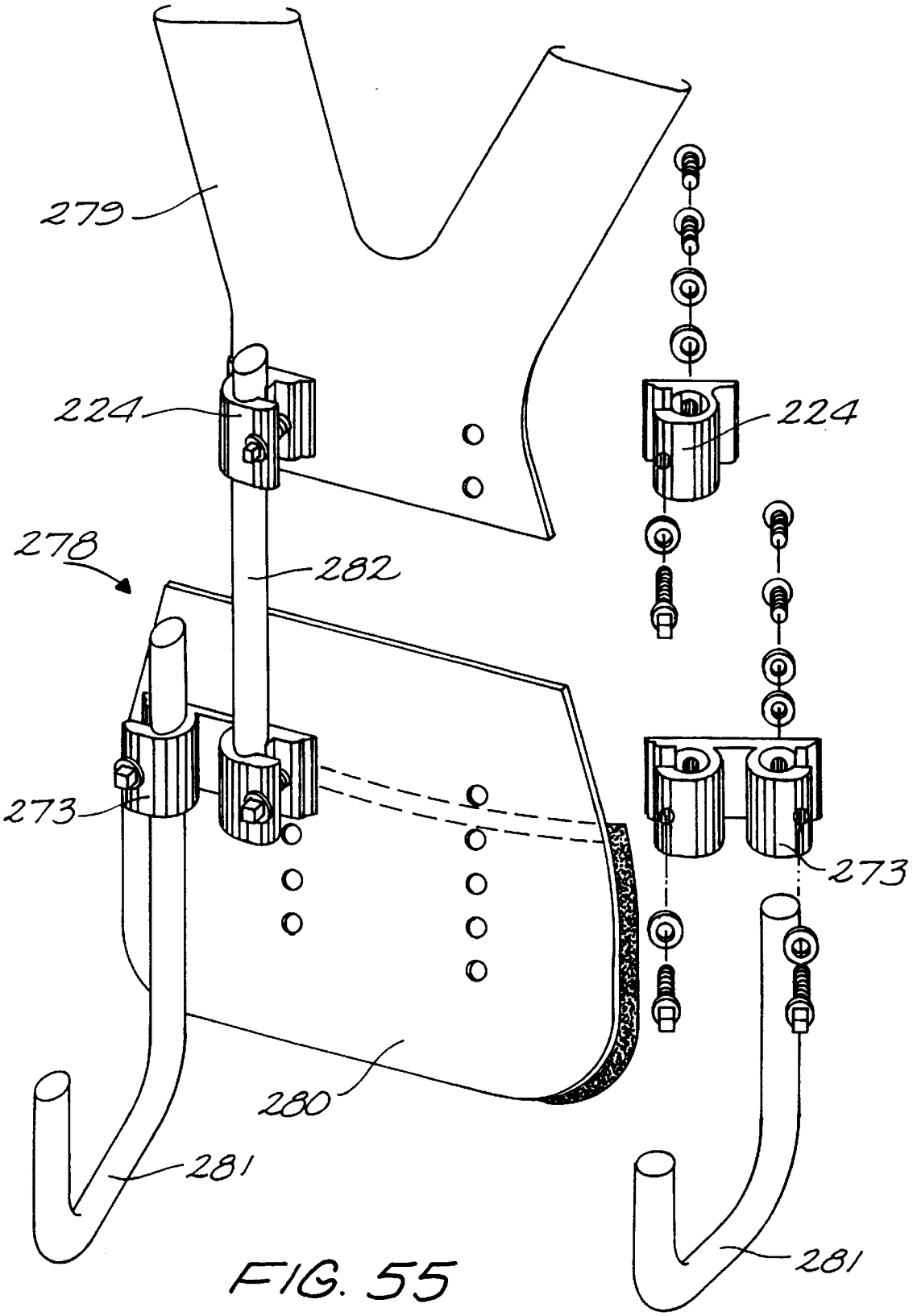
FIG. 55 is an exploded view of a vest assembly with two parts supported for adjustable movement by the double clamp shown in FIGS. 47–49

In FIGS. 52–54 there is shown a double facing receptacle for securing more than one J-rod or post. In FIG. 55, there is shown one application of the double facing receptacle. Receptacle 273 is cast or extruded and has a pair of open edge portions 274 facing in opposite directions which can flex to clamp J-rods or posts adjustably. Receptacles 273 have inner surfaces that are polygonal, in this case, hexagonal, in section which provides a plurality (in this case five) of surfaces which clamp the surface of the J-rods or posts. This is a superior clamping arrangement to set screws that provide only one or two point clamping contact. Holes 275 in the base of each receptacle are used for mounting by means of bolts or screws or the like. Aligned holes 276, 277 receive clamping screws which operate on adjustment to clamp or to release the J-rod or post secured therein.

ADJUSTABLE TWO-PART VEST

In FIG. 55, supporting member or carrier comprises a vest assembly 278 having two separate vest pieces 279, which connects to the shoulder straps, and 280, which supports the J-rods 281. A pair of J-rod or post receptacles 224 are secured on the upper vest piece 279. A pair of the double facing receptacles 273 are secured on the lower vest piece 280. J-rods 281 are secured and clamped in receptacles 273 on opposite sides of the lower vest piece 280. A pair of posts 282 are secured at one end in receptacle 273 and at the other end in receptacles 224. The pieces 279 and 280 are adjusted to a desired position and the key-operated bolts are tightened to clamp both ends of the posts 282 tightly.

While this invention has been described fully and completely, with special emphasis on several preferred embodiments and/or applications, it should be understood that within the scope of the appended claims, the invention may be practiced otherwise than as specifically described.

I claim:

1. A shoulder supported harness assembly for supporting percussion instruments, comprising a supporting member resting against the abdominal region of the wearer in use, a pair of rigid shoulder straps operatively secured to said supporting member and for supporting the same, and drum-supporting hardware operatively supported on said supporting member, a vertically extending tube, rod or post operatively supported on said supporting member, separate from said drum-supporting hardware, for supporting cymbal or other percussion hardware.

2. A shoulder supported harness assembly for supporting percussion instruments according to claim 1, including:

at least one receptacle coupled to said supporting member receiving and supporting said rod, post or tube.

3. A shoulder supported harness assembly for supporting percussion instruments according to claim 2, including:

a J-rod of circular cross-section supported in one of said receptacles, said receptacles are of a one-piece construction comprising a flat base portion and an upper portion overlying said base portion defining an opening permitting said upper portion to flex toward said base portion, said opening being polygonal in cross section to permit clamping said rod by each of the flat polygonal surfaces, screw means for connecting said receptacles to a supporting surface, and screw means for tightening said bracket upper portion to damp on said rod positioned therein.

4. A shoulder supported harness assembly for supporting percussion instruments, comprising shoulder straps cushioning members secured on said shoulder straps, said cushioning members comprise a backing strip of plastic film, and a thin sheet of plastic film enclosing discrete blocks of closed pore plastic foam spaced apart from each other and sealed to said backing strip to enclose separately compressible blocks, and said cushioning members having said backing strip removably coupled to the surface being cushioned for added adjustability, sizing and fit.

5. A shoulder supported harness assembly for supporting percussion instruments according to claim 4, comprising a supporting member resting against the abdominal region of the wearer in use, a pair of rigid shoulder straps operatively secured to said supporting member for supporting the same, and drum-supporting hardware operatively supported on said supporting member, said supporting member and shoulder straps being removably coupled together, and said cushioning members being supported on the underside of said shoulder straps.

6. A shoulder supported harness assembly for supporting percussion instruments according to claim 5, including:

a back bar secured between said shoulder straps for contacting the back of the wearer.

7. A shoulder supported harness assembly for supporting percussion instruments according to claim 6, including a horizontal bar member secured on the lower end of said vertical bar member, a pair of receptacles supported for sliding movement along said horizontal bar member, and J-rods supported in said receptacles.

8. A shoulder supported harness assembly for supporting percussion instruments according to claim 6, including a horizontal bar member secured on the lower end of said vertical bar member, a pair of receptacles supported for sliding movement along said horizontal bar member, J-rods supported in said receptacles, and a vertically extending tube or post supported on said horizontal bar member for supporting cymbal hardware.

9. A shoulder supported harness assembly for supporting percussion instruments according to claim 6, including a horizontal bar member secured on the lower end of said vertical bar member, a pair of receptacles supported for sliding movement along said horizontal bar member, J-rods supported in said receptacles, plate members supported one at each end of said horizontal bar member, receptacles supported one on each of said plate members, and vertical rods supported in said last named receptacles for supporting cymbal hardware.

10. A shoulder supported harness assembly for supporting percussion instruments according to claim 6, in which said supporting member is a vest of a composite material supporting the abdominal region of the wearer in use.

11. A shoulder supported harness assembly for supporting percussion instruments according to claim 9, including a curved horizontal bar member secured to a lower portion of said vest, a pair of receptacles supported for sliding movement on said horizontal bar member, and J-rods supported in said receptacles.

12. A shoulder supported harness assembly for supporting percussion instruments according to claim 10, including in addition to said J-rods, a vertically extending tube or post supported on said horizontal bar member for supporting cymbal or other percussion hardware.

13. A shoulder supported harness assembly for supporting percussion instruments according to claim 10, including plate members supported one at each end of said horizontal bar member, second receptacles supported one on each of said plate members, and vertical rods supported in said second receptacles for supporting cymbal or other percussion hardware.

14. A shoulder supported harness assembly for supporting percussion instruments according to claim 11 in which said receptacles are of a one piece construction comprising a flat base portion and an upper portion overlying said base portion defining an opening permitting said upper portion to flex toward said base portion, said opening being polygonal in cross section to permit clamping said rod on each of the flat polygonal surfaces, screw means for connecting said receptacles to a supporting surface, and screw means for tightening said bracket upper portion to clamp on said rod positioned therein.

15. A shoulder supported harness assembly for supporting percussion instruments according to claim 11, in which said receptacles are of a one-piece construction comprising an elongated flat base portion and an upper portion overlying opposite ends of said base portion defining a pair of openings permitting each said upper portion to flex toward said base portion, said openings being polygonal in cross section to permit clamping a rod by each of the flat polygonal surfaces, screw means for connecting said receptacles to a supporting surface, and screw means for tightening said bracket upper portion to clamp on a rod positioned therein, J-rods fitting in and secured by one of said openings, and vest connecting rods fitting in and secured by the other of said openings.

16. A shoulder supported harness assembly for supporting percussion instruments according to claim 10, in which said shoulder straps are formed of a rigid light metal.

17. A shoulder supported harness assembly for supporting percussion instruments according to claim 10, in which said shoulder straps and said supporting member are formed of a rigid light metal which is magnesium, aluminum or titanium.

18. A shoulder supported harness assembly for supporting percussion instruments according to claim 6, in which said vest is formed in two vertically spaced pieces having a securing rod, and receptacles secured on each piece receive and clamp the ends of said rods for adjustably securing said pieces at a selected vertical spacing.

19. A shoulder supported harness assembly for supporting percussion instruments according to claim 6, in which said supporting member is a T-bar support having an upper horizontal bar member, a belly plate member, and a vertically oriented bar member secured to and interconnecting said upper horizontal member and said belly plate.

20. A shoulder supported harness assembly for supporting percussion instruments according to claim 5, in which said drum-supporting hardware comprises J-rods or J-bolts supported on said supporting member.

21. A shoulder supported harness assembly for supporting percussion instruments according to claim 5, in which said drum supporting hardware comprises a pair of supporting brackets supported on said supporting member and having recesses therein, and J-rods secured in said bracket recesses.

22. A shoulder supported harness assembly for supporting percussion instruments according to claim 5, in which said supporting member is a T-bar support having an upper horizontal bar member, a belly plate member, a vertically oriented bar member secured to and interconnecting said upper horizontal member and said belly plate, and said vertically oriented bar member comprising first and second bar member sections slidably interconnected for adjustment of the length thereof.

23. A shoulder supported harness assembly for supporting percussion instruments according to claim 22, including means supporting said belly plate member for vertical movement along said a vertically oriented bar member.

24. A shoulder supported harness assembly for supporting percussion instruments according to claim 23 in which:

said J-rod supporting means is adjustable for locating the J-rods in a set position.

25. A shoulder supported harness assembly for supporting percussion instruments according to claim 23, including means supporting said belly plate member for vertical movement along said vertically oriented bar member, a pair of J-rods, means for supporting said J-rods for vertical movement relative to said belly plate and lateral movement toward and away from each other to vary the spacing of said J-rods at the point of support thereon, a pair of threaded J-bolts, and means for supporting said J-bolts on said upper horizontal bar member for lateral movement toward and away from each other to vary the spacing of said J-bolts at the point of support thereon.

26. A shoulder supported harness assembly for supporting percussion instruments according to claim 23, including means supporting said belly plate member for vertical movement along said vertically oriented bar member, a pair of J-rods, means for adjustably supporting said J-rods for vertical movement relative to said belly plate and lateral movement toward and away from each other to vary the spacing of said J-rods at the point of support thereon, a pair of threaded J-bolts, and means for supporting said J-bolts on said upper horizontal bar member for lateral movement toward and away from each other to vary the spacing of said J-bolts at the point of support thereon.

27. A shoulder supported harness assembly for supporting percussion instruments according to claim 23, including receptacles supported on said belly plate and J-rods supported therein, and laterally extending plates at each end of said with receptacles supported thereon and vertically extending posts supported therein.

28. A shoulder supported harness assembly for supporting percussion instruments according to claim 27, in which said post supporting receptacles include an extension for connection to said J-rod supporting receptacles.

29. A shoulder supported harness assembly for supporting percussion instruments according to claim 22, including means supporting said belly plate member for vertical movement along said vertically oriented bar member, a pair of J-rods, and means for supporting said J-rods for vertical movement relative to said belly plate and lateral movement toward and away from each other to vary the spacing of said J-rods at the point of support thereon.

30. A shoulder supported harness assembly for supporting percussion instruments according to claim 24, including cymbal supporting hardware assembled over the distal end of said rod and comprising:

spring loaded clamp means for clamping a cymbal on said rod.

31. A shoulder supported harness assembly for supporting percussion instruments, comprising a supporting member resting against the abdominal region of the wearer in use, a pair of rigid shoulder straps operatively secured to said supporting member for supporting the same, and drum supporting hardware operatively supported on said supporting member, and cushioning members supported on a body-contacting portion of said harness assembly, said cushioning members comprise a backing strip of plastic film, a thin sheet of plastic film enclosing discrete blocks of closed pore plastic foam and sealed to said backing strip to enclose separately compressible blocks spaced apart from each other, and said cushioning members having said backing strip secured to the surface being cushioned for added adjustability, sizing and fit.

32. A shoulder supported harness assembly for supporting percussion instruments, comprising a supporting member resting against the abdominal region of the wearer in use, a pair of rigid shoulder straps operatively secured to said supporting member for supporting the same, and drum-supporting hardware operatively supported on said supporting member, said supporting member and shoulder straps being removably secured together, and cushioning members supported on the underside of said shoulder straps, said supporting member comprising a T-bar support having an upper horizontal bar member, a belly plate member, a vertically oriented bar member secured to and interconnecting said upper horizontal member and said belly plate, and said vertically oriented bar member comprising first and second bar member sections slidably interconnected for adjustment of the length thereof, said belly plate having J-rod receiving receptacles with cooperating rib and groove construction providing a guide track for lateral movement of said receptacles on said belly plate.

33. A shoulder supported harness assembly for supporting percussion instruments, comprising a supporting member resting against the abdominal region of the wearer in use, a pair of rigid shoulder straps operatively secured to said supporting member for supporting the same, and drum-supporting hardware operatively supported on said supporting member, said supporting member and shoulder straps being removably secured together, and cushioning members supported on the underside of said shoulder straps, in which said supporting member is a T-bar support having an upper horizontal bar member, a belly plate member, a vertically oriented bar member secured to and interconnecting said upper horizontal member and said belly plate, a vertically oriented tube having a plurality of circumferentially spaced grooves extending longitudinally on its exterior surface, means supporting said tube adjacent to said belly plate, collar members operatively connected with said grooves to slide longitudinally therein, at least one pivoted arm having one end supported on said collar members and a distal end movable by said collar members both vertically and angularly relative to said tube, and a pivotal supporting member at the distal end of said pivoted arm.

34. A shoulder supported harness assembly for supporting percussion instruments according to claim 33, in which said collar members are independently movable along said grooves, at least one pivoted arm supported on one of said collar members, at least one pivoted brace supported on another of said collar members at one end and to an intermediate point on said pivoted arm at the other end, and independent movement of said collar members causing the distal end of said pivoted arm to move both vertically and angularly relative to said tube.

35. A shoulder supported harness assembly for supporting percussion instruments according to claim 34, in which said tube supporting means comprises one of said collar members supported adjacent to said belly plate and fitting said grooves and clamping means clamping said tube to said one collar member, and said collar members supporting said pivot arm and brace on a side of said tube opposite to said one collar member.

36. A shoulder supported harness assembly for supporting percussion instruments according to claim 33, in which said tube supporting means comprises one of said collar members supported adjacent to said belly plate and fitting said grooves and clamping means clamping said tube to said one collar member, and said collar members supporting said pivot arm and brace on a side of said tube opposite to said one collar member.

37. A shoulder supported harness assembly for supporting percussion instruments according to claim 33, in which said pivotal supporting member at the distal end of said pivoted arm comprises a pair of supporting bases secured on said pivoted arm, a cylindrical hub supported between said supporting bases for rotary movement therebetween, and a supporting rod secured at one end in said rotary hub and having a distal end operable to have pivotal movement relative to said supporting bases.

38. A shoulder supported harness assembly for supporting percussion instruments according to claim 37, including a threaded bolt and clamping nut secured thereon extending through said supporting bases and said cylindrical hub to hold the same together and to clamp pivotal supporting member against angular movement.

39. A shoulder supported harness assembly for supporting percussion instruments according to claim 33, in which said pivotal supporting member at the distal end of said pivoted arm comprises a pair of supporting bases secured on said pivoted arm, a cylindrical hub supported between said supporting bases for rotary movement therebetween, and a supporting rod secured at one end in said rotary hub and having a distal end operable to have pivotal movement relative to said supporting bases, including telescopically assembled supporting means comprising one member having a longitudinally extending rib and another member having a longitudinally extending groove in which said rib fits for extension and retraction, and a back bar removably and adjustably secured to said shoulder straps to position said back bar adjustably for contacting the back of the wearer in the most comfortable position.

40. A shoulder supported harness assembly for supporting percussion instruments according to claim 39, in which:

said telescopically assembled supporting means is operable adjust the size and position of said shoulder straps and said back bar for contacting the back of the wearer in the most comfortable position.

41. A shoulder supported harness assembly for supporting percussion instruments according to claim 40, in which:

said telescopically assembled supporting means is of a slide and groove construction operable adjust the size and position of said shoulder straps and said back bar for contacting the back of the wearer in the most comfortable position.

42. A shoulder supported harness assembly for supporting percussion instruments, comprising a supporting member resting against the abdominal region of the wearer in use, a pair of rigid shoulder straps operatively secured to said supporting member for supporting the same, and drum-supporting hardware operatively supported on said supporting member, said supporting member and shoulder straps being removably secured together, and cushioning members supported on the underside of said shoulder straps, said supporting member is a vest of a composite material supporting the abdominal region of the wearer in use, a vertically oriented tube having a plurality of circumferentially spaced grooves extending longitudinally on its exterior surface, means supporting said tube adjacent to said belly plate, collar members operatively connected with said grooves to slide longitudinally therein, at least one pivoted arm having one end supported on said collar members and a distal end movable by said collar members both vertically and angularly relative to said tube, and a pivotal supporting member at the distal end of said pivoted arm.

43. A shoulder supported harness assembly for supporting percussion instruments according to claim 42, in which said collar members are independently movable along said grooves, at least one pivoted arm supported on one of said collar members, at least one pivoted brace supported on another of said collar members at one end and to an intermediate point on said pivoted arm at the other end, and independent movement of said collar members causing the distal end of said pivoted arm to move both vertically and angularly relative to said tube.

44. A shoulder supported harness assembly for supporting percussion instruments according to claim 43, in which:

said supporting member comprises a rigid vest having elongated slots at the upper end thereof, said shoulder straps being secured by bolts extending into said vest slots and operable on tightening to fix the position of said shoulder straps on said vest.

45. A shoulder supported harness assembly for supporting percussion instruments according to claim 43, in which:

said drum supporting hardware comprises J-rods supported in receptacles on said supporting member, said receptacles comprising a flat base portion and an upper portion overlying said base portion defining an opening permitting said upper portion to flex toward said base portion, said opening being polygonal in cross section to permit clamping a rod on each of the flat polygonal surfaces, screw means for connecting said receptacles to a supporting surface, and screw means for tightening said bracket upper portion to clamp on a rod positioned therein.

46. A shoulder supported harness assembly for supporting percussion instruments according to claim 43, including:

a back bar removably and adjustably secured between said shoulder straps for contacting the back of the wearer.

47. A shoulder supported harness assembly for supporting percussion instruments, comprising a supporting member resting against the abdominal region of the wearer in use, a pair of rigid shoulder straps operatively secured to said supporting member for supporting the same, and drum-supporting hardware operatively supported on said supporting member, said supporting member and shoulder straps being removably secured together, and cushioning members supported on the underside of said shoulder straps, in which said supporting member is a T-bar support having an upper horizontal bar member, a belly plate member, a vertically oriented bar member secured to and interconnecting said upper horizontal member and said belly plate, a pair of vertically oriented tubes having a plurality of circumferentially spaced grooves extending longitudinally on its exterior surface, means supporting said tubes at opposite ends of said belly plate, collar members operatively connected with said grooves to slide longitudinally therein, at least one pivoted arm having one end supported on said collar members and a distal end movable by said collar members both vertically and angularly relative to said tube, a pivotal supporting member at the distal end of said pivoted arm, and drum-supporting hardware comprises a pair of J-rods supported on said belly plate.

48. A shoulder supported harness assembly for supporting percussion instruments, comprising a supporting member resting against the abdominal region of the wearer in use, a pair of rigid shoulder straps operatively secured to said supporting member for supporting the same, and drum-supporting hardware operatively supported on said supporting member, said supporting member and shoulder straps being removably secured together, and cushioning members supported on the underside of said shoulder straps in which, said supporting member is a vest of a composite material supporting the abdominal region of the wearer in use, a curved horizontal member is secured to a lower portion of said vest, a pair of receptacles are supported for sliding movement on said horizontal bar member, J-rods are supported in said receptacles, and including cymbal-supporting hardware assembled over the distal end of said rod, in which:

said spring loaded clamp means for clamping a cymbal on said rod comprises a cylindrical hub secured by a bolt on said rod, a supporting disc having three coplanar rubber or plastic bumpers supported on said rod, said bumpers receiving and supporting a cymbal on fmal assembly, a cylindrical bumper member with tapered end positioned over said rod and abutting a cymbal when installed thereon, a coil spring surrounding said rod and having one end abutting said cylindrical bumper member, another cylindrical bumper member slidably positioned on said rod against another end of said coil spring, an adjustment assembly secured on the distal end of said rod abutting said another cylindrical bumper member, said adjustment assembly comprising:

a brass cylindrical hub secured on said rod and having a threaded tubular extension, an internally threaded tubular sleeve member positioned on said extension and movable longitudinally against said last named bumper and having a handle for rotation, and operable on rotation by said handle to compress said bumper members and said spring.

49. A shoulder supported harness assembly for supporting percussion instruments, comprising:

a supporting member resting against the upper body of the wearer in use, a pair of rigid shoulder straps operatively secured to said supporting member, drum supporting hardware coupled to said supporting member, said supporting member and shoulder straps being coupled together, and means for adjustably and slidably supporting and positioning said drum-supporting hardware laterally of said supporting member.

50. A shoulder supported harness assembly for supporting percussion instruments, comprising a supporting member resting against the abdominal region of the wearer in use, a pair of rigid light metal shoulder straps operatively secured to and supporting said supporting member, telescoping support members slidable relative to each other and interconnecting said shoulder straps and said supporting member for adjusting the position of said supporting member vertically relative to said shoulder straps, and drum-supporting hardware operatively supported on said supporting member.

51. A shoulder supported harness assembly for supporting percussion instruments according to claim 50, in which:

said telescoping support members are of a slide and groove construction operable to adjust the position of said shoulder straps relative to said supporting member.

52. A shoulder supported harness assembly for supporting percussion instruments according to claim 51, in which said supporting member is a T-bar support having an upper horizontal bar member, a belly plate member, and said telescoping support member comprising a two-piece vertically oriented bar member secured to and adjustably interconnecting said upper horizontal member and said belly plate member.

53. A shoulder supported harness assembly for supporting percussion instruments according to claim 52, including a horizontal bar member secured to said belly plate member, a pair of receptacles supported for sliding movement on said horizontal bar member, and J-rods supported in said receptacles.

54. A shoulder supported harness assembly for supporting percussion instruments according to claim 53, including a horizontal bar member secured to said belly plate member, a pair of receptacles supported for sliding movement on said horizontal bar member, said bar member and said receptacles being a slide and groove construction operable to adjust the position of said receptacles on said bar member, and J-rods supported in said receptacles.

55. A shoulder supported harness assembly for supporting percussion instruments according to claim 53, including a vertically oriented tube having a plurality of circumferentially spaced grooves extending longitudinally on its exterior surface, means supporting said tube adjacent to said belly plate, collar members operatively connected with said grooves to slide longitudinally therein, at least one pivoted arm having one end supported on said collar members and a distal end movable by said collar members both vertically and angularly relative to said tube, and a pivotal supporting member at the distal end of said pivoted arm.

* * * * *